US009988837B2

(12) United States Patent
Defenbaugh et al.

(10) Patent No.: US 9,988,837 B2
(45) Date of Patent: Jun. 5, 2018

(54) VARIABLE FORCE BRAKE FOR A WINDOW COVERING OPERATING SYSTEM

(71) Applicant: Hunter Douglas Industries Switzerland, GmbH, Lucerne (CH)

(72) Inventors: Michael Defenbaugh, Dunwoody, GA (US); Tim Hyde, San Francisco, CA (US); Brian Bellamy Johnson, Atlanta, GA (US); Joshua Maust, Roswell, GA (US); Miguel Morales, Atlanta, GA (US)

(73) Assignee: HUNTER DOUGLAS INDUSTRIES SWITZERLAND GMBH, Lucerne (CH)

( * ) Notice: Subject to any disclaimer, the term of this patent is extended or adjusted under 35 U.S.C. 154(b) by 281 days.

(21) Appl. No.: 14/481,152

(22) Filed: Sep. 9, 2014

(65) Prior Publication Data

US 2015/0028144 A1 Jan. 29, 2015

Related U.S. Application Data

(63) Continuation-in-part of application No. 13/939,699, filed on Jul. 11, 2013, now Pat. No. 9,217,282.

(60) Provisional application No. 61/877,488, filed on Sep. 13, 2013, provisional application No. 61/671,212, filed on Jul. 13, 2012.

(51) Int. Cl.
*E06B 9/32* (2006.01)
*E06B 9/322* (2006.01)

(52) U.S. Cl.
CPC ..... *E06B 9/322* (2013.01); *E06B 2009/3222* (2013.01)

(58) Field of Classification Search
CPC ..... E06B 9/322; E06B 2009/3222
USPC ..... 160/168.1 R, 170, 173 R, 178.2, 84.01, 160/84.04
See application file for complete search history.

(56) References Cited

U.S. PATENT DOCUMENTS 2,119,550 A * 6/1938 Loughridge ..... E06B 3/90 188/134
2,663,368 A 12/1953 Walker
(Continued)

FOREIGN PATENT DOCUMENTS

DE 19505824 A1 8/1996
EP 1748144 A2 1/2007

OTHER PUBLICATIONS

Newell Window Furnishings, Inc., International Application No. PCT/US2013/50080, International Search Report and Written Opinion, dated Nov. 22, 2013.

*Primary Examiner* — Katherine W Mitchell
*Assistant Examiner* — Johnnie A. Shablack
(74) *Attorney, Agent, or Firm* — Dority & Manning, P.A.

(57) ABSTRACT

An operating system for a window covering includes at least one spring motor, at least one variable force brake, and at least one lift spool assembly operatively coupled to a panel for raising and lowering a panel. An effective shaft is operatively coupled to and synchronizes the spring motor, the variable force brake, and the lift spool. The variable force brake comprises a one-way clutch operatively coupled to the shaft. A brake member is operatively engaged with the one-way clutch to apply a brake force to the one-way clutch when the shaft is rotated. The magnitude of the brake force applied to the one-way clutch is determined by the rotational position of the shaft.

25 Claims, 44 Drawing Sheets

(56) References Cited

U.S. PATENT DOCUMENTS 2,701,611 A 2/1955 Griesser
3,180,400 A 4/1965 Rau
3,194,343 A * 7/1965 Sindlinger ..... F03G 1/00 185/10
3,289,739 A 12/1966 Hensel
3,352,349 A 11/1967 Hennequin
3,404,504 A 10/1968 Taylor
4,042,075 A * 8/1977 Hehl ..... E06B 9/60 160/298
4,200,135 A 4/1980 Hennequin
4,372,432 A 2/1983 Waine et al.
4,498,517 A * 2/1985 Mase ..... E06B 9/82 160/294
4,697,630 A 10/1987 Rude
5,154,558 A 10/1992 McCallion
5,228,491 A 7/1993 Rude et al.
5,328,113 A 7/1994 De Chevron Villette et al.
5,375,643 A * 12/1994 Rude ..... E06B 9/90 160/292
5,482,100 A 1/1996 Kuhar
5,531,257 A * 7/1996 Kuhar ..... E06B 9/32 160/168.1 P
5,725,040 A 3/1998 Domel
5,799,342 A * 9/1998 Last ..... E04H 4/101 4/502
5,908,062 A 6/1999 Fun
5,927,370 A * 7/1999 Judkins ..... E06B 9/262 160/291
6,012,506 A * 1/2000 Wang ..... E06B 9/30 160/170
6,056,036 A * 5/2000 Todd ..... E06B 9/262 160/84.01
6,116,323 A 9/2000 Huang
6,149,094 A 11/2000 Martin et al.
6,530,863 B2 * 3/2003 Balli ..... E06B 9/74 160/310
6,536,503 B1 3/2003 Anderson et al.
6,571,853 B1 * 6/2003 Ciuca ..... E06B 9/60 160/170
6,601,635 B2 * 8/2003 Ciuca ..... E06B 9/32 160/170
6,644,375 B2 * 11/2003 Palmer ..... E06B 9/322 160/170
6,675,861 B2 * 1/2004 Palmer ..... E06B 9/322 160/170
6,718,707 B2 4/2004 Marshall
6,792,997 B2 9/2004 Damiano
6,915,831 B2 7/2005 Anderson
6,945,302 B2 9/2005 Nien
6,948,216 B2 9/2005 Gaudyn et al.
6,968,884 B2 11/2005 Anderson et al.
6,986,378 B2 * 1/2006 Beaudoin ..... E05D 13/003 160/191
7,096,917 B2 * 8/2006 Ciuca ..... E06B 9/322 160/170
7,137,430 B2 11/2006 Fraczek
7,168,476 B2 * 1/2007 Chen ..... E06B 9/322 160/170
7,178,577 B2 2/2007 Liu
7,210,646 B2 5/2007 Hsu
7,254,868 B2 * 8/2007 Mullet ..... E05D 13/003 16/198
7,287,569 B2 * 10/2007 Lin ..... E06B 9/303 160/170
7,311,133 B2 12/2007 Anderson et al.
7,389,956 B2 6/2008 Hung
7,428,918 B2 * 9/2008 Martin ..... E05D 13/003 160/191
7,540,315 B2 6/2009 Chen
7,543,625 B2 * 6/2009 Beaudoin ..... E05D 13/1269 160/191
7,740,045 B2 6/2010 Anderson et al.
7,802,608 B2 * 9/2010 Anderson ..... E06B 9/262 160/170
7,832,450 B2 11/2010 Brace et al.
7,832,453 B2 11/2010 Lin
7,886,803 B2 2/2011 Anderson et al.
8,006,735 B2 8/2011 Collum et al.
8,051,960 B2 * 11/2011 Nakajima ..... E06B 9/80 160/299
8,356,653 B2 * 1/2013 Fu-Lai ..... E06B 9/322 160/170
8,622,184 B2 * 1/2014 Sakai ..... F16D 41/066 192/45.008
8,723,466 B2 * 5/2014 Chambers ..... E05F 15/79 160/166.1
8,887,788 B2 * 11/2014 Toti ..... E06B 9/322 160/170
8,893,766 B2 * 11/2014 Bohlen ..... E06B 9/88 160/297
8,939,190 B2 * 1/2015 Mullet ..... E06B 9/307 160/176.1 P
9,103,157 B2 * 8/2015 Mullet ..... E06B 9/322
9,217,282 B2 * 12/2015 Defenbaugh ..... E06B 9/68
9,217,284 B2 * 12/2015 Panseri ..... E05D 13/003
9,663,986 B2 * 5/2017 Mullet ..... E06B 9/322
9,670,724 B2 * 6/2017 Oakley ..... E06B 9/322
9,695,633 B2 * 7/2017 Morris ..... E06B 9/322
2002/0046817 A1 4/2002 Last
2003/0221799 A1 * 12/2003 Cross ..... E06B 9/322 160/168.1 P
2004/0177933 A1 9/2004 Hillman et al.
2005/0217805 A1 10/2005 Strand et al.
2006/0000561 A1 * 1/2006 Anderson ..... E06B 9/262 160/168.1 R
2006/0108076 A1 * 5/2006 Huang ..... E06B 9/307 160/176.1 R
2006/0118248 A1 6/2006 Anderson et al.
2006/0249264 A1 * 11/2006 Lin ..... E06B 9/303 160/171
2007/0023149 A1 2/2007 Lamars et al.
2007/0039696 A1 * 2/2007 Strand ..... E06B 9/262 160/84.04
2009/0120592 A1 * 5/2009 Lesperance ..... E06B 9/322 160/84.02
2009/0242332 A1 10/2009 Anderson et al.
2009/0294076 A1 12/2009 McNiel
2010/0206492 A1 * 8/2010 Shevick ..... E06B 9/30 160/170
2011/0000628 A1 * 1/2011 Anderson ..... E06B 9/262 160/313
2011/0277943 A1 * 11/2011 Lin ..... E06B 9/262 160/84.04
2012/0048485 A1 * 3/2012 Fu-Lai ..... E06B 9/322 160/331
2012/0145335 A1 * 6/2012 Panseri ..... E05D 13/003 160/2
2013/0248125 A1 * 9/2013 Lin ..... E06B 9/262 160/84.05
2014/0014279 A1 * 1/2014 Defenbaugh ..... E06B 9/68 160/168.1 P
2014/0083631 A1 * 3/2014 Huang ..... E06B 9/322 160/170
2014/0262062 A1 * 9/2014 Higgins ..... E06B 9/42 160/84.01
2015/0028144 A1 * 1/2015 Defenbaugh ..... E06B 9/322 242/378.4
2015/0308186 A1 * 10/2015 Mullet ..... E06B 9/322 160/313
2016/0201389 A1 * 7/2016 Oakley ..... E06B 9/322 160/368.1
2016/0222722 A1 * 8/2016 Schulman ..... E06B 9/322
2016/0369558 A1 * 12/2016 Kirby ..... E06B 9/80
2017/0183904 A1 * 6/2017 Schulman ..... E06B 9/322
2017/0254143 A1 * 9/2017 Guan ..... E06B 9/307

* cited by examiner

VARIABLE FORCE BRAKE FOR A WINDOW COVERING OPERATING SYSTEM

The present application claims benefit of priority to the filing date of U.S. Provisional Application No. 61/877,788 filed on Sep. 13, 2013, the contents of which are hereby incorporated by reference herein in its entirety, and is a continuation-in-part of U.S. patent application Ser. No. 13/939,699 filed on Jul. 11, 2013, the contents of which are hereby incorporated by reference herein in its entirety, which, in turn, claims the benefit of U.S. Provisional Application No. 61/671,212 filed on Jul. 13, 2012, the contents of which are hereby incorporated by reference herein in its entirety.

BACKGROUND

The invention relates to window coverings and more particularly to an operating system for controlling the operation of the window covering. A window covering may comprise a head rail from which a panel is suspended. The head rail may be mounted to a window frame or other architectural feature. The panel may be supported by lift cords to raise and lower the panel relative to the head rail. The raising and lowering of the panel may be controlled using pull cords or the raising and lowering of the panel may comprise a "cordless" system where the panel is raised and lowered by direct manipulation of the panel.

SUMMARY OF THE INVENTION

In one embodiment, an operating system for a window covering comprises at least one spring motor, at least one variable force brake, and at least one lift spool assembly operatively coupled to a panel for raising and lowering a panel. An effective shaft is operatively coupled to and synchronizes the spring motor, the variable force brake, and the lift spool. The variable force brake comprises an outer race selectively coupled for rotation with the shaft by a one-way clutch where the outer race of the brake is in contact with a brake member such that the braking force applied by the brake member to the outer race varies as the panel is raised and lowered.

In some embodiments, a variable force brake for a window covering has a shaft operatively coupled to a panel for raising and lowering the panel. The variable force brake comprises a one-way clutch operatively coupled to the shaft. A brake member is operatively engaged with the one-way clutch to apply a brake force to the one-way clutch when the shaft is rotated. The magnitude of the brake force applied to the one-way clutch is determined by the rotational position of the shaft.

A cam may rotate when the effective shaft rotates, the cam moving a cam follower operatively engaged with the brake member to vary the force of the brake against the one-way clutch. The cam follower may move an adjustment mechanism that engages the brake member. The outer race may have a generally cylindrical shape that defines a cylindrical brake surface and the brake member may comprise a band brake that is in contact with the brake surface. The band brake may have a first end and a second movable end where the movable end is moved toward the second end to adjust the force applied by the brake to the one-way clutch by the adjustment mechanism. The adjustment mechanism may adjust the compression of a spring that exerts a variable force on the brake member. The magnitude of the braking force may be varied over a range and the range may be adjustable. The one-way clutch may comprise a one-way needle bearing comprising a plurality of needle bearings that receive the effective shaft where the one-way needle bearing is mounted for rotation with the outer race. The cam may be operatively connected to the effective shaft such that the cam rotates when the effective shaft rotates where the cam has a cam surface that is shaped to define a force curve where the force curve increases the braking force when the panel is moved in a first direction and decreases the braking force when the panel is moved in a second direction. The slope of the force curve may change over the extent of the cam surface. The brake member may have a first end and a second movable end where the movable end is moved toward the second end to adjust the force applied by the brake member to the one-way clutch by the adjustment mechanism.

DETAILED DESCRIPTION OF EMBODIMENTS OF THE INVENTION

Embodiments of the present invention will be described more fully hereinafter with reference to the accompanying drawings, in which embodiments of the invention are shown. This invention may, however, be embodied in many different forms and should not be construed as limited to the embodiments set forth herein. Like references numbers are used to refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Relative terms such as "below" or "above" or "upper" or "lower" or "horizontal" or "vertical" or "top" or "bottom" or "front" or "rear" may be used herein to describe a relationship of one element, area or region to another element, area or region as illustrated in the figures. It will be understood that these terms are intended to encompass different orientations of the device in addition to the orientation depicted in the figures.

Figure 1:
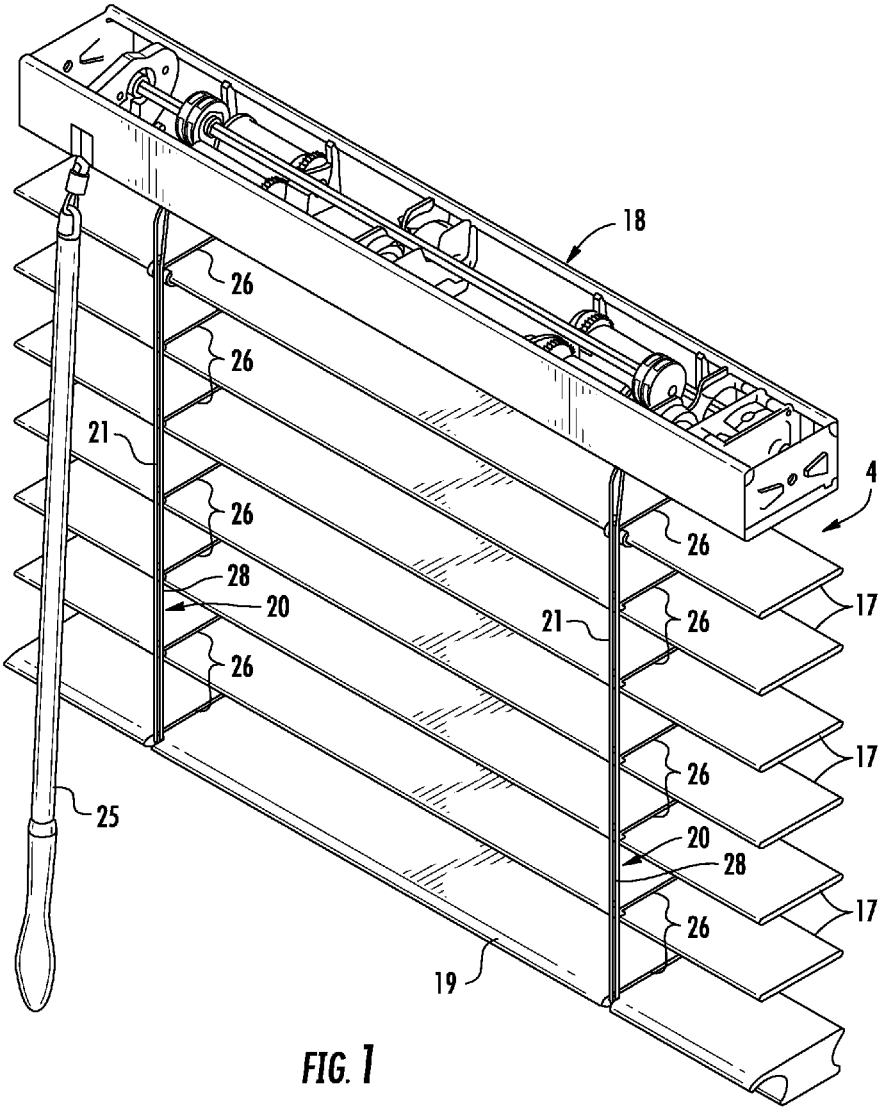
FIG. 1 is a perspective view of an embodiment of a window covering of the invention.
Figure 2:
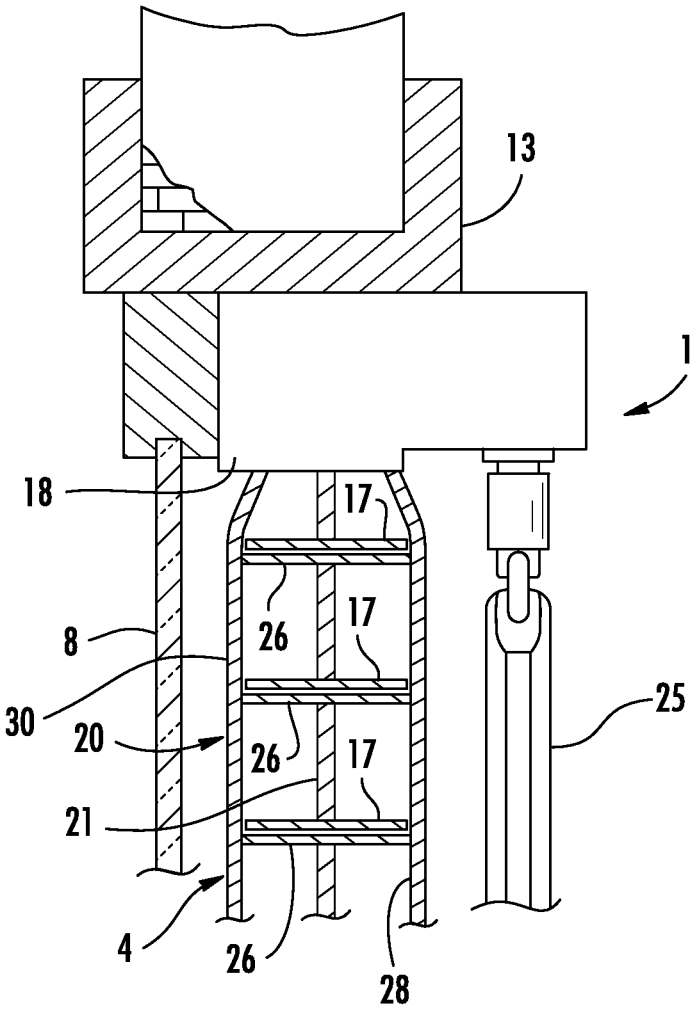
FIG. 2 is a partial side section view of another embodiment of the window covering of the invention.

Referring to FIGS. 1 and 2 an embodiment of a window covering 1 is shown comprising a head rail 18 from which a panel 4 is suspended. The panel may comprise a slatted blind, a cellular shade, pleated shade, Roman shade, natural shade or other blind or shade construction or combinations thereof. In the illustrated embodiment panel 4 comprises a slatted blind comprised of a plurality of slats 17. The head rail 18 may be constructed of wood, steel or other rigid material and may be solid or have an interior channel. It is appreciated that, in some embodiments, the term "head rail" need not be limited to a traditional head rail structure and may include any structure, component or components from which a shade may be suspended or supported and which may include the operating system. The head rail 18 may be mounted to a window frame or other architectural feature 13 by brackets or other mounting mechanism to cover the window or other opening 8 (FIG. 2). The panel 4 has a top edge that is located adjacent to the head rail 18 and a bottom edge remote from the head rail 2 that may terminate in a bottom rail 19.

The shade panel 4 may be supported by lift cords 21 that are connected to or near the bottom edge of the panel 4 or to the bottom rail 19. The lift cords 21 may be retracted toward the head rail 18 to raise the shade or extended way from the head rail to lower the shade. The lift cords 21 may be operatively connected to the operating system that may be used to raise and lower the shade panel as will hereinafter be described. In one type of window covering, known as a privacy panel, each lift cord extends down the outside of one side of the panel, around the bottom of the panel and up the outside of the other side of the panel, as shown in FIG. 1. In another embodiment of a privacy panel the lift cord comprises a first lift cord section that extends down the outside of one side of the panel to the bottom of the panel and a second lift cord section that extends down the outside of the other side of the panel to the bottom of the panel. The lift cord sections may be connected to one another, to the bottom of the panel or to bottom rail, or both. In another type of window covering the lift cords 21 extend through apertures formed in the shade panel, such as through apertures in slats 17, as shown in FIG. 2.

For a slatted blind, the slats 17 are also supported by a tilt cord 20 that functions to tilt the slats 17 between open positions where the slats 17 are spaced from one another and closed positions where the slats 17 are disposed in an abutting, overlapping manner. The tilt cord 20 may comprise a ladder cord as shown that supports the individual slats 17 where manipulation of the ladder cord results in the tilting of the slats 17 between an open position, closed positions and any intermediate position. The tilt cord 20 may be controlled by a user control 25 such as a control wand or cord that is manipulated by the user to adjust the opening and closing of the slats. Each tilt cord 20 may comprise a ladder cord that has a plurality of rungs 26 that are connected to and supported at each end by vertical support cords 28 and 30. A slat 17 rests on top of is otherwise supported by each rung 26. A drum or other control device may be rotated by a user using a control 25 such that the front vertical support cord 28 may be raised or lowered while the back vertical support cord 30 is simultaneously lowered or raised, respectively, to tilt the rungs 26 and the slats 17. Typically, the slats will be supported by two or more tilt cords 20 and two or more lift cords 21 depending upon the width of the window covering. While specific embodiments of a window covering are disclosed, the window covering may have a wide variety of constructions and configurations.

The operating system for controlling movement (raising and lowering) of the panel uses a cordless design where the raising and lowering of the panel is adjusted by manually moving the panel into position and then releasing the panel. The operating system, if balanced properly, holds the panel in position without the panel sagging (lowering) or creeping (rising). The operating system described herein may be used to control the movement of the bottom edge of a traditional panel and/or the top edge of a top down panel. The operating system uses spring motors, take-up spools and brakes to balance the load of the panel such that it may be moved into a desired position without sagging or creeping. It is difficult to balance the load of a window covering panel because the forces exerted by the spring motor, brake and system friction must be balanced against the supported load of the panel where the load of the panel supported by the lift cords varies as the panel is raised and lowered. As a result, cordless window coverings have been limited to custom blinds where the window covering may be weighted to balance against the forces generated by the spring motor, brake and system friction. The operating system of the invention is an improved cordless operating system that is more easily and effectively balanced and is less expensive than existing systems. As a result, the operating system of the invention may be used with size-in-store window coverings, lower cost window coverings as well as custom blinds. With size-in-store blinds the operating system is located such that the width of the window covering may be cut down to a desired size outside of the factory without adversely affecting the operating system. The operating system may be easily tuned to balance the size of the panel even after being cut down in a size-in-store operation.

Figure 3:
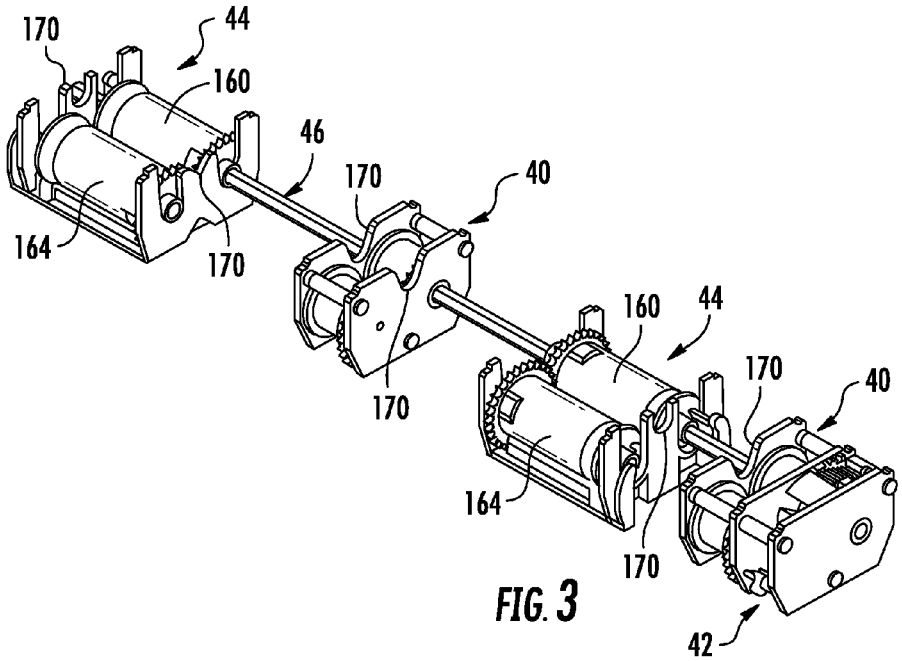
FIG. 3 is a perspective view of an embodiment of an operating system of the invention.

An embodiment of the operating system of the invention is shown in FIG. 3 and comprises at least one spring motor 40, at least one brake 42, at least one lift spool assembly 44 and a shaft 46 interconnecting and synchronizing these components. In a typical use two or more lift spool assemblies 44 are used each supporting a lift cord depending upon the size of the blind. The spools 160 and 164 of lift spool assembly 44 may be connected to the panel 4 by lift cords that are wound onto and unwound from the spools. In operation, the spring motor or motors 40 apply a force on the shaft 46 that rotates the spools 160 and 164 in a direction that winds the lift cords onto the spools and raises the panel. According to one embodiment, the force applied by the spring motors 40 can be slightly underpowered relative to the load of the panel such that a raised panel will tend to sag (or otherwise continue unwinding) when released under the weight of the panel. In other embodiments, however, an overpowered motor may be utilized, such that the panel may tend to rise (creep) under the power of the motor when released. As described below, it may be one goal of operating system design to match the motor force output to the load of the panel throughout the blind's travel (recognizing that as a panel is raised and lowered the load placed on the motor varies along the length of the travel). Thus, in some embodiments, a brake may not be required and the motor or motors may be configured such that the motor output approximately closely equals the corresponding load of the panel along the length of travel. Accordingly, any embodiments described herein may be provided without a braking mechanism (depending upon the selected motor configuration). However, some embodiments, as described in more detail herein, can utilize braking mechanisms to accommodate for any slight differences between the panel load and motor output. In some embodiments, different braking mechanisms other than those described herein, as are known, may be utilized.

According to one embodiment, the brake 42 may be a one-way brake that applies a braking force on the shaft 46 that resists rotation of the shaft in the lowering direction such that sagging of the window covering is prevented. When a user raises the panel 4, the spring motors 40 wind the lift cords on the spools of the lift spool assemblies 44 and assist the user in raising the panel. When the user releases the panel 4, the brake 42 holds the shaft 46 in the desired position and prevents sagging of the panel. To lower the panel 4, the user pulls down on the bottom of the panel 4 (or on the top of the panel in a top down shade) to overcome the brake force generated by brake 42 and the forces generated by the spring motors 40. However, as described further herein, a one-way brake may be applied in the opposite direction to resist rotation of the shaft in the raising direction.

Figure 4:
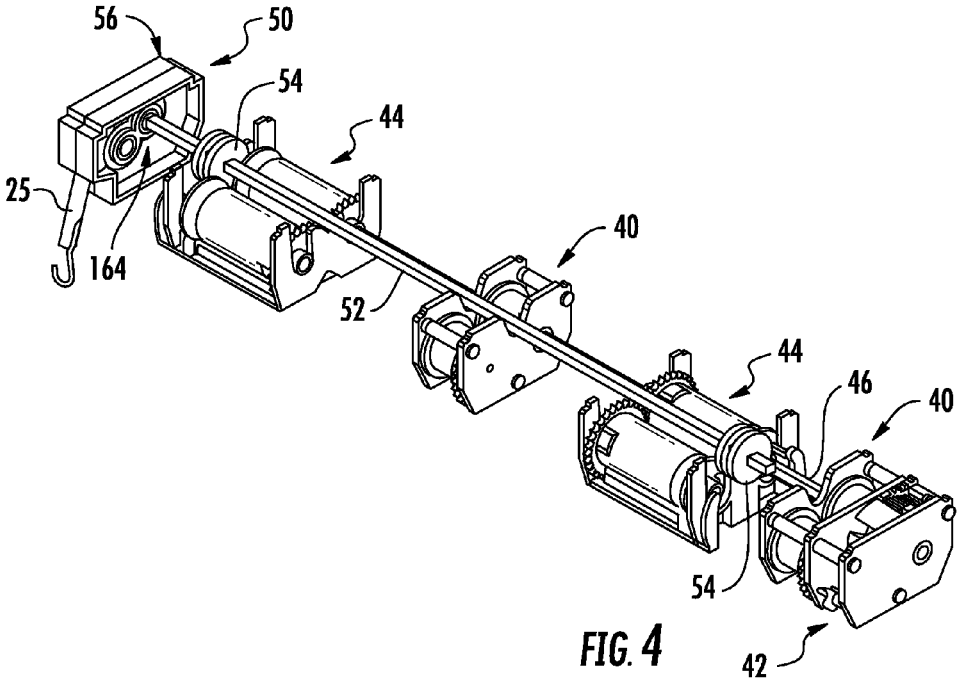
FIG. 4 is a perspective view of another embodiment of an operating system of the invention.
Figure 5:
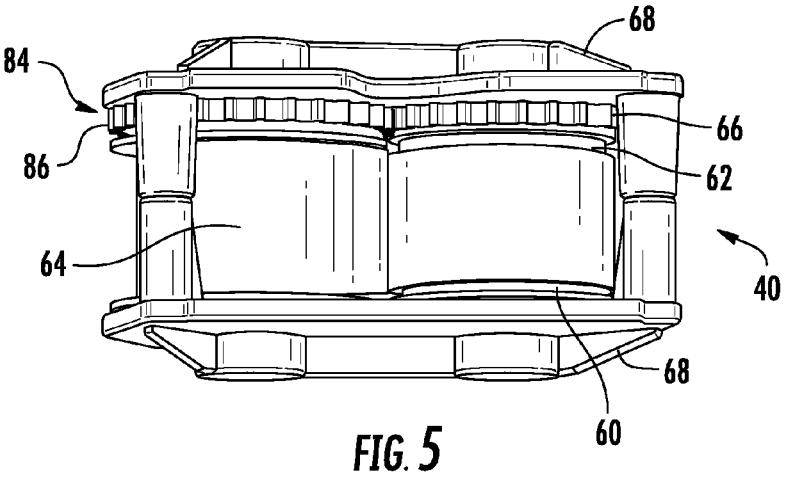
FIG. 5 is a perspective view of an embodiment of a spring motor usable in the operating system of the invention.

Referring to FIG. 4, for a slatted blind with tilting slats a tilt system 50 may also be provided. In one embodiment, the tilt system 50 comprises a second shaft 52 supporting at least one tilt drum 54. A tilt assembly 56 rotates the shaft 52 when actuated by a user control 25. In typical use two or more tilt drums 54 may be used depending upon the size of the blind. The tilt drums 54 may be connected to the slats by tilt cords 20 such that rotation of the drums 54 moves the tilt cords to open and close the slats.

Figure 6:
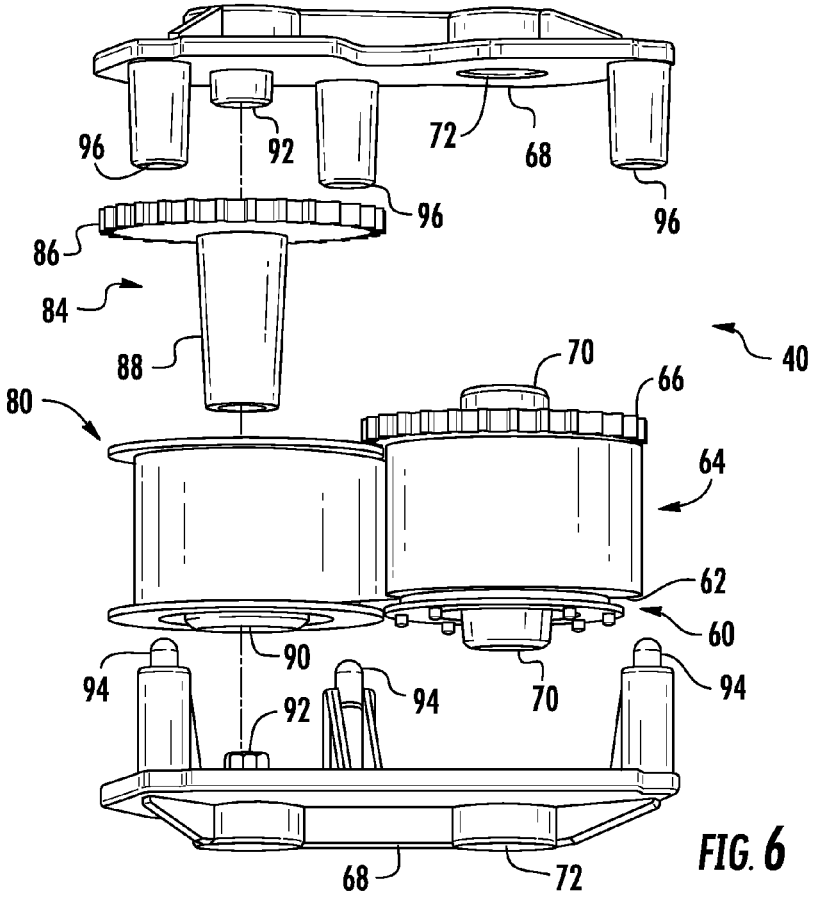
FIG. 6 is an exploded perspective view of the spring motor of FIG. 5.
Figure 7:
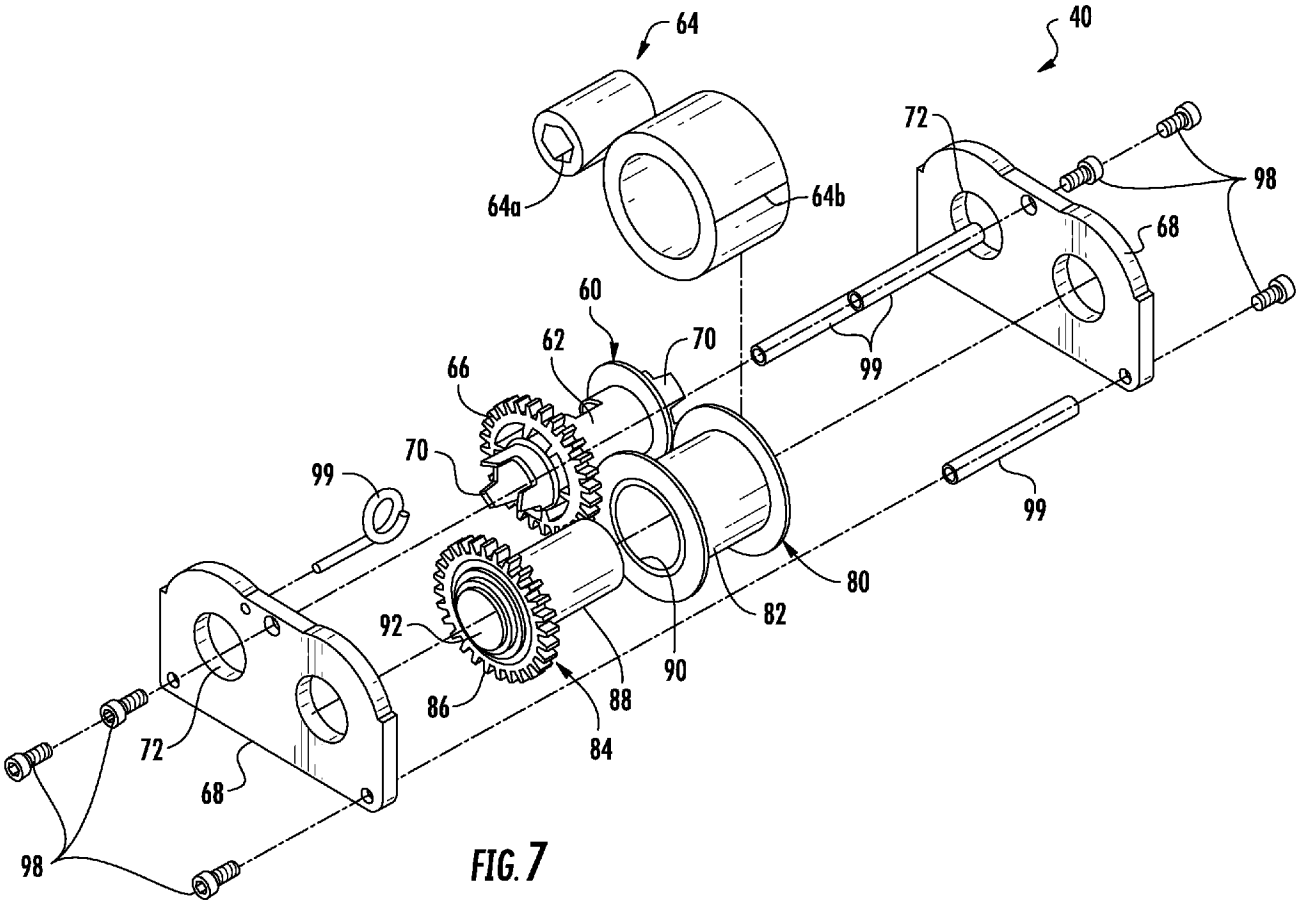
FIG. 7 is an exploded perspective view of another embodiment of a spring motor usable in the operating system of the invention.

Description of the spring motor 40 will be described with reference to FIGS. 5 through 9. According to one embodiment, the spring motor 40 is retained in a housing where the housing may for example comprise a pair of side plates 68 connected to one another to support the components of the spring motor in the head rail. In the illustrated embodiment, the side plates 68 may be secured together using a snap-fit connection by inserting pins 94 formed on one of the side plates into mating receptacles 96 formed on the other side plate as shown in FIG. 6. The side plates 68 may also be connected using separate fasteners 98 and connecting members 99 as shown in FIG. 7. The side plates 68 may also be connected by welding, adhesive or any other suitable mechanism.

Figure 8:
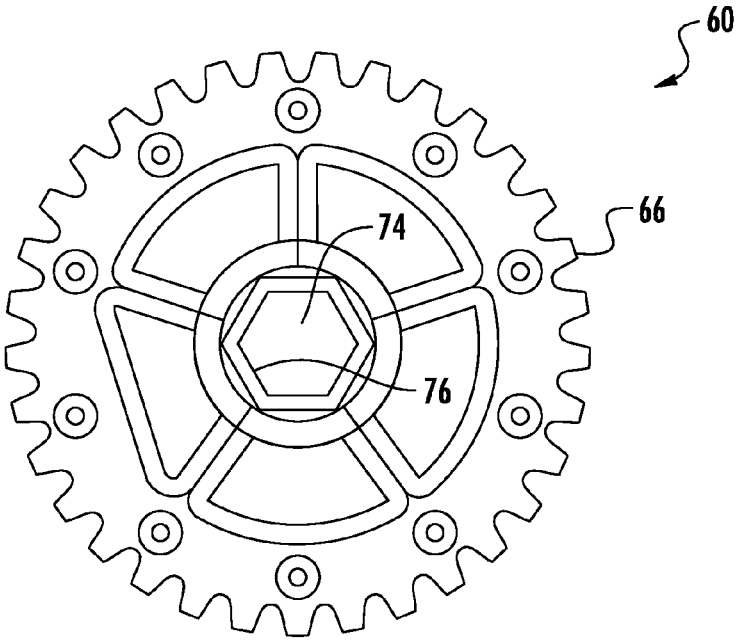
FIG. 8 is a front view of an embodiment of a drum usable in a spring of the invention.
Figure 9:
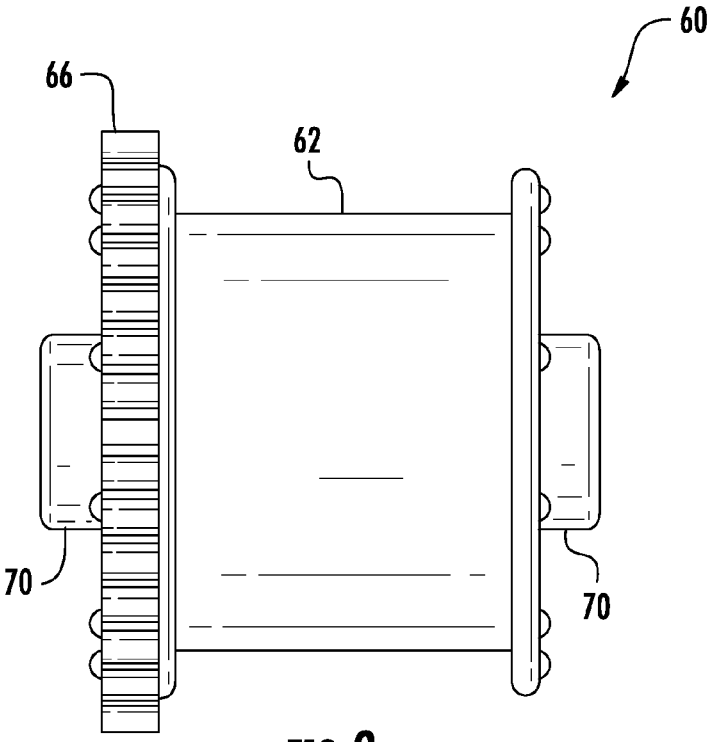
FIG. 9 is a side view of the drum of FIG. 8.

The spring motor 40 comprises a power spool 60 having a drum 62 for receiving a spring 64. Although not required in all embodiments, according to one embodiment, the power spool 60 also comprises a gear 66 mounted for rotation with the drum 62. Power spool 60 rotates about an axis formed by axles 70 that are supported in apertures 72 formed in side plates 68. A through hole 74 extends through the power spool 60 and defines the axis of rotation of the spool (FIG. 8). The shaft 46 extends through hole 74 such that the spring motor 40 may be located anywhere along the length of the shaft 46. The power spool 60 and shaft 46 are operatively coupled together for rotation. The power spool 60 and shaft 46 may be operatively coupled using a keyed connection such as by using mating non-round profiles 76 where the shaft 46 may be inserted through the power spool 60 but the power spool and shaft 46 are constrained to rotate together. As shown, the shaft 46 comprises a plurality of flat faces that extend the length of the shaft and that engage a plurality of mating flat faces formed on the interior periphery of hole 74. Such an arrangement allows the shaft 46 to be slid through the hole 74 but constrains the shaft 46 and power spool 60 to rotate together. Other keyed connections or couplers between spool 60 and shaft 46 may also be used such as a cotter sleeve, set screw or the like.

The spring motor 40 also comprises a take-up spool 80 including a drum 82 for receiving the spring 64. The take-up spool 80 is mounted on an idler gear 84 such that the take-up spool 80 and idler gear 84 may rotate both together and relative to one another as will hereinafter be described. The idler gear 84 comprises a gear 86 that is mounted to a post 88 where the post 88 is received in and extends through a sleeve 90 in drum 82 and forms the rotational axis of the drum 82 and the idler gear 84. The post 88 and sleeve 90 frictionally engage one another but may rotate relative to one another when the friction between the post 88 and sleeve 90 is overcome. Post 88 freely rotates about an axis formed by pins 92 that extend from side plates 68. The pins 92 engage a bore 92 that extends through the post 88. Other mounting mechanisms for rotatably mounting the idler gear 84 may also be used.

The power spool 60 and the idler gear 84 are mounted between the side plates 68 such that the power spool 60 and idler gear 84 may freely rotate. The power spool 60 and the idler gear 84 are positioned such that gear 66 engages gear 86. Spring 64 is wound on the power spool 60 and take-up spool 80 such that as the panel 4 is lowered the spring 64 is wound onto the power spool 60 and is unwound from the take-up spool 80. Energy is stored in the spring 64 as it is wound on the power spool 60. As the panel is raised the spring 64 unwinds from the power spool 60 back onto the take-up spool to rotate the shaft 46 and wind the lift cords 21 on the spools of lift spool assemblies 44.

According to one embodiment, the spring 64 may comprise a variable force spring and may be designed such that maximum torque is generated when the panel is fully raised and the load on the lift cords 21 from supporting the full weight of the panel is greatest and a minimum torque is generated when the panel 4 is fully lowered and the load on the lift cords from supporting the panel is lowest. Because the spring force is relatively low when the panel 4 is initially raised from the fully lowered position, the possibility exists that the spring 64 will "billow" around the take-up spool 80 rather than being tightly wound around the spool. To prevent the billowing of the spring 64 the power spool 60 and take-up spool 80 may be geared together by gears 66 and 86 such that the take-up spool 80 is forced to rotate and wind the spring 64 when the panel 4 is initially raised. However, because the speed at which the spring 46 moves does not match the rotational speed of the take-up spool 80 over the entire range of motion, the take-up spool 80 and power spool 60 may spin at different speeds over the range of motion. Therefore, it may be preferable to allow the drums 82 and 62 to spin independently of one another over at least portions of the range of motion of the panel. By mounting the take-up spool drum 82 on post 88 of idler gear 84, the drum 82 may spin freely relative to the idler gear 84 when the friction between the idler gear 84 and drum 82 is overcome to allow independent rotation of the drum 80 relative to power spool 60. If the spring 64 does not billow or the billowing of the spring does not cause binding or otherwise interfere with the operation of the motor, the idler gear 84 and/or drive gear 66 may be eliminated and take-up spool 80 may be allowed to rotate independently of power spool 60 throughout the entire range of motion.

The arrangement of the spring 64 will be described. According to some embodiments, it may be desired to approximately match the output torque of the spring 64 to the load supported by the spring motor 40 over the entire range of motion of the panel 4 between the fully raised position and the fully lowered position. In a typical window covering the load supported by the lift cords increases as the panel is raised and decreases as the panel is lowered. This is because as the panel is raised the panel stacks on top of itself and on the bottom rail and the stacked load is supported by the lift cords. As the panel is lowered the panel unstacks such that more of the load of the panel is transferred to and supported by the tilt cords and/or head rail, depending on the style of window covering, and less of the load is supported by the lift cords. Thus, it may be desirable to increase the torque output of the spring motor 40 as the panel is raised and to decrease the torque output as the panel is lowered.

To provide a variable force output, a variable force spring 64 may be used. According to one embodiment, the natural diameter of the spring 64 varies along the length of the spring to produce a variable output. The variable force spring can be created by winding a metal strip into a coil where the spring has a smaller diameter on the inside end of the coil (higher spring force) and an increasingly larger diameter to the outside end of the coil (lower spring force). However, if the spring 64 is mounted on the motor 40 as coiled the smaller diameter would be on the inside of the spring coil and the torque output by the motor 40 would increase as the coil is extended (i.e. the torque would increase as the panel is lowered). This is the opposite force curve desired in the operation of a window covering. To achieve the desired force curve, the spring is mounted on the spools in a reverse manner such that the larger natural diameter is on the inside end of the coil at end 64*a* and the smaller natural diameter is on the outside end of the coil at end 64*b* (FIG. 7). With the coil mounted in the reverse manner the torque output by the spring motor 40 decreases as the coil is extended (i.e. the torque decreases as the panel is lowered) because the highest torque is generated at the outside end of the coil as the spring 64 is just being extended.

It is appreciated that a variable force spring 64 can be generated in a number of other manners, which may also be utilized in the embodiments described herein. For example, a variable force spring may be formed by tapering the spring from a first end of the spring to a second end of the spring such that the thickness and/or width of the spring varies (rather than or in addition to its curvature) along its length. Another example of a variable force spring comprises a spring having a series of apertures or other cutouts formed along the length of the spring where the cutouts increase in size from a first end of the spring to a second end of the spring. Other embodiments for creating a variable force spring may also be used.

In one embodiment, to create the spring motor 40, the coil spring 64 is wrapped on the storage spool 80 and the storage spool 80 and power spool 60 are mounted between the side plates 68. The spring 64 is then reverse wrapped on the power spool 80 to preload the spring. The power spool 80 is held in the reversed wrap condition such as by inserting a pin 99 that engages the power spool 60 and one of the side plates 68. The reverse wrapped (preloaded) spring motor 40 is inserted into the head rail of the blind and is connected to the shaft 46 when the panel 4 is in the in the fully lowered position.

It may be difficult to construct the spring motor 40 such that the torque generated by the spring motor exactly matches the varying load of the panel 4. As a result, the spring motor 40 may be designed such that it is intentionally either underpowered or overpowered relative to the load of the panel. If the spring motor 40 is slightly underpowered the panel will tend to sag and if the spring motor is slightly overpowered the panel will tend to creep. A one-way brake 42 is used to prevent the sagging or creeping of the panel 4 depending on whether an overpowered or underpowered spring motor is used. In the illustrated embodiment the spring motor 40 is designed such that the force generated by the spring motor is slightly underpowered relative to the load of the panel 4 and the brake 42 is used to prevent sagging. The operating system of the invention may also be used with an overpowered spring motor where the brake function is reversed to prevent creeping.

Figure 18:
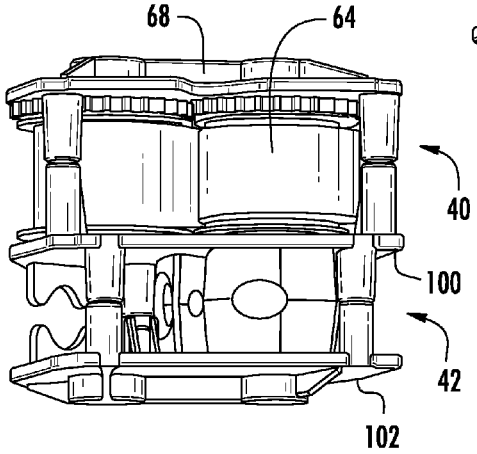
FIG. 18 is a perspective view of an embodiment of a spring motor and brake usable in the operating system of the invention.
Figure 19:
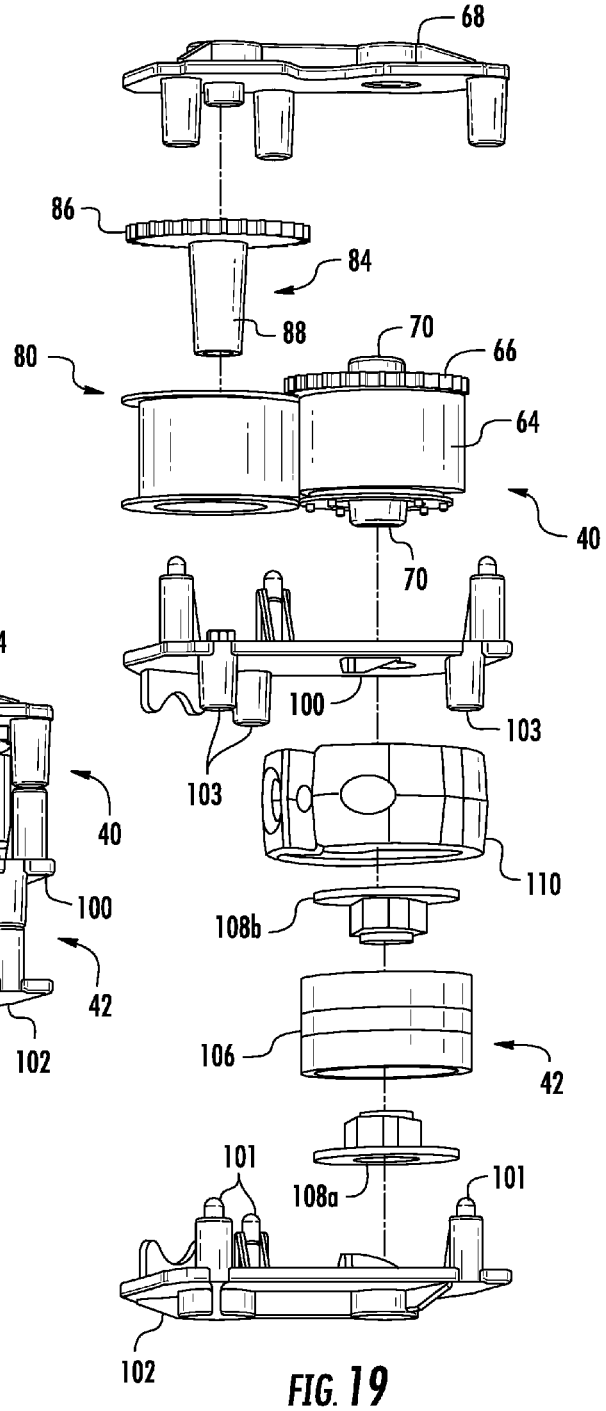
FIG. 19 is an exploded perspective view of the spring motor and brake of FIG. 18.
Figure 20:
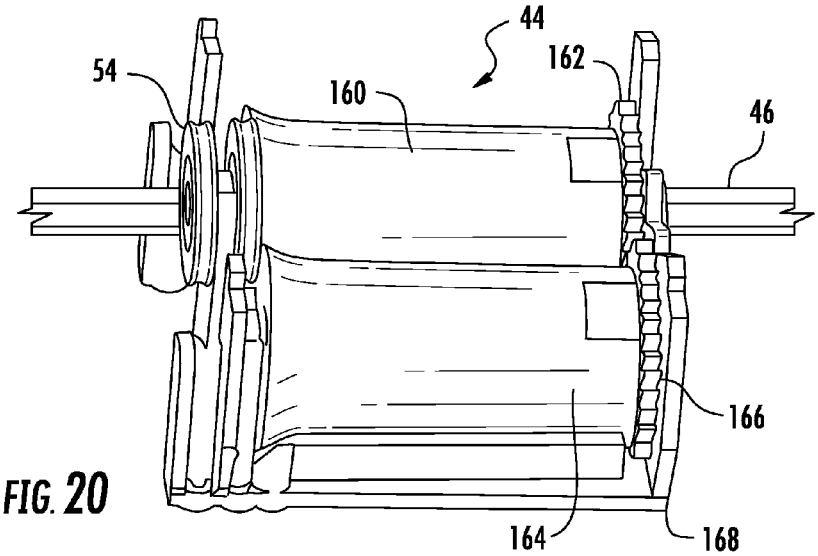
FIG. 20 is a perspective view of an embodiment of a spool assembly usable in the operating system of the invention.
Figure 21:
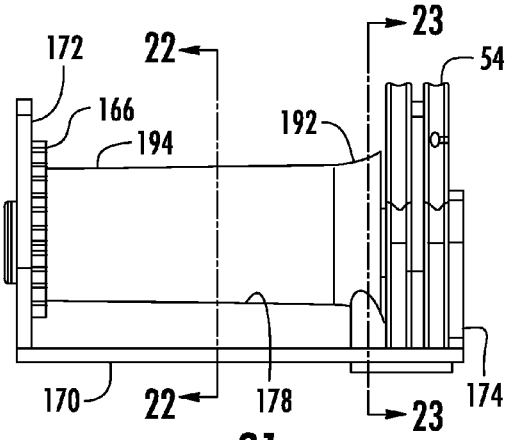
FIG. 21 is a side view of the spool assembly of FIG. 20.
Figure 22:
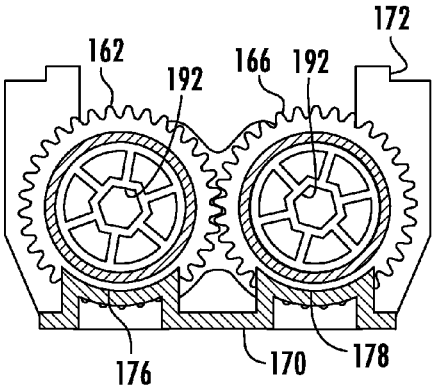
FIG. 22 is a section view of the spool assembly taken along line 22 of FIG. 21.
Figure 23:
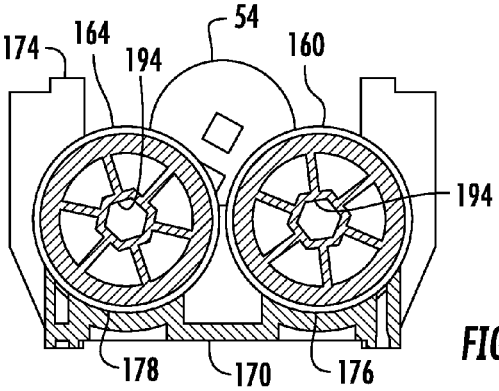
FIG. 23 is a section view of the spool assembly taken along line 23 of FIG. 21.
Figure 24:
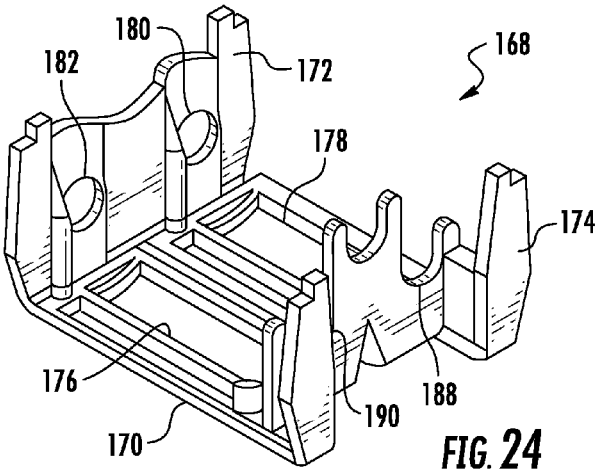
FIG. 24 is a perspective view of a cradle of the spool assembly of FIG. 20.

One embodiment of a brake 42 suitable for use in the operating system of the invention is shown in FIGS. 10 through 19. The brake 42 may comprise a pair of side plates 100 and 102 that form a housing that trap the brake components and that may be mounted in a head rail. In one embodiment, the spring motor and the brake may be contained within housings that are connected to one another. For example, one of the side plates of the brake 42 also acts as the side plate of the spring motor 40 as shown in FIGS. 18 and 19 such that the brake 42 and spring motor 40 may form a unit.

The spring motor 40 and brake 42 may also be formed as separate units that are independently mounted to the shaft 46. The brake 42 comprises an outer race 106 and an inner race 108 where the inner race 108 is connected to the outer race 106 using a one-way clutch. The inner race 108 is mounted for rotation with the shaft 46 and the outer race 106 is in contact with an adjustable band brake 110. The brake force may be applied to the outer race using a mechanism other than a band brake such as a clamp brake, brake shoe and the like.

Figure 11:
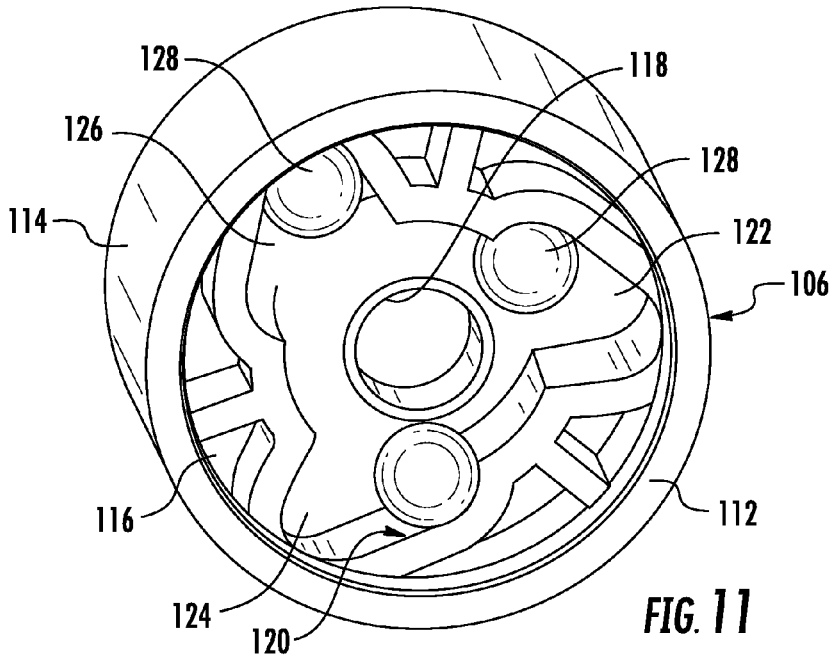
FIG. 11 is a perspective view of an embodiment of a brake component of the brake of FIG. 10.
Figure 12:
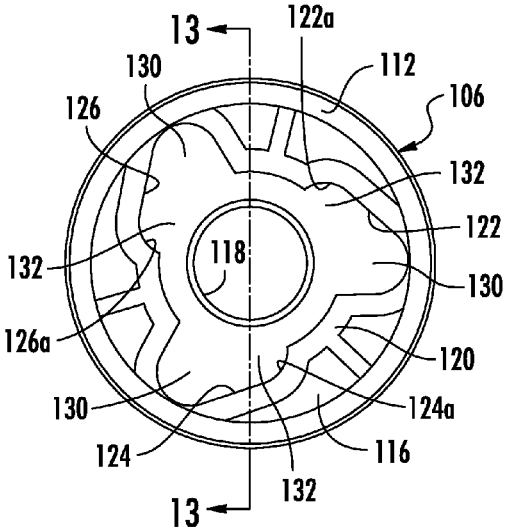
FIG. 12 is a side view of the outer race of the brake of FIG. 10.
Figure 13:
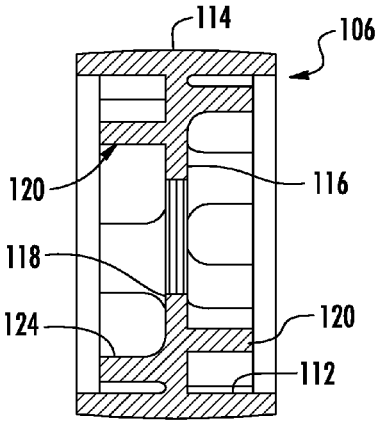
FIG. 13 is a section view taken along line A-A of FIG. 12.

Referring to FIGS. 11-13, the outer race 106 has a generally cylindrical shape that defines a cylindrical outer wall 112 defining a brake surface 114. Located internally of the outer wall 112 is a web 116 comprising a centrally located bore 118 that defines the axis of rotation of the outer race 106. A shaped wall 120 extends from each side of web 116 that defines a plurality of recesses 122, 124 and 126 where each of the recesses receives a ball bearing 128, as will be described. The arrangement of wall 120 and recesses 122, 124 and 126 are identical on both sides of web 116 (although angularly offset from one another 60 degrees) such that only one side of the outer race 106 will be described. The recesses 122, 124 and 126 define a first unlocked position 130. When the ball bearings 128 are located in the unlocked positions 130 the inner race 108 and outer race 106 are decoupled such that the inner race 108 is freely rotatable relative to the outer race 106 in a second direction. The recesses 122, 124 and 126 cooperate with the inner race 108 to define a second locked position 132 for receiving ball bearings 128. When the ball bearings 128 are located in the locked positions 132 the inner race 108 and outer race 106 are coupled together for simultaneous rotation in a first direction. In the illustrated embodiment three recesses and ball bearings are provided on each side of the outer race 106; however, a greater or fewer number of recesses and ball bearings may be used.

Figure 14:
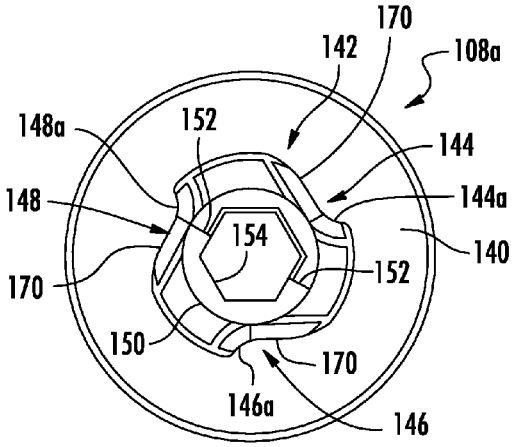
FIG. 14 is a side view of the inner race of the brake of FIG. 10.
Figure 15:
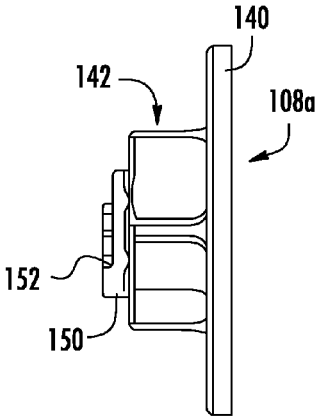
FIG. 15 is a front view of the inner race of FIG. 14.

The inner race 108 is rotatably mounted in the bore 118 of the outer race 106 such that the inner race 108 may rotate relative to the outer race 106. The inner race 108 comprises a first section 108*a* and a second section 108*b* that together form the inner race (FIGS. 14, 15 and 19). The sections 108*a* and 108*b* are identical to one another such that section 108*a* will be described in detail with reference to FIGS. 14 and 15. Section 108*a* comprises an outer wall 140 that fits into the area defined by outer wall 112 of the outer race 106 and a hub 142 that is positioned inside of the space defined by shaped wall 120. The hub 142 defines a plurality of recesses 144, 146 and 148 that are in a one-to-one relationship with the recesses 122, 124 and 126 on the outer race 106. Inner recesses 144, 146 and 148 and outer recesses 122, 124 and 126 cooperate to form a releasable one-way coupling between the inner race 108 and outer race 106. The hubs 142 of the two sections 108*a* and 108*b* define mating bearing structures 150 that fit into bore 118 and rotate relative to the bore. The bearing structures 150 on each of sections 108*a* and 108*b* comprise mating faces 152 that engage one another such that the two sections 88*a* and 88*b* rotate together as a unit relative to the outer race 106. Additional connection mechanisms for holding the sections 88*a* and 88*b* together may also be used such as welding, adhesive, mechanical fastener or the like. The hub 142 further defines an aperture 154 that receives the shaft 46 such that shaft 46 may extend through the inner race 108. The shaft 46 and the inner race 108 are keyed together or otherwise coupled and rotate as a unit. In the illustrated embodiment the shaft 46 and aperture 154 are formed with mating non-round profiles; however, other keyed connections or couplings may be used.

A ball bearing 128 is positioned in the each of the spaces defined between the outer recesses 122, 124 and 126 and the inner recesses 144, 146 and 148. The ball bearings 128 are trapped between the web 116 of the outer race 106 and the side walls 120 of the inner race but are free to move in the spaces defined by the inner recesses 144, 146 and 148 and the outer recesses 122, 124 and 126.

Figure 10:
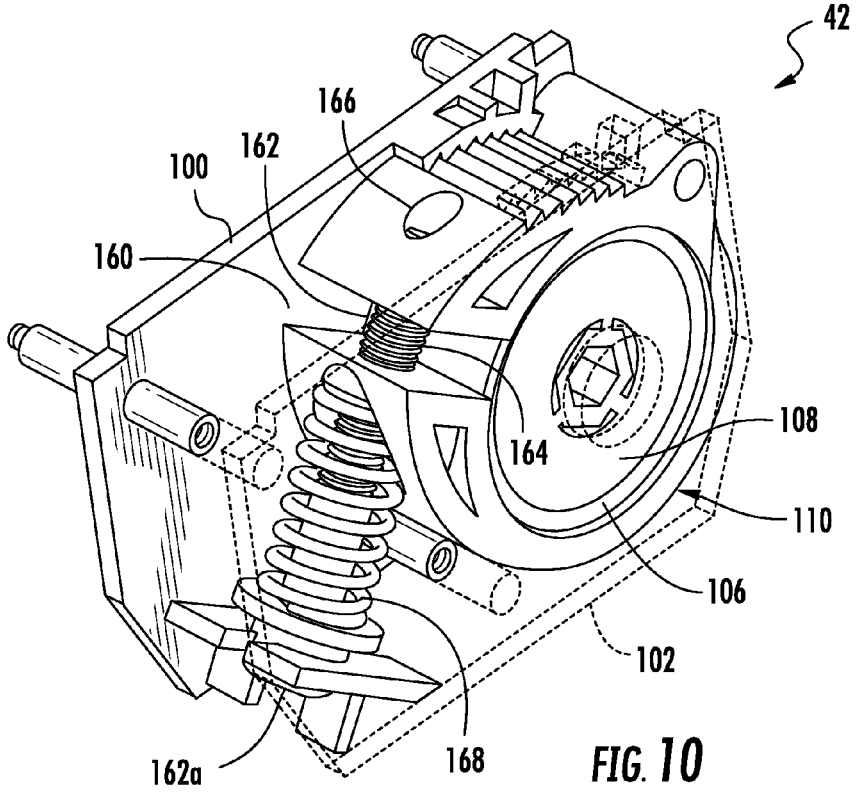
FIG. 10 is a perspective view of an embodiment of a brake usable in the operating system of the invention.
Figure 16:
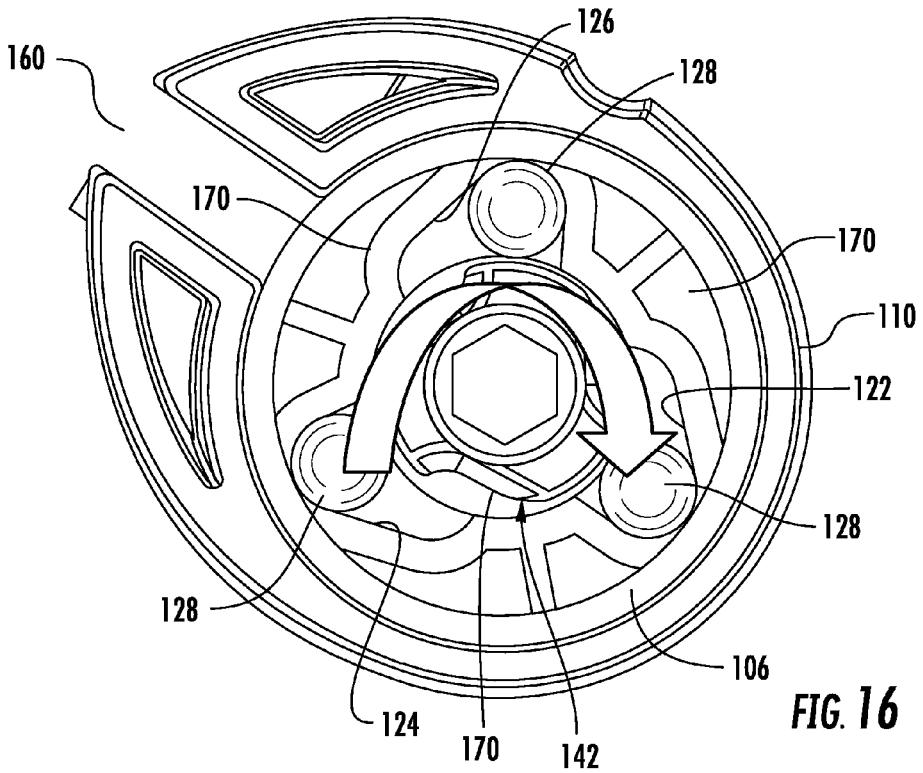
FIGS. 16 and 17 show the operation of the brake of FIG. 10.
Figure 17:
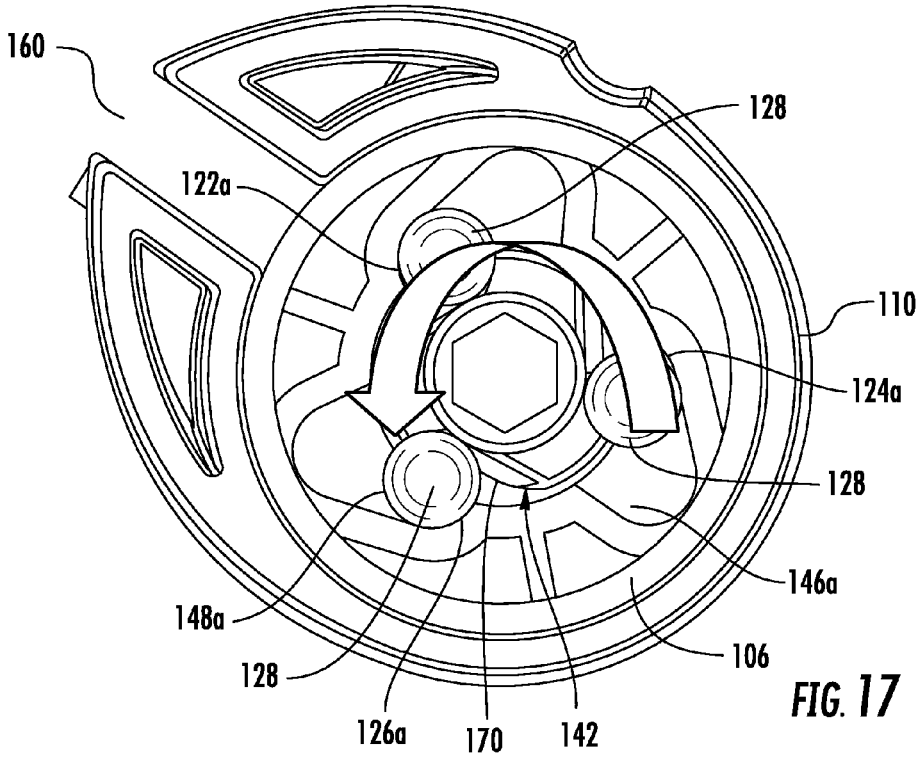

A brake member is provided that contacts the brake surface 114 on outer race 106 to apply the braking force to the system. Referring to FIGS. 10, 16 and 17, in one embodiment, the brake member comprises a band brake 110 that is disposed over the outer race 106 and includes a substantially cylindrical brake surface that contacts the cylindrical brake surface 114 of the outer race 106. The band brake 110 is fixed to the side plates 82 and 84. The outer race 106 rotates relative to the band brake 110 where the friction force between the band brake 110 and the outer race 106 controls the rotation of the outer race. The band brake 110 is in the form of a C-shape such that a gap 160 is formed in the band brake. An adjustment mechanism is provided to adjust the brake force applied by the brake. In one embodiment the adjustment mechanism comprises a screw 162 that is inserted through a smooth bore 164 on one free end of the band brake 110 and is threaded into a threaded hole 166 on the other free end of the band brake. A spring 168 is mounted between the head 162*a* of the screw 162 and the first free end of the band brake such that the spring 168 exerts a force on the first free end of the band brake 110 tending to push the first free end toward the second free end of the band brake to clamp the outer race 106 in the band brake. The screw 162 may be threaded into or out of the threaded hole 166 to adjust the compression of the spring 168 to thereby adjust the force exerted by the band brake 110 on the outer race 106.

Reference will be made to FIGS. 16 and 17 to describe the operation of the brake 42. To facilitate the explanation of the operation of the system, reference is made to the "clockwise" and "counterclockwise" rotation of the operating system. It is understood that in operation the shaft and brake may rotate in either direction to effect braking and that the direction of rotation also depends on the point of view of the observer. When the panel 4 is raised the shaft 46 rotates, clockwise as shown in FIG. 16. Because the shaft 46 and inner race 108 are coupled to rotate together the inner race 108 also rotates clockwise. As the inner race 108 rotates, a cam surface 170 of each of the inner recesses 144, 146 and 148 contacts the ball bearings 128 to force the ball bearings 128 into the upper portion of the outer recesses 122, 124 and 126 to the unlocked positions 130. In the unlocked positions the ball bearings 128 do not interfere with the rotation of the inner race 108, and the inner race 108 rotates freely relative to the outer race 106. Because the inner race 108 is not coupled to the outer race the band brake 110 does not affect rotation of shaft 46. As long as inner race 108 rotates in this direction the ball bearings 128 are pushed to the unlocked positions 130 by the cam surfaces 170. Thus, during the raising of the panel 4 the shaft 46 is rotated by the spring motor(s) 40 to wind the lift cords and to provide lift assist and the inner race 108 freely rotates relative to the outer race 106 such that the brake 42 exerts no braking force on the inner race 108 or shaft 46.

When the panel is lowered the shaft 46 rotates counterclockwise as shown in FIG. 17. Because the shaft 46 and inner race 108 are keyed to rotate together the inner race 108 also rotates counterclockwise. As the inner race 108 rotates counterclockwise the ball bearings 128 are moved by the inner recesses 144, 146 and 148 toward the locked positions 132 at the inner end of the outer recesses 122, 124 and 126. The inner recesses 144, 146 and 148 and the outer recesses 122, 124 and 126 are shaped such that the ball bearings 128 are wedged between the trailing edges 144*a*, 146*a* and 148*a* of the inner recess 144, 146 and 148 and the leading edges 122*a*, 124*a* and 126*a* of the outer recesses 122, 124 and 126. The ball bearings 128 transfer the rotary motion of the inner race 108 to the outer race 106 such that the outer race 106 rotates counterclockwise with the inner race 108. The band brake 110 applies a braking force to the outer race 106 as previously described. As a result, when the panel 4 is lowered the user pulls the panel down against the force created by the brake 42 and the force generated by the spring motors 40. When the panel 4 is released by the user, the load of the panel 4 is greater than the torque output by the spring motors 40, as previously described. Absent the brake 42, the panel 4 would sag. However, when the panel 4 begins to sag the shaft 46 and inner race 108 rotate counterclockwise as shown in FIG. 17 such that the brake 42 is engaged. As a result, the sagging of the panel is stopped by the one-way brake 42.

To assemble the brake 42, three ball bearings 128 are inserted into the recesses 122, 124 and 126 on a first side of the outer race 106. The first inner race section 108*a* is inserted into the outer race 106 to hold the three ball bearings in place. The assembly is flipped over and three ball bearings are inserted into the recesses 122, 124 and 126 on the second side of the outer race 106. The second inner race section 108*b* is inserted into the outer race 106 to hold the three ball bearings in place. The assembled inner race 108 and outer race 106 are inserted into the band brake 110 and the brake assembly is trapped between the side plates 100 and 102. In the illustrated embodiment the side plates 100 and 102 are snap fit together by inserting pins 101 formed on one of the side plates into mating receptacles 103 formed on the other side plate. The side plates may also be connected using separate fasteners, adhesive or the like.

Variable Force Brake

The brake described above is a substantially constant force brake where the brake force applied to the shaft 46 remains constant during operation of the blind. While the brake force applied by the brake may be adjusted by turning screw 162 to adjust the force applied by the spring 168, once adjusted the force remains substantially constant or near constant as the panel 4 is raised and/or lowered. It will be understood that as the panel 4 is raised the amount of brake force required to hold the panel in position increases because as the slats are stacked on top of one another the weight of the stacked slats increases. The maximum load on the brake is when the panel is in the completely raised position where the lift cords support the weight of the entire stack of slats. As the panel is lowered the slats are sequentially supported by the tilt or ladder cords and removed from the stack of slats supported by the lift cords. As a result, the load on the lift cords lessens as the panel is lowered with the smallest load being when the panel is in the fully lowered position. With a constant force brake, the brake force applied to the system must be set to the highest value required to hold the maximum load (when the panel is completely raised). This brake force remains constant even as the panel is lowered and the brake force required to hold the panel progressively lessens. As a result, the user must apply increasing force to the panel as the panel is lowered. As the panel approaches the completely lowered position the amount of force required from the user to lower the panel may be approximately twice the force required from the user to lower the panel at the completely raised position. In addition to the increased force required to lower the panel, the use of a constant force brake may increase the wear on the brake components. As a result, the brake surfaces wear faster than necessary, resulting in the user having to adjust the screw 162 more frequently than may be desirable.

The variable force brake described herein varies the brake force applied to the system as the panel is raised and lowered. In accordance with one embodiment, the variable force brake is arranged such that the brake force increases as the panel is raised and the brake force decreases as the panel is lowered. In one embodiment the brake force may be at its maximum in the raised or nearly raised position, and at its minimum (or less than maximum) when the panel is in its lowered position. The brake force applied to the system may be varied over the range of motion of the panel to more closely align the applied brake force to the load supported by the system.

Figure 51:
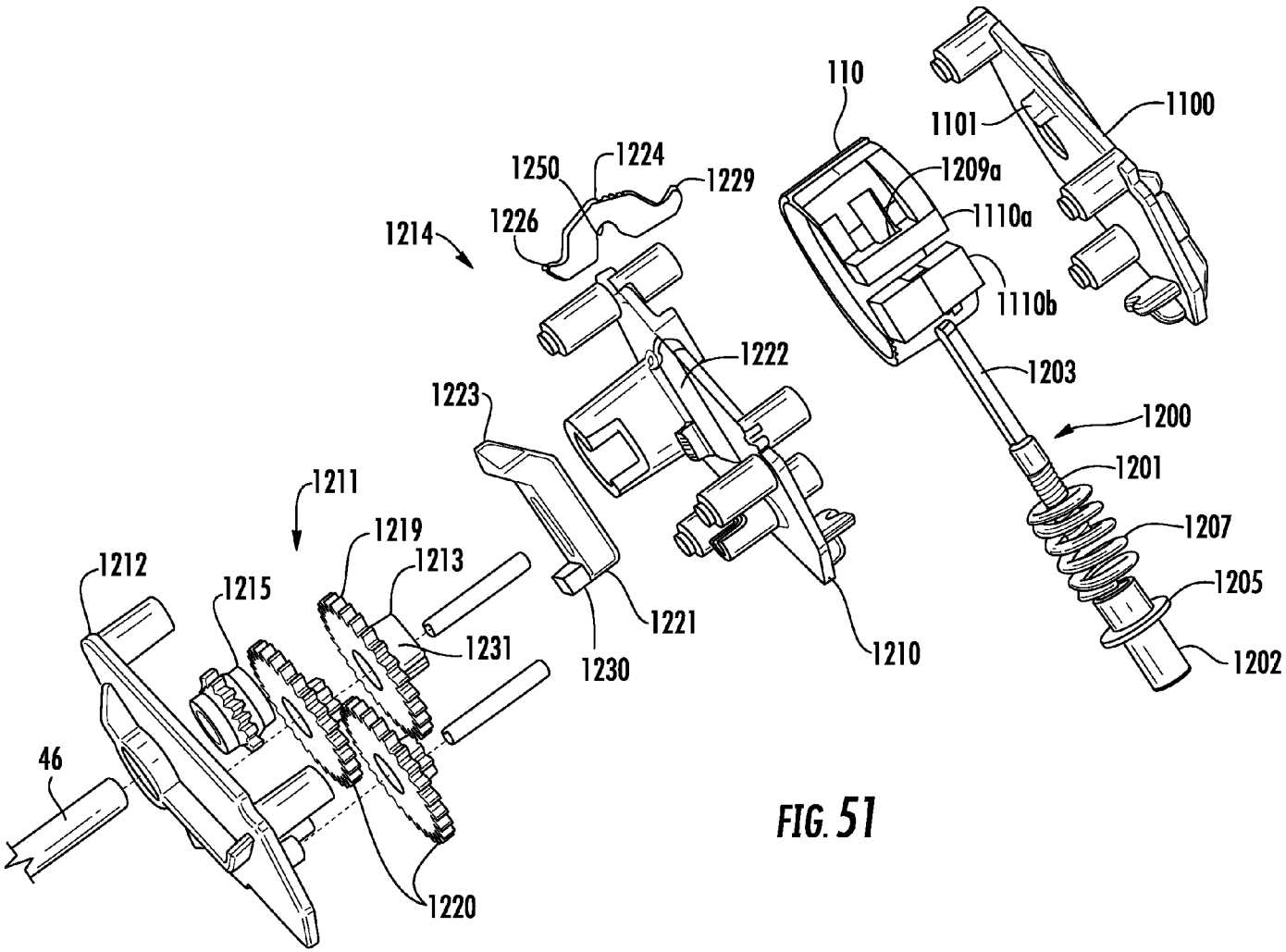
FIG. 51 is an exploded perspective view of a first embodiment of a variable brake.
Figure 52B:
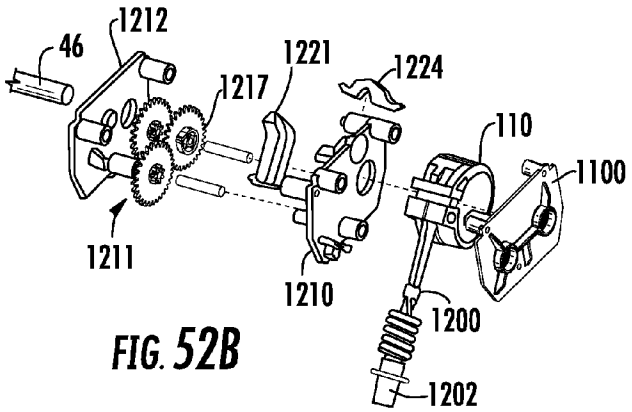
FIG. 52B is another exploded perspective view of the embodiment of the variable brake of FIG. 51.
Figure 52A:
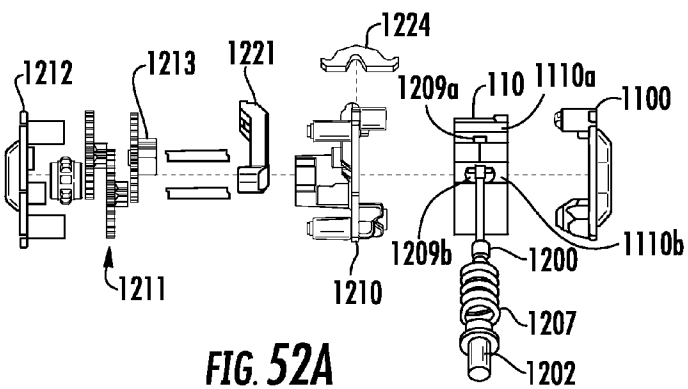
FIG. 52A is an exploded plan view of the embodiment of the variable brake of FIG. 51.
Figure 52D:
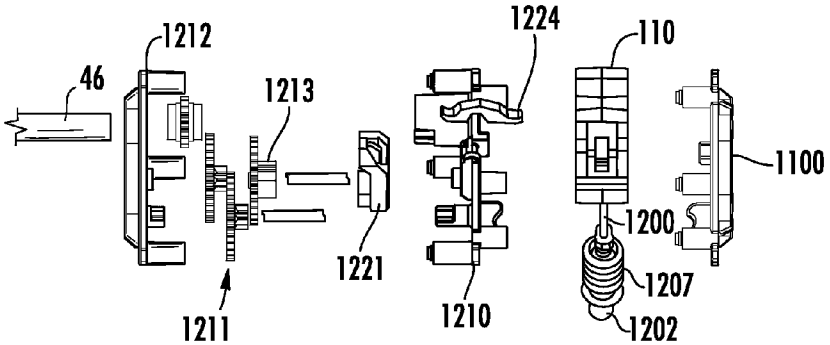
FIG. 52D is another exploded plan view of the embodiment of a variable brake of FIG. 51.
Figure 52C:
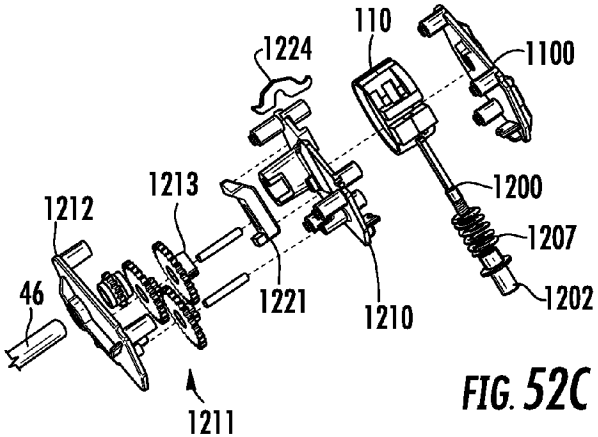
FIG. 52C is another exploded perspective view of the embodiment of the variable brake of FIG. 51.
Figure 53B:
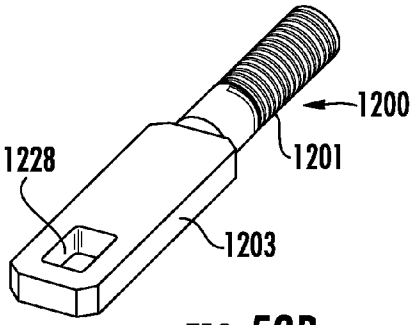
FIG. 53B is a perspective view of the threaded member of FIG. 53A.
Figure 53D:
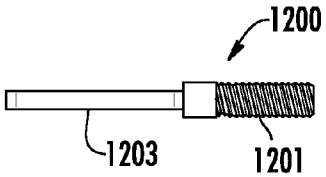
FIG. 53D is a side view of the threaded member of FIG. 53A.
Figure 53A:
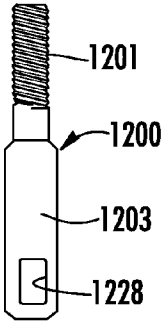
FIG. 53A is a plan view of a threaded member used in the variable brake of FIG. 51.
Figure 53C:
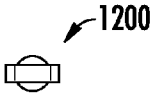
FIG. 53C is an end view of the threaded member of FIG. 53A.
Figure 54B:
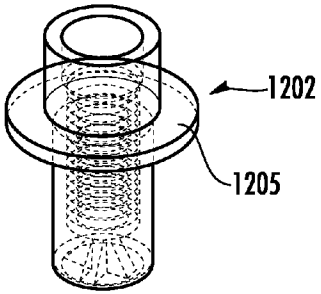
FIG. 54B is a perspective view with hidden lines of the threaded head of FIG. 54A.
Figure 54D:
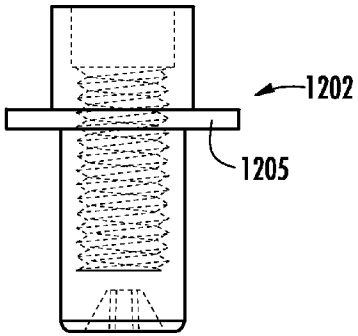
FIG. 54D is a side view with hidden lines of the threaded member of FIG. 54A.
Figure 54A:
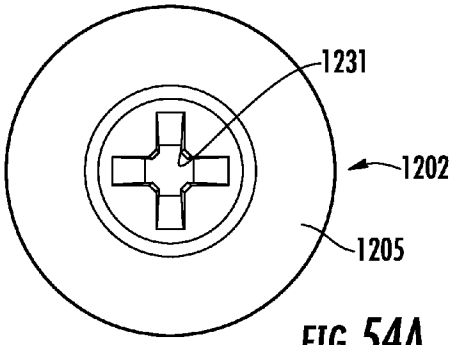
FIG. 54A is an end view of a threaded head used in the variable brake of FIG. 51.
Figure 54C:
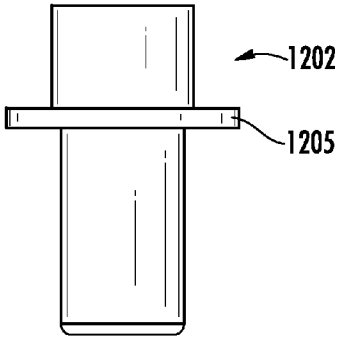
FIG. 54C is a side view of the threaded head of FIG. 54A.
Figure 55B:
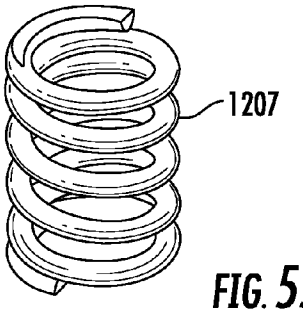
FIG. 55B is a perspective view of the spring of FIG. 55A.
Figure 55D:
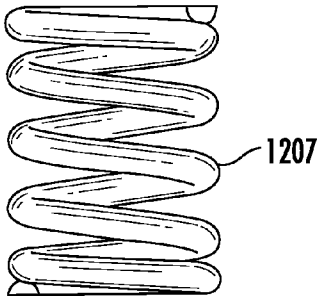
FIG. 55D is a second side view of the spring of FIG. 55A.
Figure 55A:
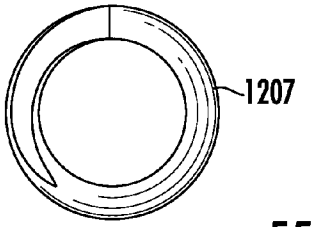
FIG. 55A is an end view of a spring used in the variable brake of FIG. 51.
Figure 55C:
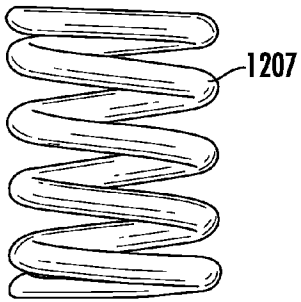
FIG. 55C is a first side view of the spring FIG. 55A.
Figure 56B:
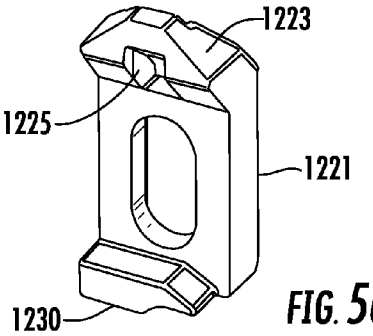
FIG. 56B is a perspective view of the cam follower of FIG. 56A.
Figure 56D:
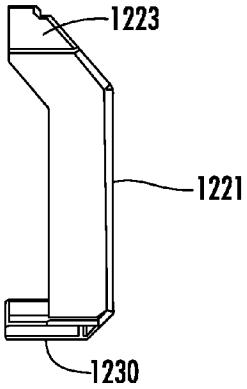
FIG. 56D is a side view of the cam follower of FIG. 56A.
Figure 56A:
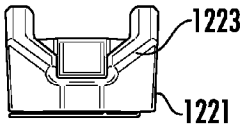
FIG. 56A is an end view of a cam follower used in the variable brake of FIG. 51.
Figure 56C:
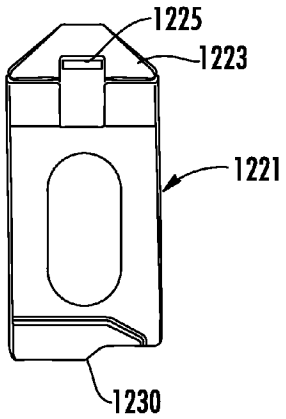
FIG. 56C is a plan view of the cam follower of FIG. 56A.
Figure 57B:
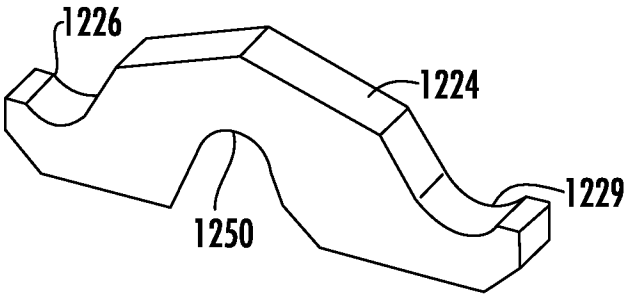
FIG. 57B is a perspective view of the lever of FIG. 57A.
Figure 57D:
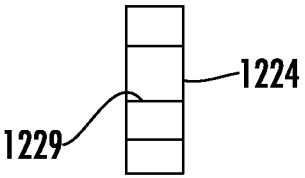
FIG. 57D is a side view of the lever of FIG. 57A.
Figure 57A:
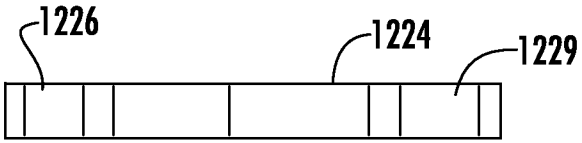
FIG. 57A is a top view of a lever used in the variable brake of FIG. 51.
Figure 57C:
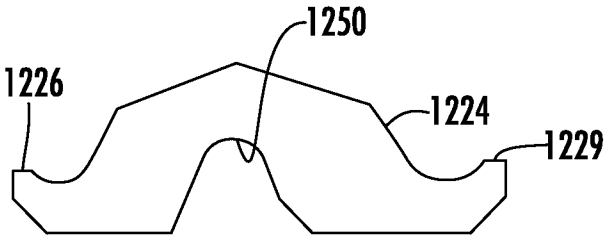
FIG. 57C is a plan view of the lever of FIG. 57A.
Figure 58B:
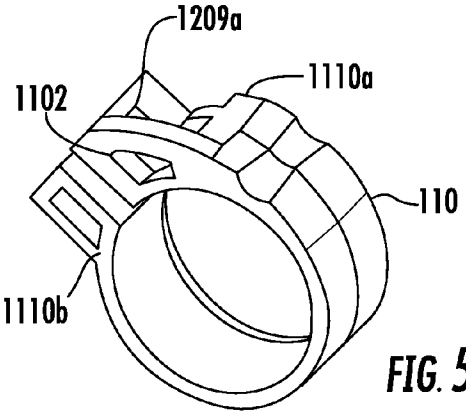
FIG. 58B is a perspective view of the band brake of FIG. 58A.
Figure 58D:
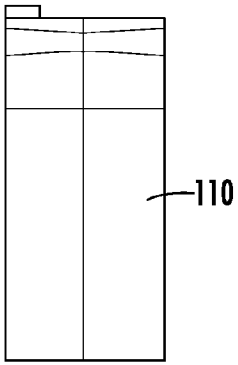
FIG. 58D is a side view of the band brake of FIG. 58A.
Figure 58A:
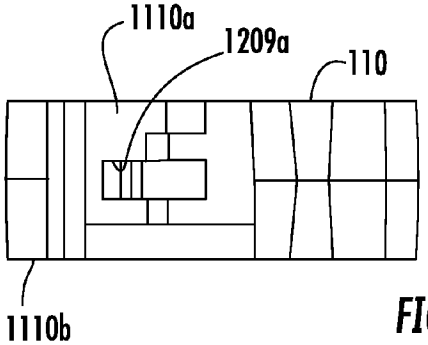
FIG. 58A is an end view of a band brake used in the variable brake of FIG. 51.
Figure 58C:
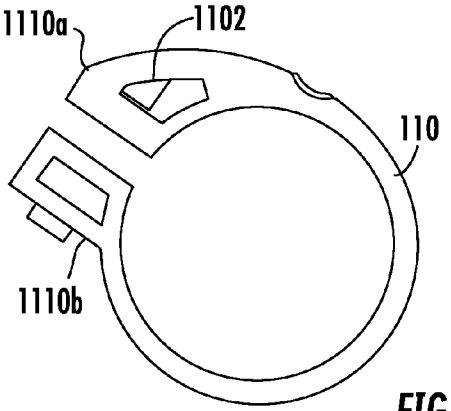
FIG. 58C is a plan view of the band brake of FIG. 58A.
Figure 59B:
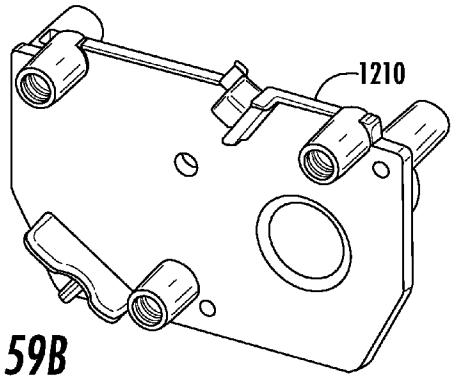
FIG. 59B is a perspective view of the inner support member of FIG. 59A.
Figure 59D:
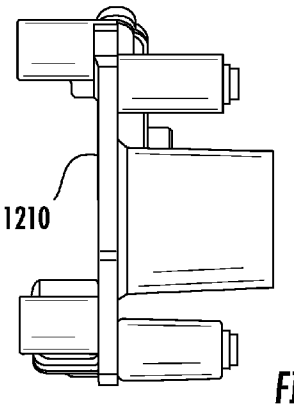
FIG. 59D is a side view of the inner support member of FIG. 59A.
Figure 59A:
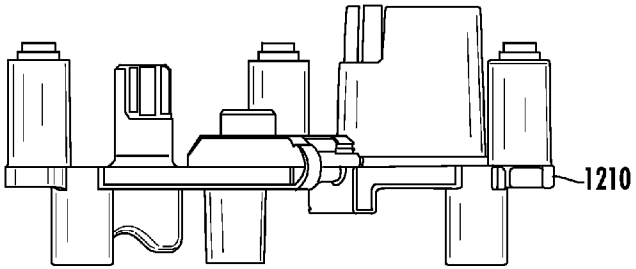
FIG. 59A is a top view of an inner support member used in the variable brake of FIG. 51.
Figure 59C:
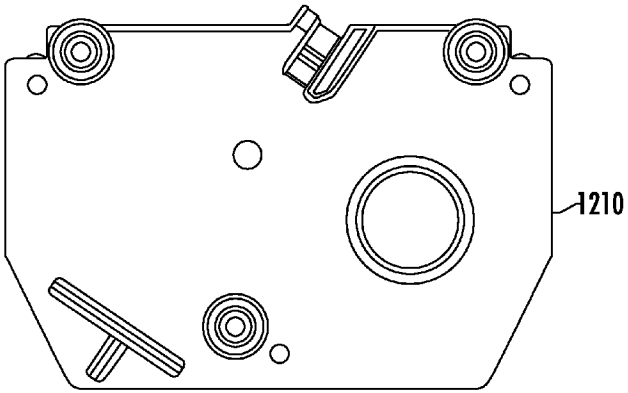
FIG. 59C is a plan view of the inner support member of FIG. 59A.
Figure 60B:
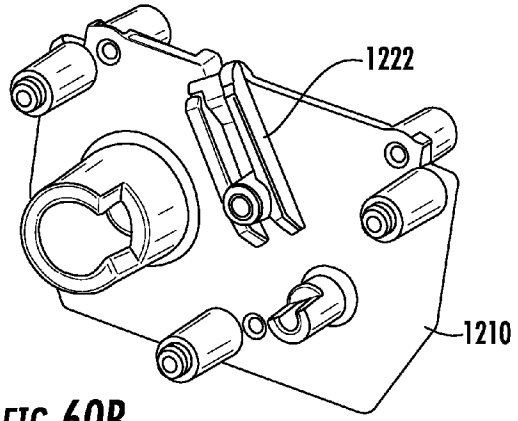
FIG. 60B is another perspective view of the inner support member of FIG. 59A.
Figure 60D:
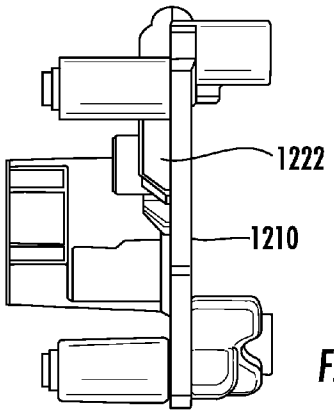
FIG. 60D is a side view of the opposite side of the inner support member of FIG. 59A.
Figure 60A:
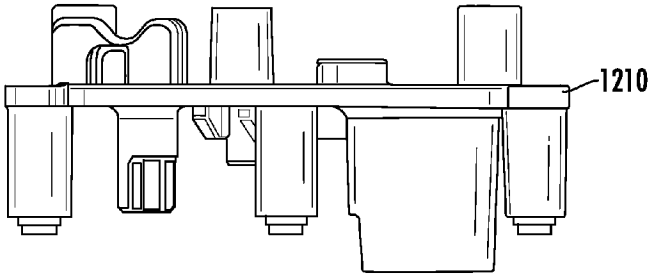
FIG. 60A is a bottom view of the inner support member of FIG. 59A.
Figure 60C:
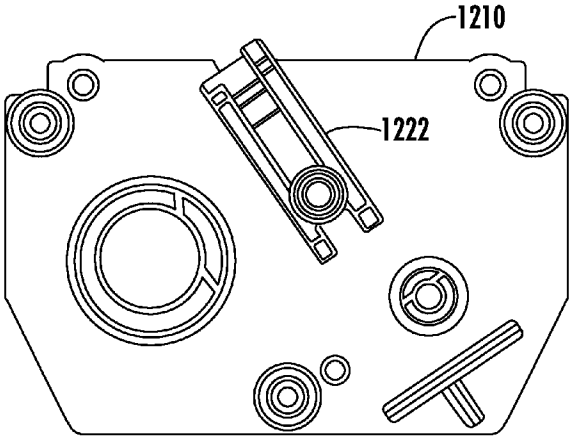
FIG. 60C is a plan view of the opposite side of the inner support member of FIG. 59A.
Figure 61B:
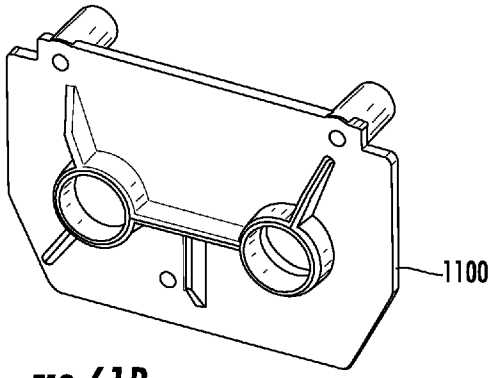
FIG. 61B is a perspective view of the support member of FIG. 61A.
Figure 61D:
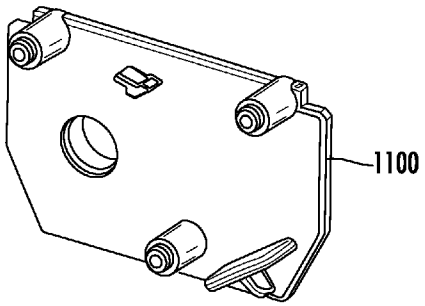
FIG. 61D is another perspective view of the support member of FIG. 61A.
Figure 61A:
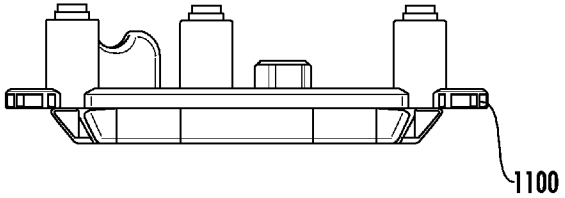
FIG. 61A is a top view of a support member used in the variable brake of FIG. 51.
Figure 61C:
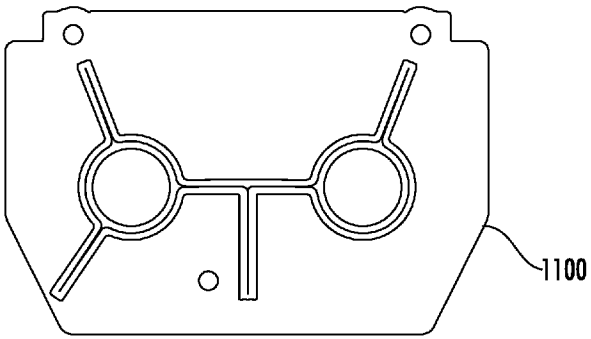
FIG. 61C is a plan view of the support member of FIG. 61A.
Figure 62B:
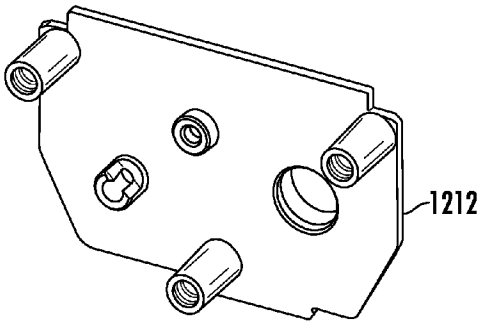
FIG. 62B is a perspective view of the outer support member of FIG. 62A.
Figure 62D:
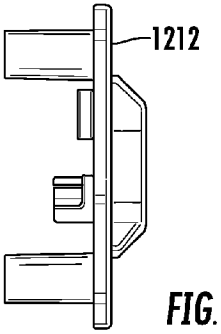
FIG. 62D is a side view of the outer support member of FIG. 62A.
Figure 62A:
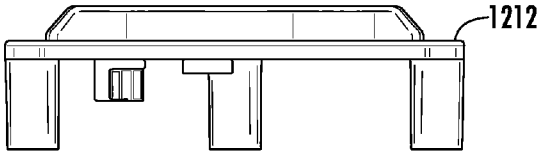
FIG. 62A is a top view of an outer support member used in the variable brake of FIG. 51.
Figure 62C:
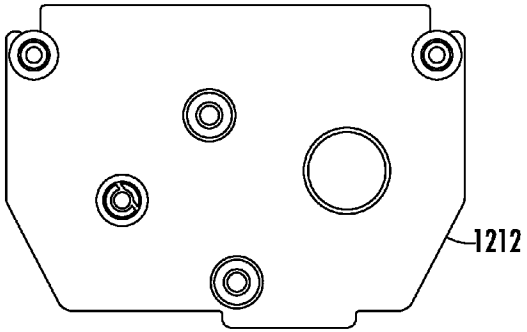
FIG. 62C is a plan view of the outer support member of FIG. 62A.
Figure 63B:
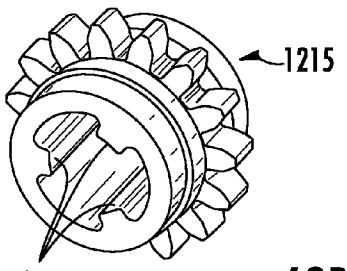
FIG. 63B is a perspective view of the gear of FIG. 63A.
Figure 63D:
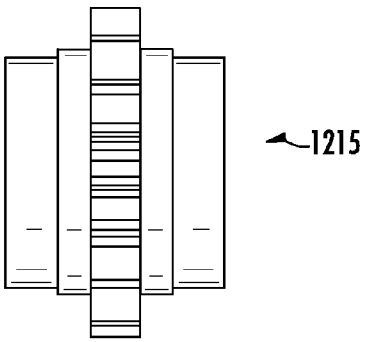
FIG. 63D is a side view of the gear of FIG. 63A.
Figure 63A:
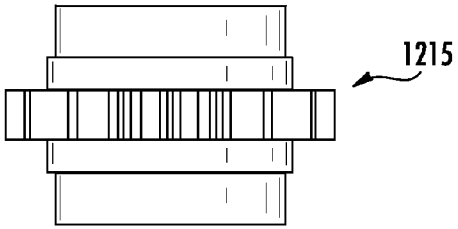
FIG. 63A is a top view of a gear used in the variable brake of FIG. 51.
Figure 63C:
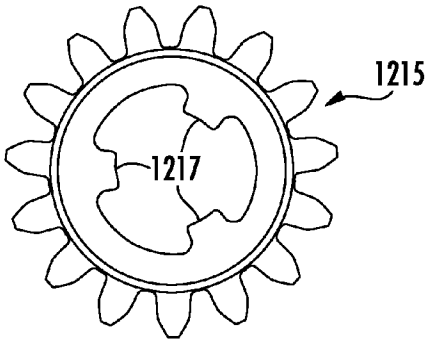
FIG. 63C is a plan view of the gear of FIG. 63A.
Figure 64B:
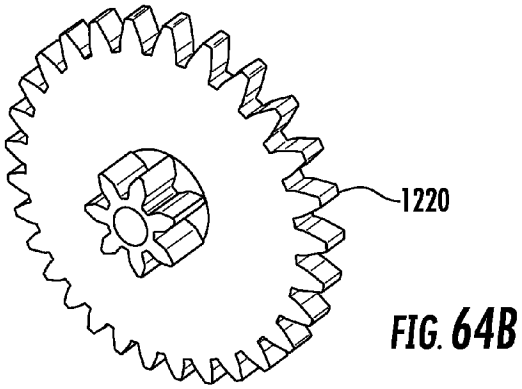
FIG. 64B is a perspective view of the double gear of FIG. 64A.
Figure 64A:
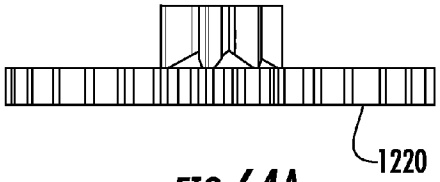
FIG. 64A is a top view of a double gear used in the variable brake of FIG. 51.
Figure 64D:
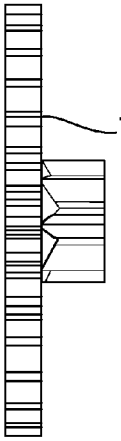
FIG. 64D is a side view of the double gear of FIG. 64A.
Figure 64C:
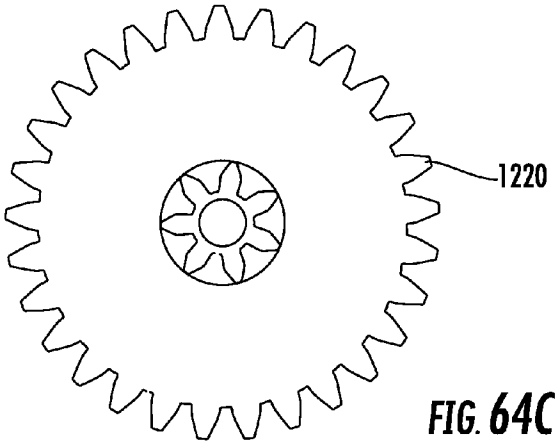
FIG. 64C is a plan view of the double gear of FIG. 64A.
Figure 65B:
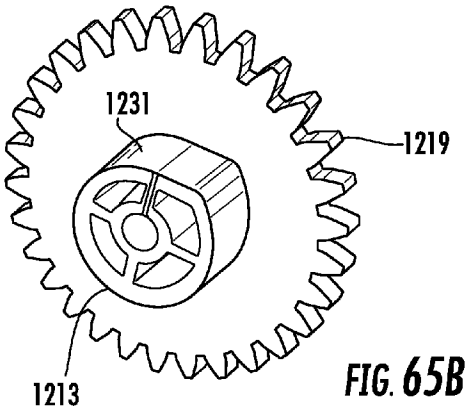
FIG. 65B is a perspective view of the output gear of FIG. 65A.
Figure 65D:
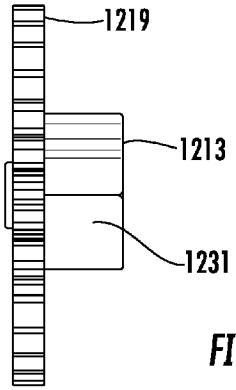
FIG. 65D is a side view of the output gear of FIG. 65A.
Figure 65A:
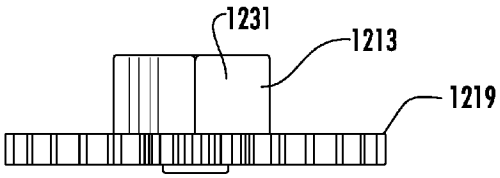
FIG. 65A is a top view of a output gear used in the variable brake of FIG. 51.
Figure 65C:
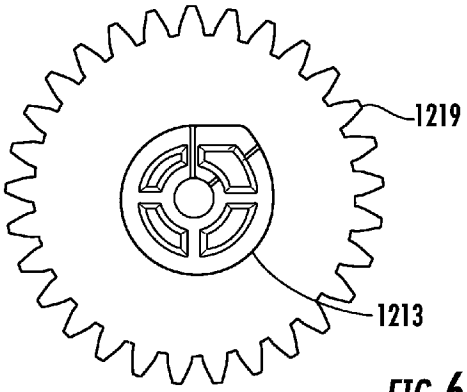
FIG. 65C is a plan view of the output gear of FIG. 65A.

One embodiment of a variable force bake is shown in FIGS. 51-65. According to this embodiment, the variable brake may comprise an outer race 106 and an inner race 108 where the inner race 108 is connected to the outer race 106 using a one-way clutch as previously described with respect to FIGS. 10-19 (not shown in FIG. 51). The brake may have other constructions including the alternate embodiments described herein. A brake member such as band brake 110 engages the outer race of the one-way clutch to apply the brake force to the system as previously described. In the system of FIGS. 51-65 the outer race 106, inner race 108 and one-way clutch are supported in the interior of band brake 110, as shown in FIGS. 10, 16, 17 and 19. The band brake 110 may have a C-clamp construction similar to that previously described; however, in the variable force brake one end 1110*a* of the C-clamp is fixed in position and the opposite end 1110*b* is movable relative to the fixed end 1110*a* with the force applied by the C-clamp to the outer race being controlled by a applying a force to the movable end 1110*b* of the C-clamp. In the illustrated embodiment the fixed end 1110*a* of the C-clamp may be mounted in a stationary position relative to the support member 1100 by forming a tang 1101 on the support member 1100 that engages a mating recess 1102 (FIG. 58C for example) formed in the fixed end 1110*a* of the band brake 110. The fixed end 1110*a* of the band brake may be fixed in position using a variety of mechanisms in place of or in addition to the tang 1101 and recess 1102. The opposite movable end 1110*b* of the band brake is free to move relative to the support member 1100 toward and away from the fixed end 1110*a* to vary the brake force applied to the outer race 106 as will be described. It is appreciated, however, that any other number of brake mechanisms can generally by utilized to create the braking force. For example other of the brake designs as described herein may be made variable by operatively connecting the cam and lever, or other suitable, force transfer mechanism, to the adjustment mechanism of the brake. For example, the adjustment mechanism may operate on the screws 308 of the brake of FIGS. 38 and 39, spring shaft 522 and nut 526 of the brake of FIGS. 42 and 43 or other brake force adjustment mechanisms in other brake embodiments.

An adjustment mechanism is provided for adjusting and varying the position of the movable end 1110*b* of the band brake 110 relative to the stationary end 1110*a* of the band brake to vary the force applied to the one-way clutch by the brake. The adjustment mechanism according to one embodiment may comprise a member 1200 (see FIGS. 53A-53D) having a threaded portion 1201 and a head 1202 (see FIGS. 54A-54D) threaded onto the distal end of the threaded portion 1201 and unthreaded post 1203 formed on the opposite end of the threaded portion. The post 1203 and threaded portion 1201 are dimensioned such that the member 1200 may be inserted through the apertures 1209*a* and 1209*b* formed on the fixed end 1110*a* and the movable end 1110*b*, respectively, of the band brake.

The head 1202 includes a flange 1205 that is dimensioned such that it can support a compression spring 1207 (see FIGS. 55A-55D) between the flange 1205 and the movable end 1110*b* of the band brake. When the member 1200 is mounted on the band brake 110 the post 1203 extends through the aperture 1209*b* on the movable end 1110*b* and into the aperture 1209*a* on the fixed end 1110*a* of the band brake with the compression spring 1207 trapped and compressed between the movable end 1110*b* of the band brake 110 and the head 1202.

With this construction the member 1200 may be moved relative to the band brake 110 such that the head 1202 is moved toward and away from the band brake to compress the spring 1207 to a greater or lesser degree to increase and decrease the force applied by the spring 1207 on the movable end 1110*b* of the band brake. When the spring 1207 is more compressed and the force applied by the spring 1207 to the movable end 1110*b* of the band brake increases the braking force applied by the band brake on the outer race 106 increases. Likewise, when the spring 1207 is less compressed and the force applied by the spring 1207 to the movable end 1110*b* of the band brake decreases the braking force applied by the band brake on the outer race 106 decreases. Thus, movement of the member 1200 varies the brake force applied by the variable force brake to the system.

Because the head 1202 is threaded onto the threaded portion 1201 the range of force applied by the spring 1207 to the system may be adjusted. Tightening the head 1202 onto the threaded portion 1201 compresses the spring between the head 1202 and the movable end 1110*b* of the band brake 110 to increase the range of the brake force and loosening the head 1202 on the threaded portion 1201 allows the spring 1207 to expand between the head and the movable end of the band brake to decrease the range of the brake force. The range of the magnitude of the force applied by the brake member to the one-way clutch is the range between the highest brake force and the lowest brake force for a particular panel. This range may be shifted higher or lower by adjusting head 1202 on member 1200.

The band brake 110 with the adjustment mechanism and one-way clutch are mounted between an outer support member 1100 and an inner support member 1210 and operate to apply a variable braking force to the shaft 46. A transmission 1211 is mounted between the inner support member 1210 and an outer support member 1212 that is operatively coupled to the shaft 46 for transmitting the rotary motion of the shaft to a cam 1213. A lever mechanism 1214 is mounted between the cam 1213 and the adjustment mechanism 1200 for transmitting the rotary motion of the cam 1213 to the adjustment mechanism 1200 to vary the force applied by the brake.

The transmission 1211 comprises a gear train for transmitting the rotary motion of the lift shaft 46 to the cam 1213. In one embodiment an input gear 1215 is mounted on the shaft such that the gear rotates with the shaft. The gear 1215 is keyed to the shaft 46 such as by teeth 1217 that mates with grooves or flat faces formed in the shaft 46. The shaft 46 also engages the inner race 108 as previously described such that the inner race 108 also rotates with shaft 46. In one embodiment the shaft 46, inner race 108 and gear 1215 are aligned such that the shaft 46 may be inserted through apertures formed in gear 1215 and inner race 108. Suitable apertures are formed in the supports 1212, 1210 and 1100 to allow passage of the shaft 46.

Cam 1213 is mounted on the output gear 1219 and a gear train comprising double gears 1220 operatively connects the input gear 1215 to the output gear 1219. The gear ratios are selected such the output gear 1219 and cam 1213 rotate less than 360 degrees in each direction as the panel 4 travels between its completely raised position and its completely lowered position. In some embodiments the cam rotates approximately between 270 and 340 degrees, such as in one embodiment between approximately 300 and 310 degrees, or in another embodiment the cam rotates approximately 307 degrees. The shaft 46 makes multiple revolutions as the panel 4 is moved between the completely lowered and completely raised positions. Using the gear train to reduce the rotation of the cam 1213 to less than 360 degrees allows the cam to be provided with a simple curve where less than 360 degrees of rotation of the cam adjusts the force applied by the brake 110 to the outer race 106 between a maximum value and a minimum value as will be described. While the use of gearing to limit the rotation of the cam 1213 to less than 360 degrees simplifies the construction of the assembly, the transmission may comprise other mechanisms than the gear train as shown herein. Moreover, limiting the cam to less than 360 degrees of rotation also simplifies the shape of the cam; however, the cam may rotate more than 360 degrees with the use of a more complex cam surface and follower.

The cam 1213 moves a cam follower 1221 (FIGS. 56A-56D) in a linear direction between a raised position and a lowered position. The use of the terms "raised position" and "lowered position" are used to distinguish the two extreme positions of the cam follower 1221 and do not necessarily mean that the first position is above or vertically above the second position. For example, in the illustrated embodiment the cam follower 1221 moves at an angle relative to vertical and in one embodiment the cam follower 1221 moves in a line that is parallel to the longitudinal axis of the adjustment member 1200. Where the adjustment member 1200 is disposed at an angle relative to vertical the cam follower 1221 may move along a line disposed at the same angle relative to vertical. In one embodiment the cam follower 1221 is mounted on a track 1222 integrally formed with the middle support 1210; however, other mechanisms for supporting the cam follower 1221 for reciprocating motion may be provided. The cam follower 1221 includes a yoke 1223 at its upper end that is pivotably connected to a lever 1224. In one embodiment the yoke 1223 comprises an aperture 1225 that is formed in the end of the cam follower 1221. The lever 1224 (FIGS. 57A-57D) is mounted for pivoting motion where a surface 1250 of the lever is supported on a surface of the middle support 1210 to form the fulcrum for the lever 1224. The lever 1224 may be mounted for pivoting motion using other mechanisms. One end of the lever 1224 comprises a hook 1226 that engages the aperture 1225 on cam follower 1221. The opposite end of the lever 1224 comprises a hook 1229 that is pivotably connected to the post 1203 of the adjustment mechanism 1200 such that the lever 1224 is pivotably connected to the adjustment member 1200. In one embodiment the adjustment member 1200 is provided with an aperture 1228 that is engaged by hook 1229 formed on the end of the lever 1224. A variety of mechanisms may be used for providing the pivoting connections for the lever fulcrum and for the pivoting connections between the lever 1224 and the cam follower 1221 and adjustment mechanism 1200.

The cam follower 1221 comprises an abutment 1230 that rides on the cam surface 1231 of cam 1213 such that as the cam 1213 rotates, the engagement of the curved cam surface 1231 with abutment surface 1231 moves the cam follower 1221 on track 1222 between the raised and lowered positions.

In operation, as the cam 1213 rotates the curved cam surface 1231 moves the cam follower 1221 in a linear reciprocating motion. The linear reciprocating motion of the cam follower 1221 is transmitted to the lever 1224 such that the end 1226 of the lever 1224 connected to the cam follower 1221 rises and falls with the cam follower 1221. In one embodiment, one rotation of the cam 1213 (e.g. 307 degrees of rotation) in a first direction raises the cam follower 1221 from the lowered position to the raised position which, in turn, lifts the end 1226 of the lever 1224 connected to the cam follower 1221. As the one end 1226 of the lever 1224 is lifted the opposite end 1229 of the lever 1224, connected to the adjustment member 1200, is lowered. As the opposite end of the lever 1229 is lowered the adjustment member 1200 is translated relative to the band brake such that the head 1202 is moved away from the band brake 110. As the head 1202 is moved away from the band brake 110 the spring 1207 expands and is under less compression such that the force applied by the spring 1207 on the band brake 110 and the corresponding brake force of the band brake 110 on the one-way clutch is reduced. When the cam 1213 is rotated one rotation in a second direction opposite to the first direction, the cam 1213 allows the cam follower 1221 to lower from the raised position to the lowered position which, in turn, lowers the end 1226 of the lever 1224 connected to cam follower 1221 from the raised position to the lowered position. As the one end 1226 of the lever 1224 is lowered, the opposite end 1229 of the lever 1224 is raised. As the opposite end 1229 of the lever 1224 is raised the adjustment member 1200 is translated relative to the band brake 110 such that the head 1202 is moved toward the band brake 110. As the head 1202 is moved toward the band brake, the spring 1207 is compressed such that the force applied by the spring 1207 on the band brake 110 and the corresponding brake force of the band brake on the one-way clutch is increased.

The operation of the variable force brake will be described with respect to the operation of a window covering. Assume that the panel 4 is in the fully raised position where the load on the lift cords is at a maximum. In this position the brake force applied by the variable force brake on the shaft 46 is also at, or near, a maximum, or at least greater than when the panel 4 is in a lower position. In this position the cam 1213 is positioned such that the cam follower 1221 is in the lowered position. With the cam follower 1221 in the lowered position the end 1229 of the lever 1224 connected to the adjustment member 1200 is in the raised position. In this position the lever 1224 pulls on the adjustment member 1200 such that the head 1202 is in a position closest to the band brake 110 where the spring 1207 is maximally compressed and the force applied by the band brake 110 to the one-way clutch is at a maximum value. It is appreciated that in other embodiments, the relationship between the cam 1213, the follower 1221, the lever 1224, and the adjustment member 1200 may differ from that described here and still achieve the same results of increasing brake force as the panel 4 is raised and decreasing braking force as the panel 4 is lowered as a result of the profile of the cam 1213 and follower in operable communication with the braking mechanism utilized.

In the embodiment shown and described, as a user lowers the panel 4 from the fully raised position to the lowered position the lift shaft 46 is rotated by the unspooling lift cords. The force to lower the panel and unwind the lift cords is provided by the user pulling down on the end of the panel 4. As the panel is lowered the rotation of the lift shaft 46 rotates the cam 1231 via the transmission 1211. As previously explained, the gear train is configured such that the cam 1231 rotates less than 360 degrees between the completely raised position of the panel 4 and the completely lowered position of the panel 4 even though the shaft 46 rotates through multiple revolutions.

The cam surface 1231 is shaped such that as the cam 1213 rotates the cam follower 1221 is moved upward such that the end 1229 of the lever 1224 connected to the adjustment member 1200 is moved downward. The cam surface 1231 is shaped to define a force curve where the force curve increases the braking force when the panel is moved in a first direction and decreases the braking force when the panel is moved in a second direction. The slope of the force curve changes over the extent of the cam surface by varying the distance of the cam surface 1213 from the axis of rotation of the cam along the extent of the cam surface. For example, the cam surface may comprise a curved surface that generally extends away from the axis of rotation of the cam from one end of the cam surface to the opposite end of the cam surface such that the cam surface defines generally a spiral. The spiral may comprise a variety of shapes and the slope of the curve may change over the length of the cam surface. Moreover, other shapes may be used and the cam surface may comprise flat portions arcs of a circle where the force does not change for a portion of the cam surface.

As the end of the lever 1224 moves downward the head 1202 is moved away from the band brake such that the spring 1202 is less compressed and the force applied by the spring 1207 on the movable part 1110*b* of the band brake 110 is lowered to thereby lower the braking force applied to the system. When the panel 4 is raised the operation of the mechanism is reversed such that the cam 1213 rotates in the opposite direction and the cam follower 1221 is moved downward such that the distal end 1229 of the lever 1224 is moved upward. As the distal end 1229 of the lever 1224 moves upward the head 1202 is moved toward the band brake 110 such that the spring 1207 is increasingly compressed and the force applied by the spring 1207 on the movable part 1110*b* of the band brake 110 increases to thereby increase the braking force applied to the system.

Thus, increasing braking force is applied to the system as the panel is raised until the maximum (or at least greater) brake force is applied at the fully raised position and decreasing braking force is applied to the system as the panel is lowered until the minimum (or at least lesser) brake force is applied at the fully lowered position. The change in the braking force as the panel is raised and lowered may be controlled by the shape of the cam surface 1231. The steeper the curve of the cam surface the faster the change in force over one rotation of the cam. Thus the cam may be designed to accommodate different types of window coverings having different weight slats and different drop lengths. The force curve may change continuously over the range of motion of the panel or it may be made variable by changing the slope of the curve of the cam surface over its length. The force applied may be varied to a greater or lesser degree at different points in the travel of the panel.

Because the braking force may be controlled to better respond to the load on the system from the panel, the variable force brake does not have to operate at the maximum or increased value throughout the entire range of motion of the panel. The application of a variable brake force also minimizes wear on the brake components. The application of a variable brake force also minimizes the force that the user must overcome as the user moves the panel to the completely lowered position providing better "feel" to the user and making operation of the window covering easier. For example in some embodiments of a window covering with a constant force brake the torque required to lower the panel at the fully lowered position is approximately 17.4 in-lb while for the same window covering using the variable force brake of the invention the torque required to lower the panel at the fully lowered position is approximately 3.8 in-lb.

Because the head 1202 is threaded on the threaded portion 1201 of the adjustment member 1200, the range of force applied by the brake may be increased or decreased based on how far the head 1202 is threaded onto the adjustment member 1200 and correspondingly how much the spring 1207 is compressed. To adjust the position of the head on the adjustment member the head may be formed with a keyed surface 1231 that may be engaged by a tool. In one embodiment the keyed surface 1231 may comprise a slot suitable to be engaged by a tool such as a screwdriver although other keyed connections may be used. The brake may apply a variable brake force without using the threaded engagement between the head and the adjustment member by fixing the head in position on the adjustment member; however, this arrangement would not allow adjustment of the applied range of force. Thus, for any given style and material of window covering the range of force applied by the variable brake may be modified to correspond to the load of the specific panel.

Figure 66:
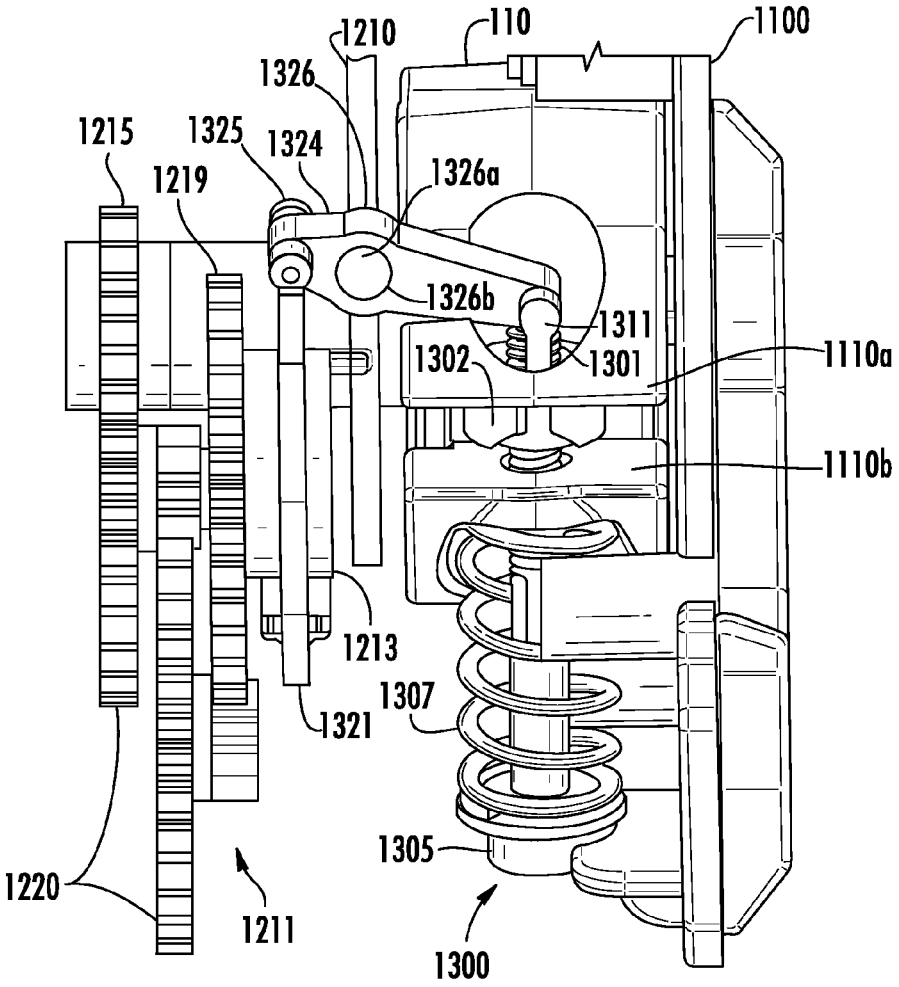
FIG. 66 is an end view of another embodiment of the variable brake.
Figure 67A:
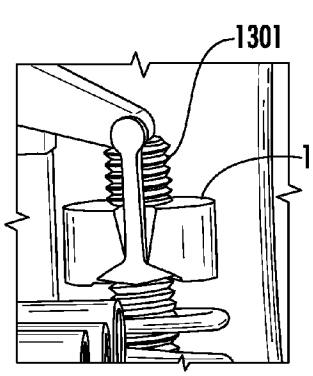
FIGS. 67A-67C are detailed views of the variable brake of FIG. 66.
Figure 67B:
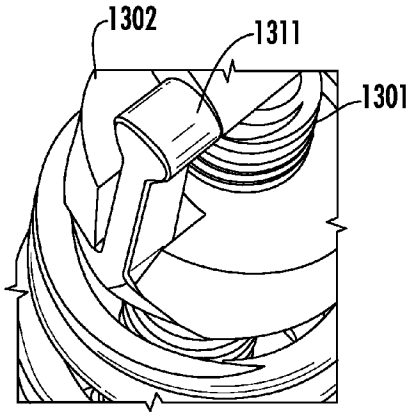
Figure 67C:
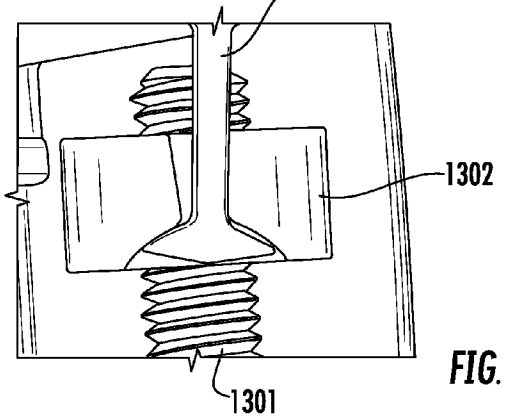
Figure 68A:
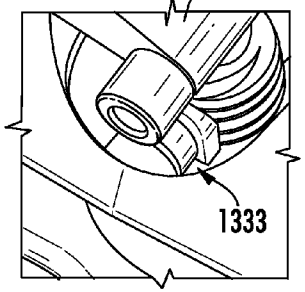
FIGS. 68A-68D are detailed views similar to FIGS. 67A-67C of an alternate embodiment of the variable brake.
Figure 68B:
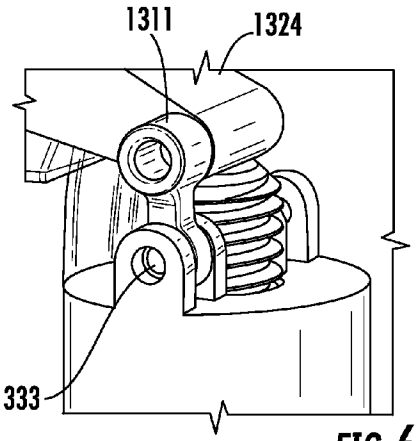
Figure 68C:
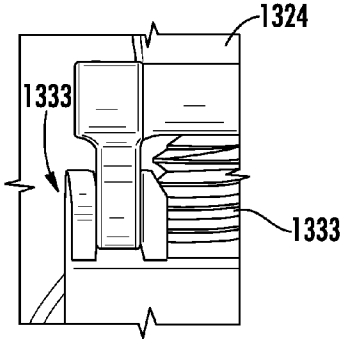
Figure 68D:
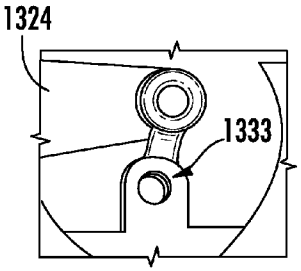
Figure 69:
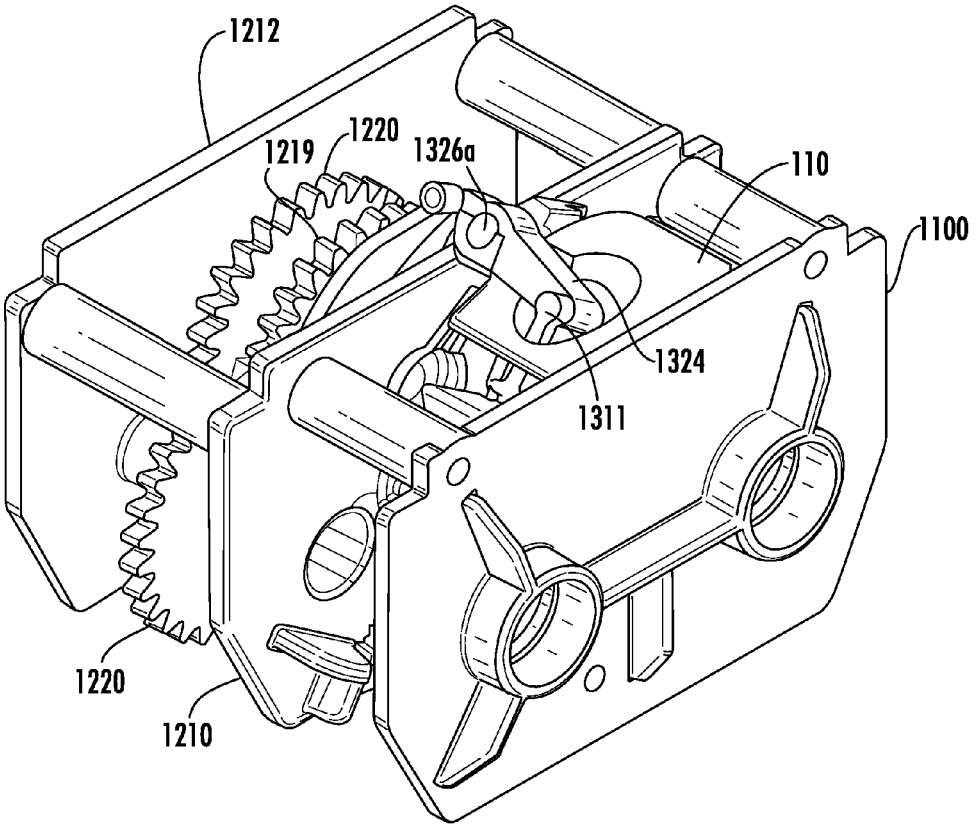
FIG. 69 is a perspective view of another embodiment of the variable brake.
Figure 70:
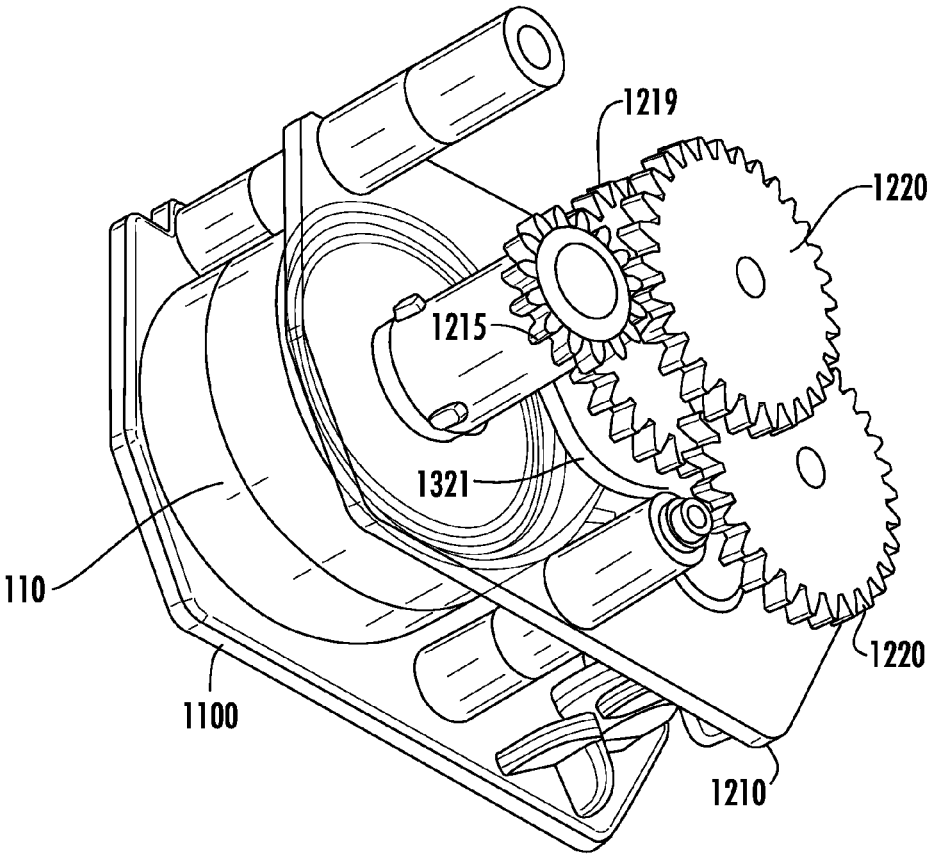
FIG. 70 is another perspective view of the variable brake of FIG. 69.
Figure 71:
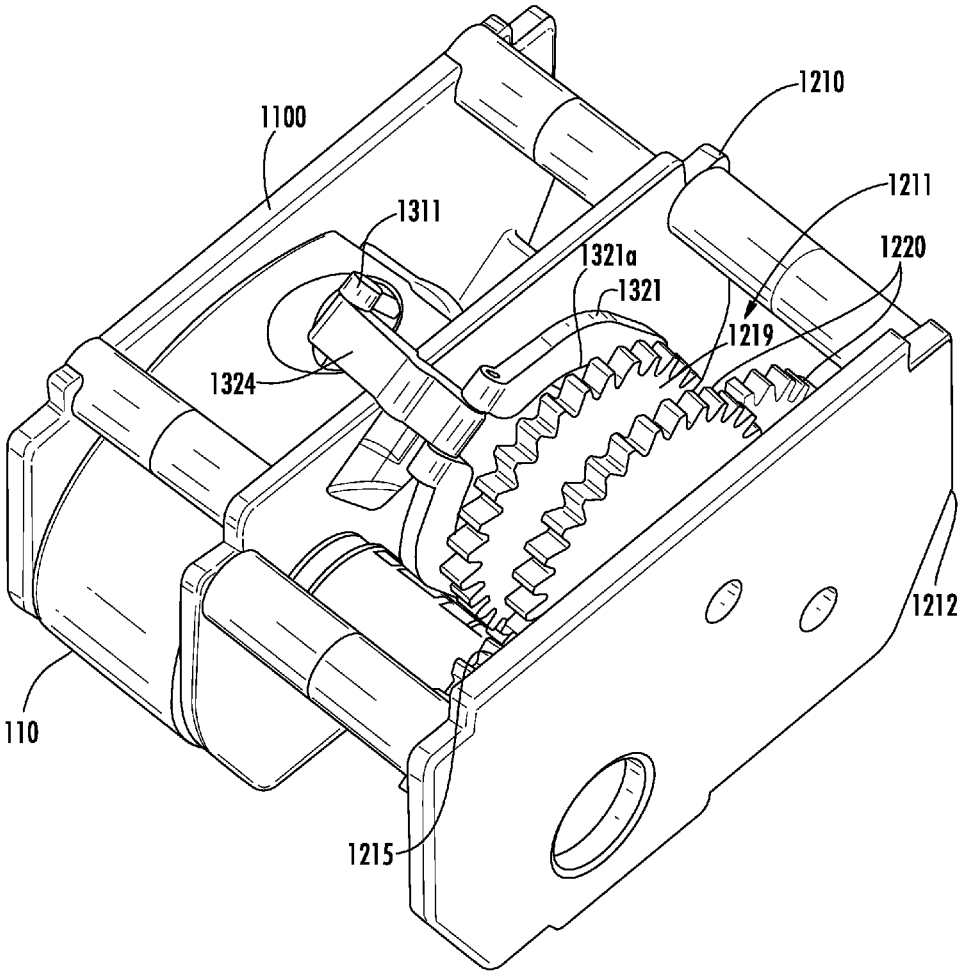
FIG. 71 is another perspective view of the variable brake of FIG. 69.
Figure 72:
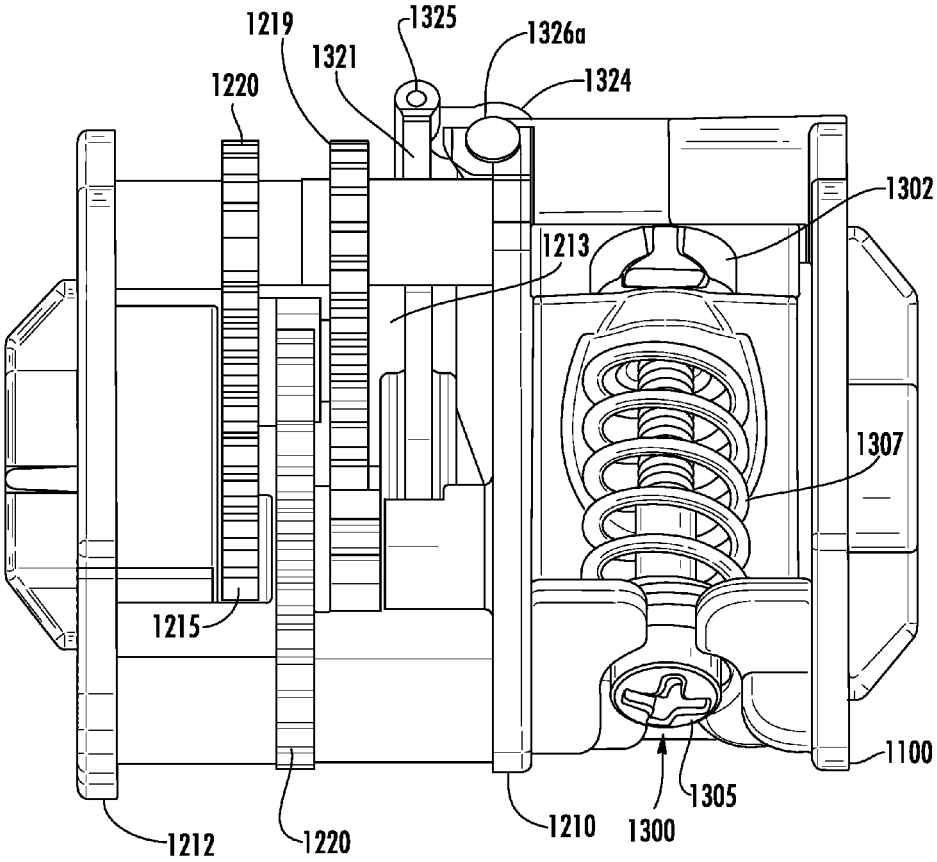
FIG. 72 is an end view of the variable brake of FIG. 69.
Figure 73:
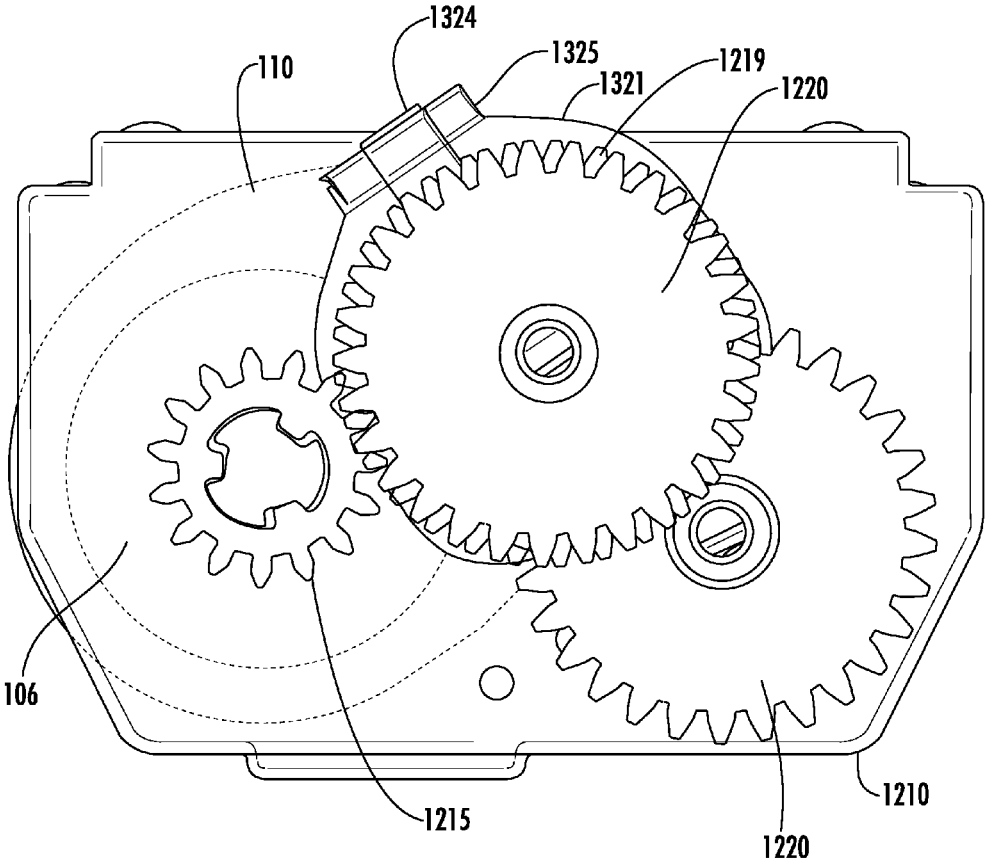
FIG. 73 is a plan view of the variable brake of FIG. 69.
Figure 75:
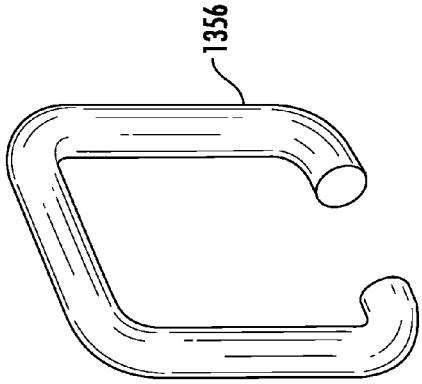
FIG. 75 is a perspective view of wireform lever linkage usable in embodiments of the variable brake of the invention.
Figure 74:
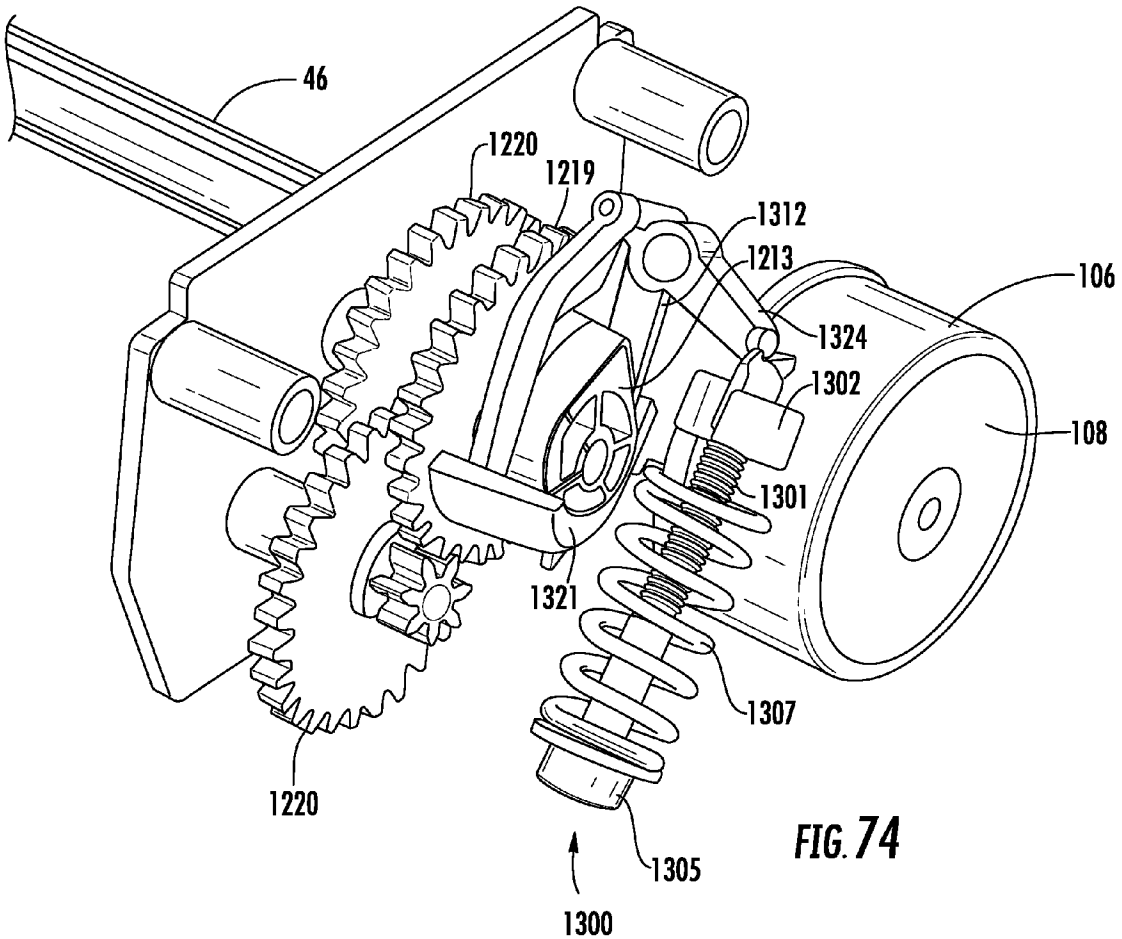
FIG. 74 is a perspective view of yet another embodiment of the variable brake.

An alternate embodiment of the variable force brake is shown in FIGS. 66, 67, 69-74. The brake operates in a similar manner to the variable force brake of FIGS. 51 to 65; however, the arrangement of the components is modified. For example the cam follower 1321 has an internal cam surface 1321*a* where the cam 1213 extends into the cam follower 1321 to engage an interior surface of the cam follower rather than engaging an exterior surface as in the embodiment of FIGS. 51 to 65. The lever 1324 is connected to the cam follower 1321 at a pin connection 1325 rather than using the hook and aperture of the embodiment of FIGS. 51 to 65. The fulcrum 1326 for the lever 1324 may comprise a pin 1326*a* that extends through an aperture 1326*b* formed in the lever 1324 rather than the lever being supported on an edge of the support member. In the embodiment of FIGS. 51 to 65 the adjustment member 1200 is arranged with the threaded portion 1201 at the end thereof with an adjustment nut 1202 mounted on the threaded portion. In the embodiment of FIG. 66, the lever 1324 engages the nut 1302 through a crank 1311 (see FIGS. 67A-67C). The head 1305 is fixed to the adjustment member 1300 such that adjustment of the force range is accomplished by rotating the adjustment member 1300 to change the position of the nut 1302 along the length of the threads 1301. As the nut 1302 moves up and down the length of the adjustment member 1300, the spring 1307 is compressed to a greater or lesser degree between the head 1305 and the movable part 1110*b* of the band brake 110. In an alternate embodiment the connection between the lever 1324 and the adjustment nut 1302 may be made by a pin joint 1333 as shown in FIGS. 68A-68D. The connection between the lever 1324 and the adjustment member 1300 may also be made by a wireform lever linkage 1356 as shown in FIG. 74B.

Figure 45:
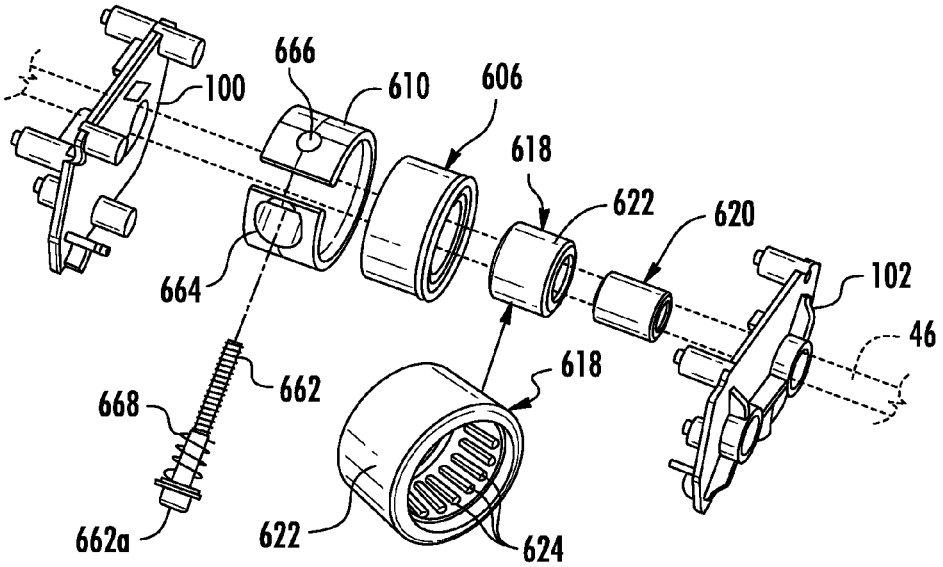
FIG. 45 is an exploded perspective view of an embodiment of still another brake assembly usable in the operating system of the invention.
Figure 46:
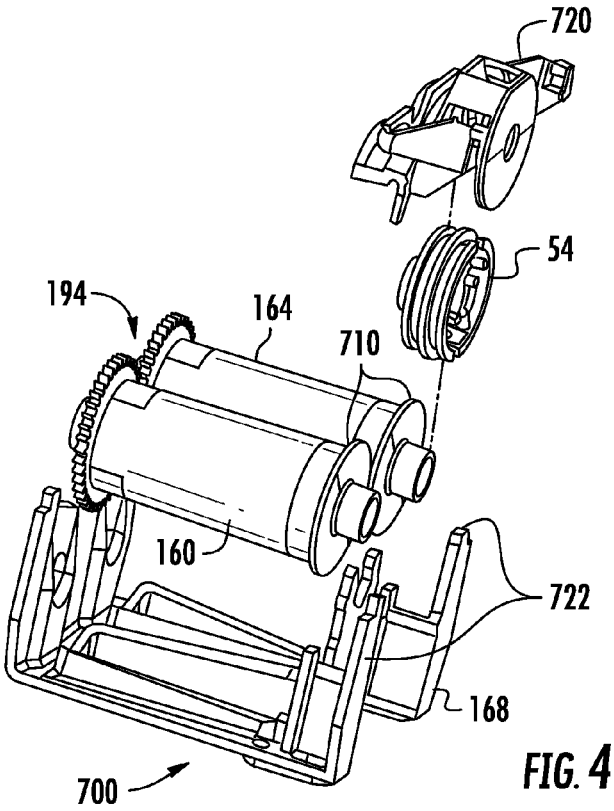
FIG. 46 is an exploded perspective view of an embodiment of another spool assembly usable in the operating system of the invention.
Figure 47:
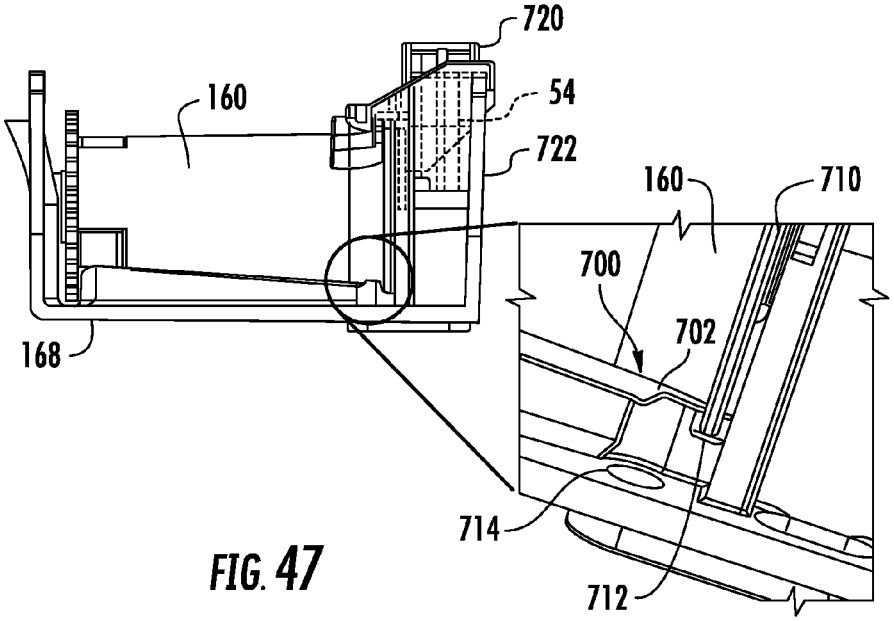
FIG. 47 is a detailed view of the spool assembly of FIG. 46.

An alternate embodiment of the brake is shown in FIG. 45 and comprises an outer race 606 rotatably supported in a brake member such as a band brake 610 such that the band brake applies a braking force to the outer race as previously described. The band brake may be supported between the side plates 100 and 102 as previously described. The adjustment mechanism may comprise a screw 662 that may be inserted through a smooth bore 664 on one free end of the band brake 610 and may be threaded into a threaded hole 666 on the other free end of the band brake. A spring 668 is mounted between the head 662*a* of the screw 662 and the first free end of the band brake such that the spring 668 exerts a force on the first free end of the band brake 610 tending to push the first free end toward the second free end of the band brake to clamp the outer race 606 in the band brake. The screw may be tightened or loosened to adjust the brake force applied to the system. The one way clutch comprises a needle bearing assembly 618 that is force fit into the opening of the outer race 606 such that the needle bearing assembly 618 and outer race 606 rotate together. The needle bearing assembly 618 comprises an annular housing 622. A plurality of one-way needle bearings 624 are positioned around the interior opening of housing 622. The one-way needle bearings 624 may rotate in a first direction relative to the housing 622 but are prevented from rotating in the opposite direction. The shaft 46 is inserted through the needle bearing assembly 618 such that it engages and rides on the needle bearings 624. In the illustrated embodiment the shaft 46 is inserted through a bearing surface 620 such as a steel bearing and the bearing surface 620 is inserted through and engages the needle bearings 624 of needle bearing assembly 618. When the shaft 46 is rotated in a first direction (corresponding to raising the panel) the needle bearings 624 are free to rotate relative to the housing 622 and the brake 610 has no effect on the rotation of shaft 46. When the shaft 46 is rotated in a second direction (corresponding to lowering the panel) the needle bearings 624 are locked between shaft 46 and the housing 622 causing the housing 622 and the outer race 606 to rotate with shaft 46 against the brake force generated by the band brake 610.

Figure 38:
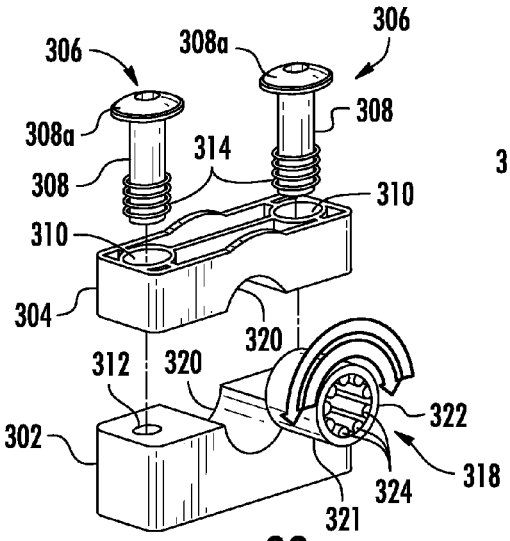
FIG. 38 is a perspective exploded view of an embodiment of a brake assembly usable in the operating system of the invention.
Figure 39:
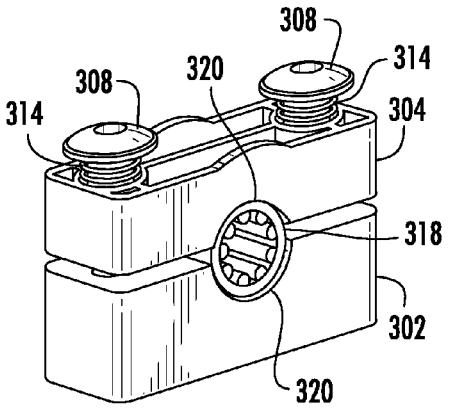
FIG. 39 is a perspective view of the brake assembly of FIG. 38.

An alternate embodiment of a one-way brake is shown in FIGS. 38 and 39 and comprises a brake member comprised of a fixed brake block 302 and an adjustable brake block 304. The adjustable brake block 304 is connected to the fixed brake block 302 by at least one adjustment mechanism 306. In the illustrated embodiment the adjustment mechanism 306 comprises a screw 308 that passes through a bore 310 formed in the adjustable block 304 and engages a threaded hole 312 formed in the fixed block 302. A compression spring 314 is disposed between the head 308*a* of the screw 308 and the adjustable block 304 such that the spring generates a clamping force on the adjustable block 304 that biases the adjustable block 304 towards the fixed block 302. The force may be adjusted by tightening or loosening the screw 308. In one embodiment both ends of the adjustable brake block 304 are supported by an adjustment mechanism 306. In another embodiment, one end of the adjustable brake block 304 may be supported by an adjustment mechanism 306 and the opposite end of the adjustable block may be operatively coupled the fixed brake block 302 by a hinge or other flexible connector.

The one-way clutch comprises a one-way needle bearing assembly 318 that is trapped between the blocks 302 and 304 such that the pressure created by the clamping action of the blocks 302 and 304 is applied to the external brake surface 321 of the needle bearing assembly 318. The blocks 302 and 304 may include cradles or brake surfaces 320 or other similar structures for retaining the needle bearing assembly 318 that act on the external brake surface 321 of the needle bearing assembly. The needle bearing assembly 318 comprises an annular housing 322. A plurality of one-way needle bearings 324 are positioned around the interior opening of housing 322. The one-way needle bearings 324 may rotate in a first direction relative to the housing 322 but are prevented from rotating in the opposite direction. The shaft 46 is inserted through the needle bearing assembly 318 such that it engages and rides on the needle bearings 324. When the shaft 46 is rotated in a first direction (corresponding to raising the panel) the needle bearings 324 are free to rotate relative to the housing 322 and the brake has no effect on the rotation of shaft 46. When the shaft is rotated in a second direction (corresponding to lowering the panel) the needle bearings 324 are locked between shaft 46 and the housing 322 causing the housing 322 to rotate with shaft 46 against the brake force generated by the blocks 302 and 304 on the brake surface 321.

Figure 40:
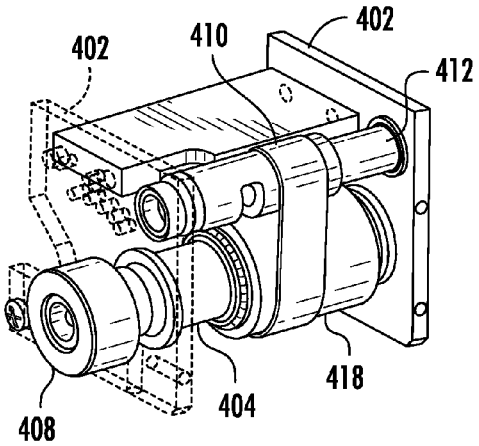
FIG. 40 is a perspective view of an embodiment of another brake assembly usable in the operating system of the invention.
Figure 41:
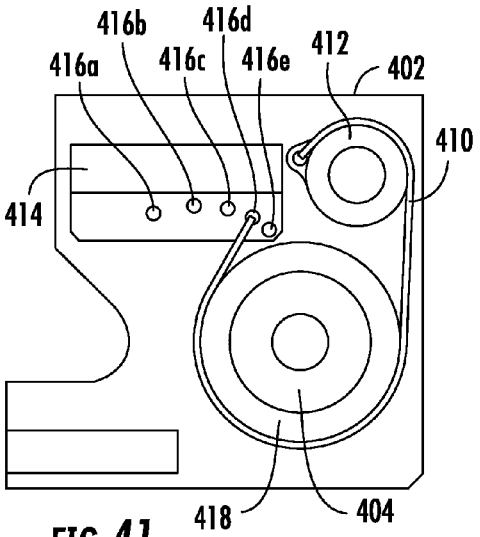
FIG. 41 is a side view of the brake assembly of FIG. 40.

Another embodiment of a one-way brake is shown in FIGS. 40 and 41 comprising a one way clutch that uses a metal belt as the brake member to adjust the brake force. The brake comprises a pair of side plates 402 that rotatably support a shaft adapter 404. The shaft 46 is inserted through the shaft adapter 404 and is connected thereto such that the shaft 46 and shaft adapter 404 rotate together. The shaft 46 may be connected to the shaft adapter using a cots collar 408 or other keyed connection, as previously described. The shaft adapter 404 is located in a one-way clutch 418 such as the one-way needle bearing assembly described above with reference to FIGS. 38, 39 and 45 or the one-way ball bearing clutch described above with reference to FIGS. 11 through 18. The brake member comprises a belt 410, such as a metal belt, that adds drag to the one-way clutch to provide the braking force to the system. The belt 410 has a first end connect to a support rod 412 and an opposite end movably mounted on a support block 414 at one of a plurality of positions 416*a* through 416*e*. The belt 410 extends around and contacts the brake surface 420 of the one-way clutch 418 to provide the brake force on the clutch. The amount of brake force applied by the belt 410 may be adjusted by adjusting the position 416*a-e* of the second end of the belt 410 on the support block 414 to increase or decrease the surface area of the belt 410 that contacts the brake surface 420 of the one-way clutch 418.

Figure 37:
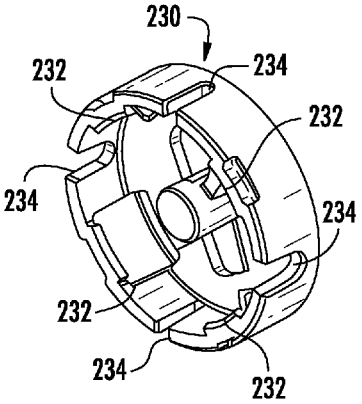
FIG. 37 is a perspective view of an embodiment of another component for the lift cord adjustment assembly usable in the operating system of the invention.
Figure 42:
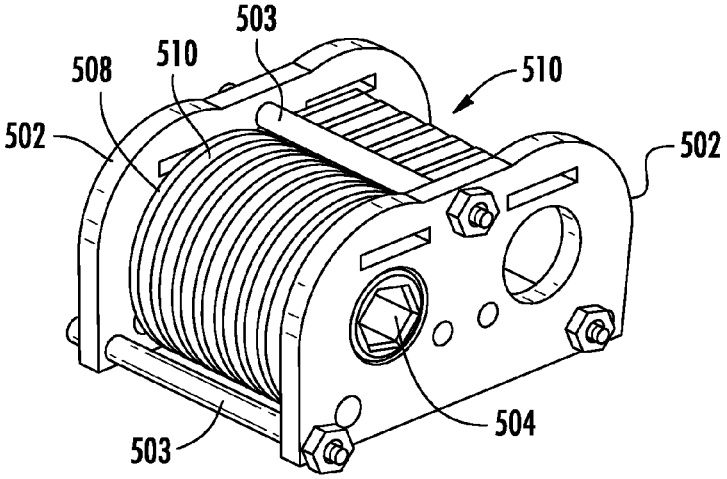
FIG. 42 is a perspective view of an embodiment of yet another brake assembly usable in the operating system of the invention.
Figure 43:
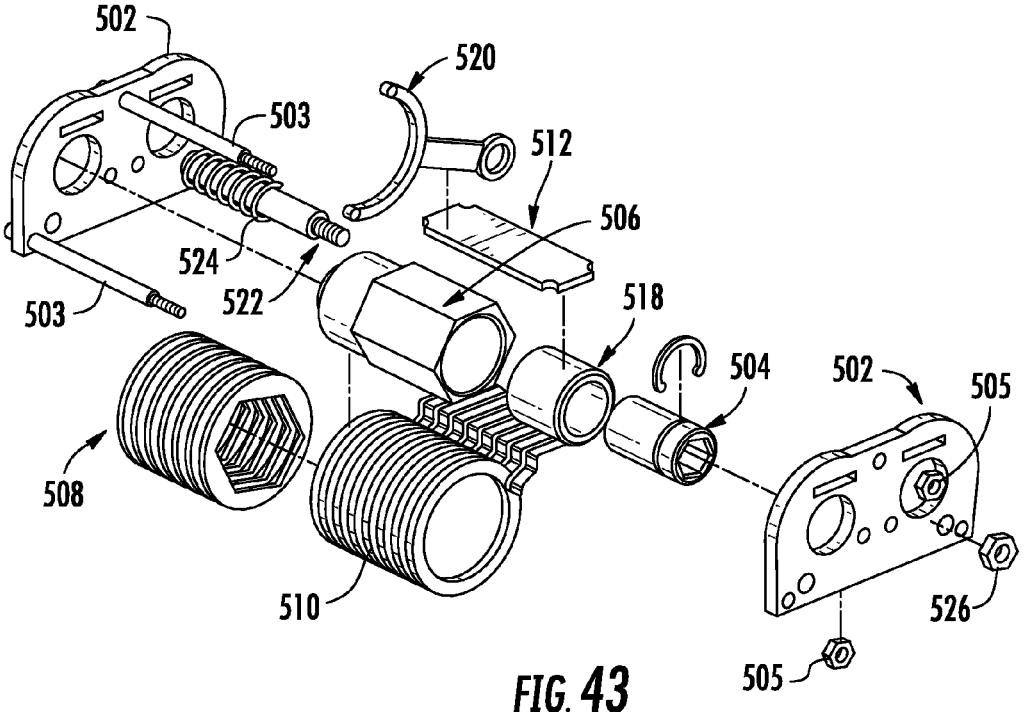
FIG. 43 is an exploded perspective view of the brake assembly of FIG. 42.

Another embodiment of a one-way brake is shown in FIGS. 42 and 43 where the brake member comprises a disc brake to provide the brake force on shaft 46. The brake comprises a pair of side plates 502 that are connected by rods 503 and fasteners 505 and that support the brake components. The shaft 46 is inserted through a shaft adapter 504 and is connected thereto such that the shaft 46 and shaft adapter 504 rotate together. The shaft 46 may be connected to the shaft adapter 504 using a keyed shaft, collar, set screw or the like as previously described. The shaft adapter 504 is located in a one-way clutch 518 such as the one-way bearing described above with reference to FIGS. 37 and 38 or the one-way ball bearing clutch described above with reference to FIGS. 11 through 18. A brake spindle 506 is mounted on the one-way clutch 518 such that the brake spindle 506 rotates with the one-way clutch 518. A plurality of dynamic brake plates 508 are mounted on the brake spindle 506 such that the dynamic plates 508 rotate with the brake spindle 506. The outside surface of the spindle 506 may engage keyed apertures on the dynamic brake plates 508. A plurality of static brake plates 510 are mounted to a static plate holder 512 that is mounted between the side plates 502 such that the static plates 510 are stationary. The dynamic plates 508 and static plates 510 are interdigitated over the brake spindle 506 with the dynamic plates 508 rotating with the spindle and the static plates 510 remaining stationary as the spindle 506 rotates inside of the static plates 510. The static plates 510 and dynamic plates 508 contact one another to add drag to the one-way clutch 518 to provide the braking force to the system. The adjustment mechanism for adjusting the amount of braking force may be provided by changing the number of plates that are used. The adjustment mechanism may also comprise a pressure arm 520 that applies a variable amount of normal force to the plates to adjust the braking force generated by the brake. The pressure arm 520 may be biased into engagement with the stack of plates by an adjustable spring. In one embodiment, a spring shaft 522 having a compression spring 524 mounted thereon extends between the plates 502. The pressure arm is mounted on the shaft 522 such that the spring biases the pressure arm against the plates. The amount of pressure exerted by the spring may be adjusted by tightening or loosening a nut 526 that is threaded onto spring shaft 522.

One embodiment of a lift spool system 44 suitable for use in the operating system of the invention is shown in FIGS. 20 through 27. The lift spool system 44 comprises a drive spool 160 that may be coupled to a drive gear 162, a driven spool 164 that may be coupled to a driven gear 166 and a cradle 168. The spools 160 and 164 ensure that the lift cords 21 wrap onto the spools 160, 164 evenly such that with each revolution of the spools 160, 164 the lift cords do not overlap on themselves on the spools.

Figure 25:
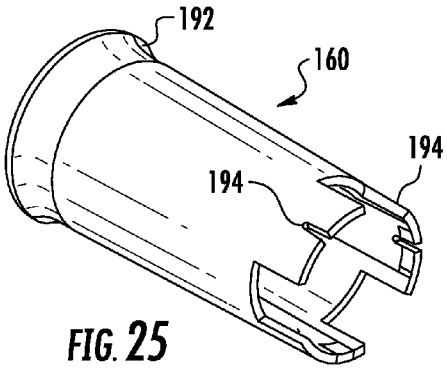
FIG. 25 is a perspective view of a spool component used in a spool of the spool assembly of FIG. 20.
Figure 26:
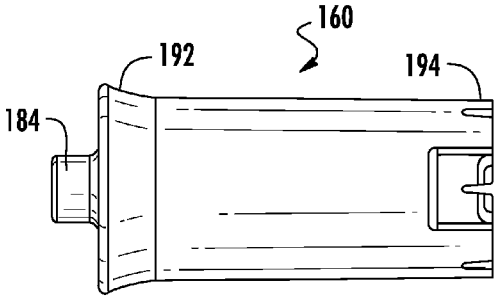
FIG. 26 is a side view of the spool component of FIG. 25.
Figure 27:
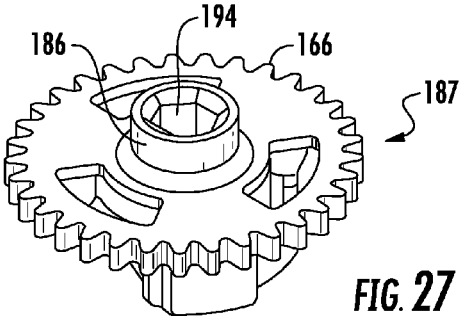
FIG. 27 is a perspective view of a spool component used in a spool of the spool assembly of FIG. 20.

Referring to FIGS. 21 through 24, the cradle 168 comprises a base 170 and a pair of side walls 172 and 174. The side walls 172 and 174 rotatably support the drive roller 160 and the driven roller 164. The drive roller 160 and driven roller 164 may be identical such that an example embodiment of drive roller 160 is shown and described with reference to FIGS. 25 and 26. The first side wall 172 includes a first aperture 180 that receives a post 184 formed on one end of the drive spool 160 and a second aperture 182 that receives a similar post formed on one end of the driven spool 164. The opposite end of the drive spool 160 comprises a drive gear 162 and the opposite end of the driven spool 164 comprises a driven gear 166. The drive gear 162 and driven gear 166 include posts 186 that are supported for rotational movement in cradles 188 and 190, respectively, formed on the side wall 174. The post 184 and post 186 of the drive spool 160 include through holes 192 and 194, respectively, that receive the shaft 46 such that shaft 46 extends through drive spool 160. The shaft 46 and the drive spool 160 are keyed together and rotate as a unit. In the illustrated embodiment the shaft 46 and holes 192 and 194 are formed with mating non-round profiles; however, other keyed connections for providing rotation may be used. The gears 162 and 166 may be unitary with the spools 160 and 164, or they may be made as separate gear caps 187 from spools 160 and 164 as shown in FIGS. 25-27 such that the gear caps 187 are attached to the spools 160 and 164 during assembly of the operating system. In one embodiment, the use of separate gear caps 187 may be used to attach the lift cords to the spools as will hereinafter be described. The driven gear 166 is engaged by the drive gear 162 such that the shaft 46 directly rotates the drive spool 160 and rotates the driven spool 164 via the geared connection of the engagement of gears 162 and 166 where the spools 160 and 164 rotate in the opposite directions. While gears 162 and 166 are shown mounted on the spools the spools may be mounted elsewhere and still provide the coordinated rotary motion of the spools. For example, gear 166 may be mounted on a shaft in aperture 194. While engaging gears are shown as the transmission between the spools 160 and 164 the transmission may comprise other elements such as a belt drive, an intermediate gear train, a chain drive, friction wheels or other suitable transmission.

The base 170 includes a first offset surface 176 and a second offset surface 178 arranged below spools 160 and 164, respectively. The spools 160 and 164 are arranged such that the drive spool 160 is disposed over one offset surface 176 and the driven spool 164 is disposed over the other offset surface 178. The offset surfaces 176 and 178 are disposed a distance from the surfaces of the spools 160 and 164 that, in one embodiment, can be less than two times the diameter of the lift cords to guide the lift cords onto the spools in a non-overlapping manner. The spools 160 and 164 are formed with a sloped arcuate receiving end 192, which may have an arcuate shape in one embodiment, at the end of the spool that receives the lift cord. The receiving end 192 narrows to opposite end 194 such that the spools have a tapered shape. The arcuate sections of spools 160 and 164 force the cords to slip downward toward the slightly tapered end 194 of the spools. Decreasing the surface friction of the spool material or increasing the slope of the arcuate section makes the cord slide down the spool more easily. However, if the curvature of the arcuate section is too steep the cord may be more likely to wind on top of itself. The slight taper of the spools ensures that the cord sections already wrapped on the spool remain looser than the cord sections being wrapped on the spools to allow the cords to be pushed down the spool with minimum force with each winding of the cord. The tapered shape of the spools 160 and 164 facilitates the orderly winding of the lift cords on the spools such that as each cord is wound on a spool the cord is moved from the wider receiving end 192 toward the narrow end 194 such that the cord does not wind on itself.

Referring to FIGS. 46-49 an alternate embodiment of a lift spool assembly is shown where a cord pusher 700 is formed on the cradle 168 to prevent the cord from climbing the arcuate sections of the spools 160, 164 and falling off of the spools onto the spool shafts. The pusher 700 comprises an angled surface 702 formed on the offset surfaces 176, 178 and spaced from the arcuate surfaces of the spools 160, 164 a distance that prevents a cord from riding up the arcuate surface. In one embodiment, the top edge of the cord pusher 700 is spaced a distance from the surface of the spools approximately equal to or less than about one half the diameter of the lift cord. The surface 700 is angled toward the end 194 of the spool such that a lift cord contacting the surface 700 will be pushed in the direction of end 194 by the surface 700. The spools 160, 164 also include a flange 710 that extends radially from the end of the spool to create a wall or abutment that prevents a lift cord from jumping off the end of the spool. In one embodiment the flange 710 may extend from the spool a distance that is approximately equal to or greater than about 1.5 times the diameter of the cord. With such a dimension the center axis of a second level cord will not be above the top of the flange 710. The flange 710 may be received in a cut-out or recessed area 712 disposed behind the pusher 400. As a result, a serpentine or tortuous path is created between the point where the cord enters the cradle 168 through aperture 714 and wraps on the spool and the end of the spool such that it is difficult for a cord to traverse this distance and jump off of the end of the spool during winding.

Figure 48:
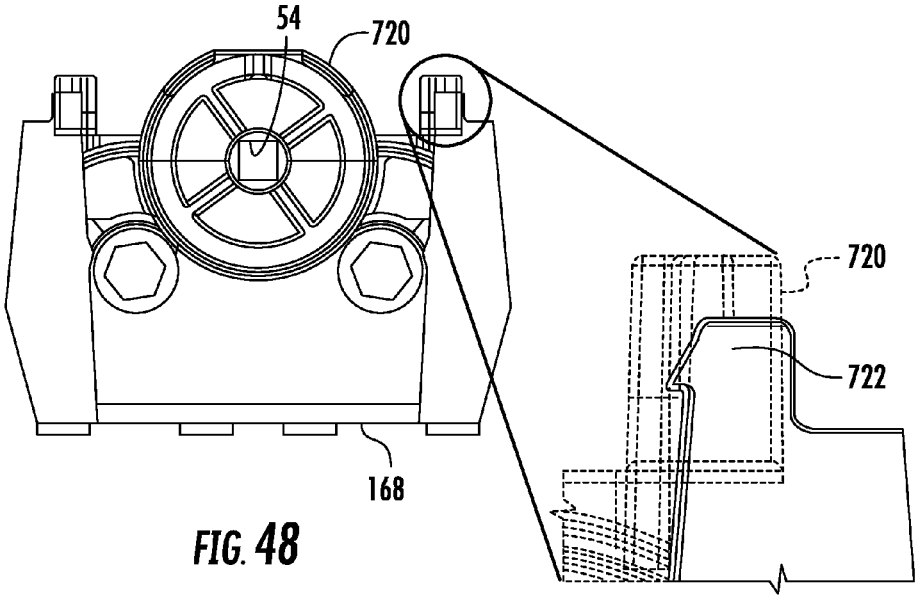
FIG. 48 is an end view of the spool assembly of FIG. 46.
Figure 49:
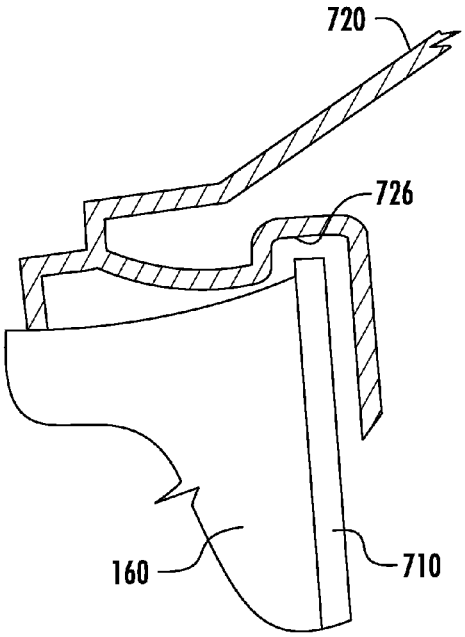
FIG. 49 is a detailed partial section view of the spool assembly of FIG. 46.

To further maintain the cord on the spools a cradle cover 720 may be provided on the top of the spools that is spaced from the spools a distance such that the cord is constrained to wrap onto the spools rather than jumping off the spools as shown in FIGS. 48 and 49. The cradle cover 720 may be snap-fit onto posts 722 formed on the cradle after the spools are mounted on the cradle. The cover comprises a recess 726 for receiving the flange 710 of the spools to create a serpentine or tortuous path from the spool to the end of the spool as previously described. The cradle cover 420 prevents the lift cords from lifting off of the spools when the blind is raised. The cradle cover 720 may also contain a cord pusher 727 similar to that of pusher 700 on the cradle 168 such that the pusher 727 prevents the lift cord from climbing the arcuate sections of the spools 160, 164 such that a lift cord contacting the pusher 727 will be pushed in the direction of end 194. Because the pusher 700 is located at the bottom of the spool and pusher 727 is located at the top of the spool, the pushers push the cord toward the end 194 of the spool sequentially such that the cord is essentially pushed twice and it is wound onto the spool. The cover 720 may also cover the tilt drum 54 to prevent the tilt cords from becoming disengaged from the tilt drum 54. For example, if a user lifts the panel quickly, the spring motor may not take all of the slack out of the lift cord such that the cord may be pushed up by the user where it may tend to jump off of the spool or wind on top of a previous cord winding. Either failure mode can lead to an uneven bottom rail and may create additional unwanted friction to the system during operation. The cord winding mechanisms discussed above also prevent the lift cords from jumping off of the spools or becoming tangled during shipping when the cords may not be under tension.

The illustrated embodiment shows a two spool arrangement that is used with a privacy-type lift cord. A privacy-type lift cord is wound around one spool, extends down the front side of the panel, wraps under or through the bottom rail and extends up the back side of the panel 4 where it is wound around the second spool as shown in FIG. 1. As previously explained, a privacy lift cord as described may be constructed of a plurality of separate lift cord sections. In other embodiments that do not provide privacy-type lift cords, however, a single lift cord can be used that typically extends through the panel to the bottom rail (as shown In FIG. 2) such that only the drive spool 160 is used. In such an arrangement the driven spool 164 may be eliminated or it may be left unused, and modifications may be made to the drive spool 160, such as eliminating the drive gear 162, its orientation within the head rail relative to the panel, and the like.

Figure 29:
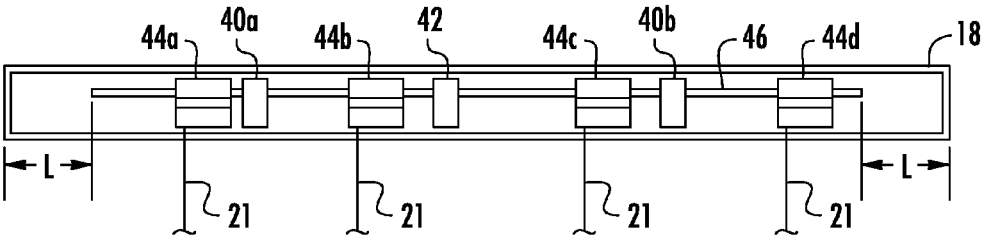
FIG. 29 is a top view showing an operating system of the invention in a head rail.

Assembly of the operating system will now be described according to one example embodiment. A head rail 18 is provided that may have an interior space for receiving the operating system as shown in FIG. 29. In the illustrated embodiment, the head rail has a U-shape such that the top of the head rail is open and allows access into the interior space. Other head rail designs may also be used. The cradle 168 for the lift spool systems 44*a*, 44*b*, 44*c*, and 44*d* may be inserted into the head rail 18. The spring motors 40*a*, 40*b* and brake 42 are inserted into the head rail at any position along the length of the head rail provided that the components may be engaged by the shaft 46. Each spring motor is positionable at any unoccupied location on the shaft. Unoccupied location as used herein means that the motors may be located at any position on the shaft where a brake or spool assembly is not positioned. Because the shaft can extend through the motors the motors can be positioned anywhere along the length of the shaft. In practice the motors may be positioned in any unoccupied location along the shaft where another component is not located. This is also true for the brakes and spool assemblies; however, the spool assemblies are typically located directly above the lift cords such that these areas are not unoccupied locations for the brakes and motors. Moreover, in some embodiments it may be desirable to mount the brake at or near one end of the shaft as shown. The spring motor(s) applies a first force directly to the shaft at a first location(s) along the shaft and the brake applies a brake force to the shaft at a second location along the shaft where the first location is spaced along the longitudinal axis of the shaft from the second location. In this manner the brakes and motors act directly on the shaft and the locations on the shaft where the motor force and the brake force are applied are be spaced from one another. Because the motor force is applied directly to the shaft via the spool 60 and the brake force is applied directly to the shaft via brake 42 these forces may be applied to the shaft independently of one another and directly to the shaft.

As previously described, the brake 42 and one of the motors 40 may be combined into a single unit if desired. In one embodiment, the components of the system snap into the head rail such that separate fasteners are not required, however, other mounting mechanisms including the use of separate fasteners may be used. While an embodiment of a lift system is shown in FIG. 29 the lift system may comprise a greater or fewer number of each component and the components may be arranged in other relative positions along the length of shaft 46.

The lift spool systems 44 are arranged in a one to one relationship with the lift cords 21 such that for a typical window covering where two lift cords are used, two lift spool systems 44 are also used. For larger window coverings, three or more lift cords may be used and a corresponding number of lift spool systems 44 are also used. Each lift spool system 44 can be arranged proximate to (i.e. approximately above) the associated lift cord such that the lift cord is wrapped onto the spool at the large diameter receiving end 192 of the spool. Apertures are provided in the head rail 18 and cradle 168 to receive the lift cords.

Figure 28A:
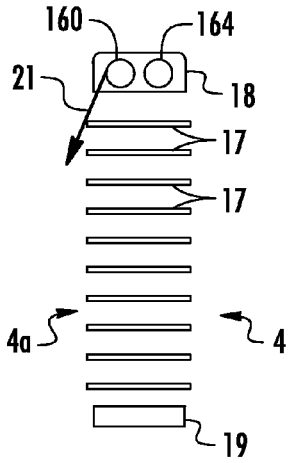
FIGS. 28A-28D are schematic views showing one arrangement of the lift cords of the window covering.
Figure 28B:
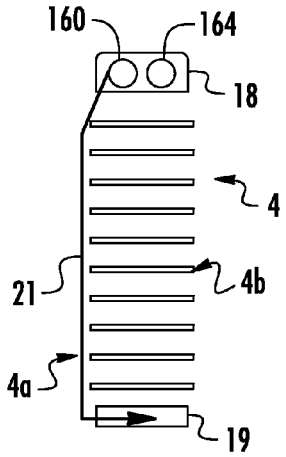
Figure 28C:
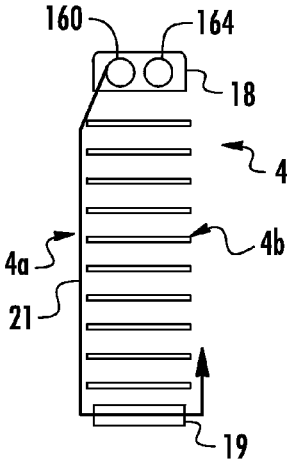
Figure 28D:
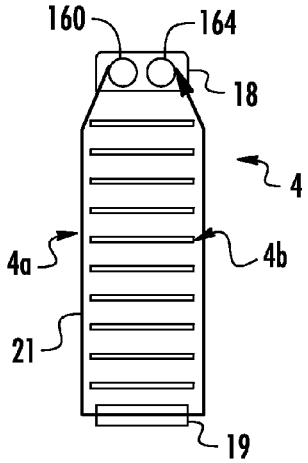

The assembly of a privacy-type lift cords will now be described with reference to FIGS. 28A-D. While more than one lift cord is typically provided on a window covering, the installation and arrangement of a single lift cord is described herein it being understood that the arrangement and installation of additional lift cords is accomplished in the same manner. In a privacy-type panel the lift cord 21 extends from adjacent head rail (FIG. 28A) down one side 4*a* of panel 4 (FIG. 28B), around the bottom of the panel or around or through the bottom rail 19 (FIG. 28C) and up the other side 4*b* of the panel 4 (FIG. 28D). Privacy-type panels may also be created by using two separate lift cord sections where one cord section extends from the head rail down one side 4*a* of the panel 4 and the second cord section extends from the head rail down the other side 4*b* of the panel 4 where the ends of the cord sections are connected to one another at the bottom rail and/or are connected to the bottom rail. The panel 4 may be a slatted blind, a cellular shade, Roman shade or other shade style. For panels such as a slatted blind the tilt cords, such as a ladder tilt cord, may be provided to tilt the slats between open and closed positions. Engagement structures such as loops may be provided on the panel 4 or on the tilt cords through which the lift cord 21 is threaded.

A first end of the lift cord 21 is threaded through an aperture in the head rail and through an aperture 714 in the lift spool cradle 168. The cord is operatively coupled to the drive spool 160 such that rotation of the spool winds the lift cord on the spool. In one embodiment a knot is tied in the first end of the lift cord 21 and the cord is inserted into a slot 199 on the drive spool 160 (FIG. 25) with the knot located internally of the spool. The gear cap 187 is attached to the spool 160 trapping the first end of the lift cord 21 in the slot 199. While one embodiment for attaching the lift cords to the spools is described, the lift cords may be operatively coupled to the spools using any suitable mechanism. The drive spool 160 is snapped into the cradle 168 with the spool 160 oriented such that the first end of the cord is adjacent the bottom of the cradle 168. These steps are repeated for attachment of the second end of the lift cord 21 to the driven spool 164.

Figure 44:
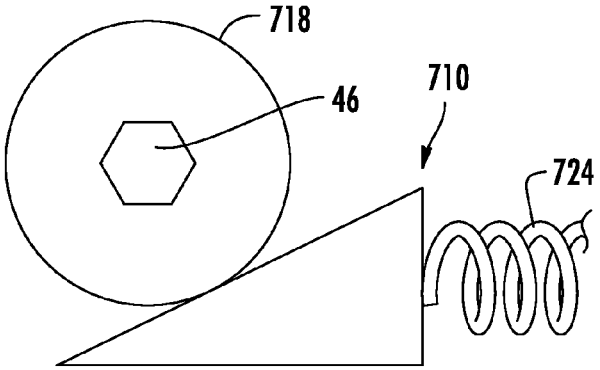
FIG. 44 is a perspective view of an embodiment of a head rail usable with the operating system of the invention.

The panel 4 is then suspended vertically from the head rail 18 by the lift cords. The lift cords 21 are wound on the spools 160 and 164 to take the slack out of the lift cords such that the panel is suspended at its full length and there is no slack in the lift cords. The shaft 46 is inserted through the mating keyed receptacles on the motor(s) 40, brake(s) 42 and drive spool(s) 160 to create the lift system as shown, for example, in FIG. 3. The pins 96 are then pulled out of the preloaded spring motors 40. The panel 4 is raised by lifting the bottom of the panel and/or bottom rail 19. As the panel 4 is raised the spring motors 40 operate as previously described to wind the lift cords 21 on the spools 160 and 164 and assist in raising the panel. The panel 4 is released to determine if the panel sags when released. If the panel sags, the adjustment mechanism such as screw 162 on the brake 42 is tightened to increase the braking force between the band brake 110 and the outer race 106. The brake 42 may also be loosened during this adjustment process if too much brake force is being applied and the panel is too difficult to lower. Likewise the head 1202 or screw 1301 of the adjustable force brake may be tightened or loosened to adjust the range of force applied by the variable force brake. To facilitate the adjustment of the brake an access aperture 9 may be formed in the head rail to allow a user to access the adjustment mechanism of brake 42 and adjust the amount of brake force applied to the system as shown in FIG. 44. The access aperture 9 is positioned relative e to the brake 42 such that the user may conveniently access the adjustment mechanism of the brake. In systems where the adjustment mechanism is a screw or similar mechanism the access aperture 9 allows a user to insert a tool such as a screwdriver 7 through the aperture 9 to access the brake. While a screwdriver is illustrated any tool that matingly engages the adjustment mechanism may be used. Moreover, the adjustment mechanism may comprise a thumb wheel or the like that may be accessed by a user's finger rather than a tool. The aperture 9 may be closed by a door or other closure feature or it may be left open. This process may be repeated several times to tune the brake 42 to match the load of the panel and the force actually output by the spring motors 40. With a size-in-store blind the tuning of the brake 42 may be performed again after the window covering is cut to the desired size to account for the lighter panel.

In addition to adjusting the brake force during manufacture of the window covering or as part of a size-in-store operation the adjustment mechanism allows a user to adjust the braking force during use of the window covering. For example, a user may adjust the brake force if the system ever becomes out of balance during use. For example, if the force output by the spring motors changes over time, the user can loosen or tighten the brake to accommodate the change in motor output without returning the blind to the manufacturer or even removing the blind from the window. Moreover the adjustment of the brake force may be used to adjust the operating parameters of the window covering. For example if the user does not require the window covering to be raised completely to the head rail the brake force may be lowered. One example of such a use would be in a situation where an eight foot tall window covering is installed but a user can only reach six feet. As a result the user will not be raising the window covering the full eight foot height of the panel. Because the panel is not fully raised the full eight feet the brake never needs to hold the full weight of the stacked panel. As a result the brake force may be lowered such that the maximum brake force applied to the system is set to hold six feet of panel rather than the maximum eight feet. The user may want to lower the maximum brake force in this situation to lower the force that needs to be applied to the panel by the user to lower the panel.

For a top down shade, where the top edge of the panel may be raised and lowered relative to the head rail, the operating system may be connected to the top edge of the panel 4 to control the movement of the top edge of the panel. In top down shades the top edge of the panel may include a middle rail. The lift cords are connected to the top edge or middle rail rather than to the bottom edge of the panel or bottom rail. In a top down shade the load on the system increases as the panel is raised because as the top of the panel is raised more of the shade panel is suspended from the top rail (rather than resting on the bottom rail) such that the operating system operates in the same manner to support the load and facilitate the raising and lowering of the top edge of the panel as previously described. "Top down/bottom up" shades are also known where the top edge/middle rail and the bottom edge/bottom rail are independently movable. In such systems two operating systems may be used where one operating system is connected to the top edge/middle rail and the other operating system is connected to the bottom edge/bottom rail. The two operating systems operate independently to control the movement of the panel.

Figure 50:
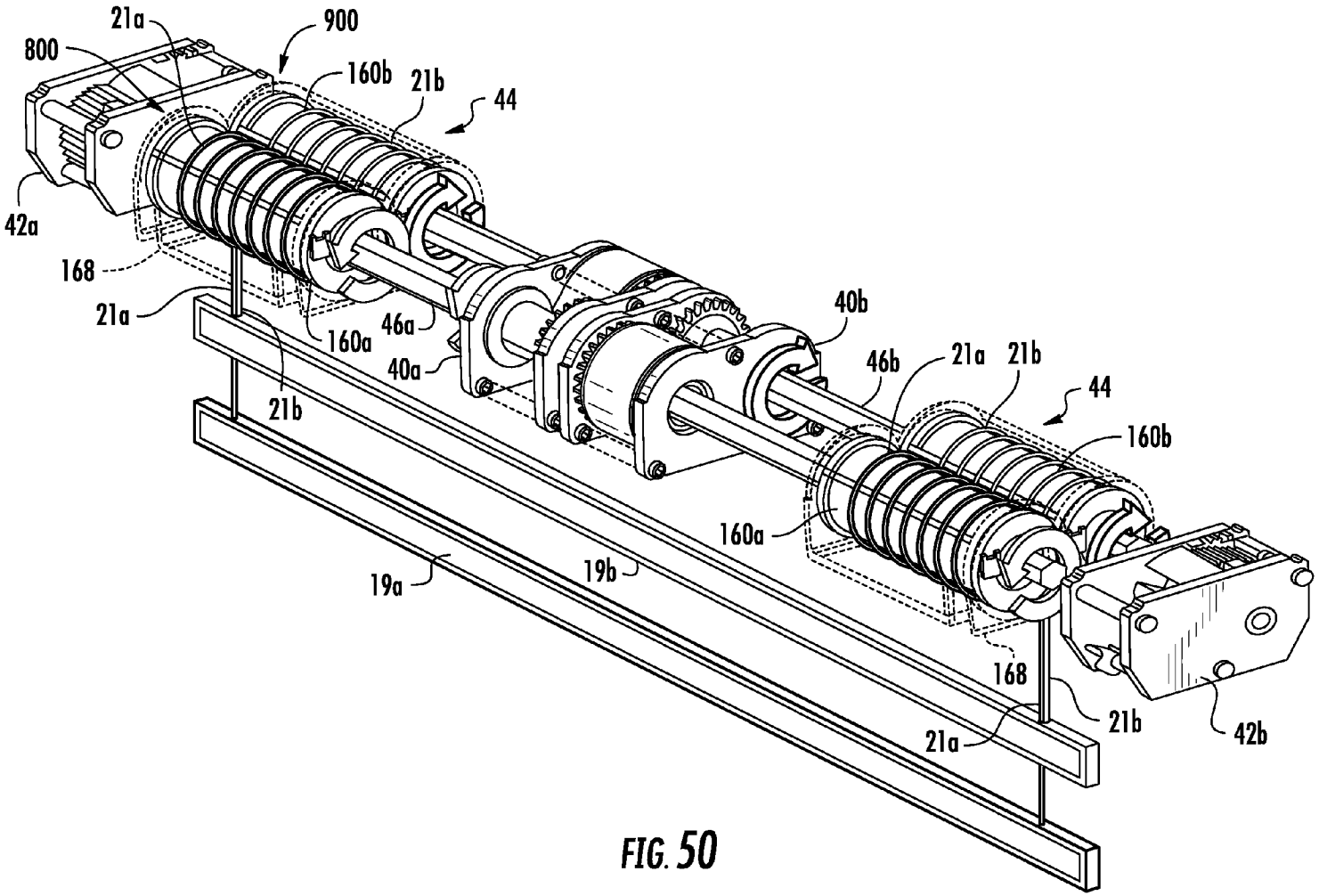
FIG. 50 is a perspective of yet another embodiment of an operating system of the invention.

An example embodiment of a top down/bottom up window covering is shown in FIG. 50. The system comprises a first operating system 800 including a first spool 160*a*, a second spool 160*a*, a spring motor 40*a*, a brake 42*a*, and a shaft 46*a* interconnecting the first spool 160*a*, the second spool 160*a*, the spring motor 40*a*, and the brake 42*a*. The first spool 160*a* and the second spool 160*a* are connected to the bottom rail 19*a* by lift cords 21*a*. The system further comprises a second operating system 900 including a first spool 160*b*, a second spool 160*b*, a spring motor 40*b*, a brake 42*b*, and a shaft 46*b* interconnecting the first spool 160*b*, the second spool 160*b*, the spring motor 40*b*, and the brake 42*b*. The first spool 164*b* and the second spool 164*b* are connected to the top rail 19*b* by lift cords 21*b*. The systems 800 and 900 operate independently of one another such that the first system 800 controls the movement of the bottom of the panel and the second system 900 controls movement of the top of the panel. To allow independent operation of the two systems, the spools 160*a* and 160*b* in each spool assembly 44 are not connected by gears such that the spools may rotate independently of one another and in opposite directions. Further, the shaft 46*a* of the first system 800 extends through but is not connected to the components of the second system 900 and the shaft 46*b* of the second system 900 extends through but is not connected to the components of the first system 800. For example, the drive spool of the motor 40*b* of the second operating system 900 comprises a through hole that allows the shaft 46*a* of the first operating system 800 to extend through the spool without being operatively connected to the spool. Likewise, the drive spool of the motor 40*a* of the first operating system 800 comprises a through hole that allows the shaft 46*b* of the second operating system 900 to extend through the spool without being operatively connected to the spool. Using the through holes described above allows two systems to be placed in the head rail using a minimum amount of space and allows the spool assemblies 44, described above, to be used to support the independent spools of the two operating systems in close proximity to one another in a single cradle 168. In the illustrated embodiment, the two operating systems are arranged to have essentially the same footprint as a single privacy shade system. However, it is also possible to use two completely separate and independent operating systems with one of the operating systems supporting the top end of the panel and the other of the operating systems supporting the bottom end of the panel.

Referring to FIG. 29, because the components such as the brakes 42, lift spool systems 44*a-d* and motors 40*a-b* are independent from one another and modular, these components may be located anywhere along the length of the shaft 46. The components all use a keyed receptacle or other coupler that engages the shaft 46. While the brakes, spring motors and drive spools are described as being operatively coupled to one another using non-round receptacles and a mating non-round shaft 46, the coupling may comprise other mechanisms. For example, the shaft and receptacles may have round profiles and a separate coupling collar, cotter pin or set screw arrangement or the like may be used to key the components together. Because the receptacles extend completely through the components, the shaft 46 may be inserted through the components and the components may be mounted in any position and in any order in the head rail and along the shaft. In one embodiment the shaft 46 is fiberglass to accommodate small variations in the linearity of the path between the components.

In one embodiment a single shaft 46 extending through all of the components may be used; however, in other embodiments the shaft may be provided as multiple segments where a segment extends between the components such as between the motors, cradle, and brake. For example, a first shaft segment may extend from the left end of the head rail through spool system 44*a* and motor 40*a* and terminate inside of the drive spool of spool system 44*b* where the shaft is operatively coupled to the drive spool. A second shaft segment may extend from, and be operatively coupled to, the drive spool of spool system 44*b* and extend through the remaining components. In such an embodiment, the shaft segments function as a single shaft because the shaft segments are operatively coupled to one another by the common component(s) (the drive spool of spool system 44*b* in the present example). While a system with a single shaft 46 and a two segment shaft have been described other embodiments using a greater number of shaft segments may be used where the shaft segments are coupled in series by the common components such that the shaft segments are operatively coupled to one another to form an effective shaft that synchronizes the movement of the components.

All of the components of the system may be disposed inside of the ends of the head rail 18 such that the head rail extends beyond each end of the lift system a desired length L. In one embodiment length L may be approximately 3 inches; however, length L may be varied to accommodate various cut down lengths. The length the head rail extends beyond the ends of the operating system may be cut off in a size-in-store operation such that the window covering may be sized to a customer desired size. While size-in-store systems and cutting machines are known, the operating system of the invention allows a window covering with a cordless operating system to be used in a size-in-store system.

Because the components are modular and independent from one another, the motors 40 may be positioned anywhere along the length of the shaft 46 and the motors do not have to be co-located with one another. This provides an advantage because the torques exerted on the shaft 46 by the motors 40 may be spread out along the length of the shaft 46 to shorten the length of the shaft over which the torques are applied. In systems that place all of the motors at one end of the shaft significant twisting forces are accumulated over the length of the shaft. In the system of the invention, where the motors 40 may be placed anywhere along the length of the shaft 46, the load accumulation may be minimized. For example, if four lift spool systems 44 are used and three motors 40 are required to handle the load of the panel 4, the motors 40 may be alternated with the lift spool systems 44 along the length of the shaft 46 such that the torsional load on the shaft is minimized. Moreover, the number of motors 40 is not tied to the number of lift cords 21, lift spool systems 44 or brakes 42 such that the motors, lift cords, lift spool systems and brakes may be provided as needed.

Additional lift spool systems 44, brakes 42 and motors 40 may also be added to the system by simply adding more components into the head rail before inserting the shaft 46. As a result, the system may be easily scaled to work with larger or smaller or heavier or lighter window coverings. Because all of the components are synchronized through the shaft 46, it is possible to scale up the system by multiplying the number of motors 40 by the factor of the window width. For example, for a particular window covering style the motor may be sized for a particular span (e.g. 12 inches) and then propagated in multiples of that basic span to create larger span window coverings or window coverings having a greater mass (e.g. panel mass may change with slatted blind compositions, such as real wood, faux wood, composites etc.). The length of the shaft 46 may be increased for larger and/or heavier window coverings to accommodate additional components but because the components may be located at any location along the length of the shaft excessive twisting loads are not created on the shaft. The operating system may also be scaled to very short spans, as small as 6 inches, by locating all of the components in close proximity to one another. The modular system simplifies the manufacture of the window covering, is scalable, allows easy replacement of components and is relatively inexpensive.

Figure 30:
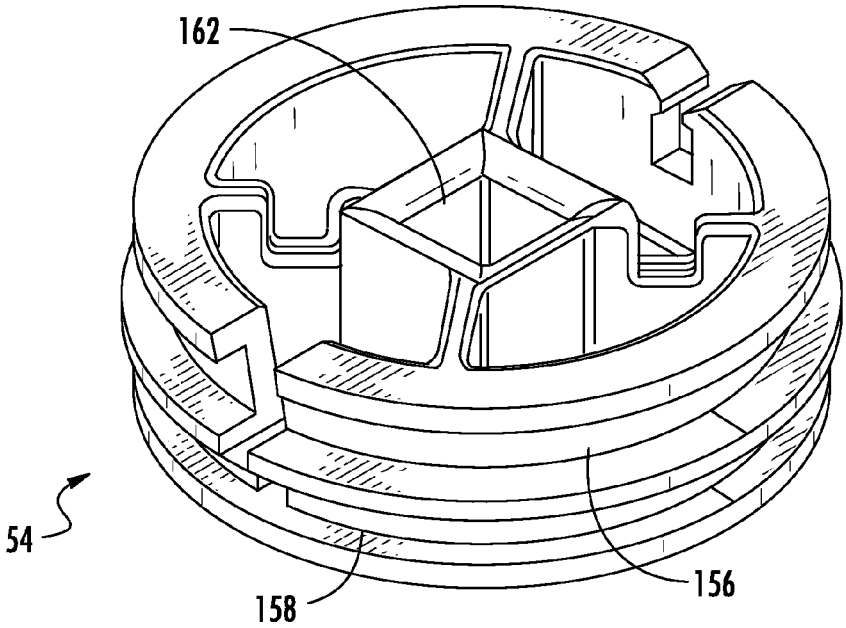
FIG. 30 is a perspective view of a tilt cord drum usable in the operating system of FIG. 1.
Figure 31:
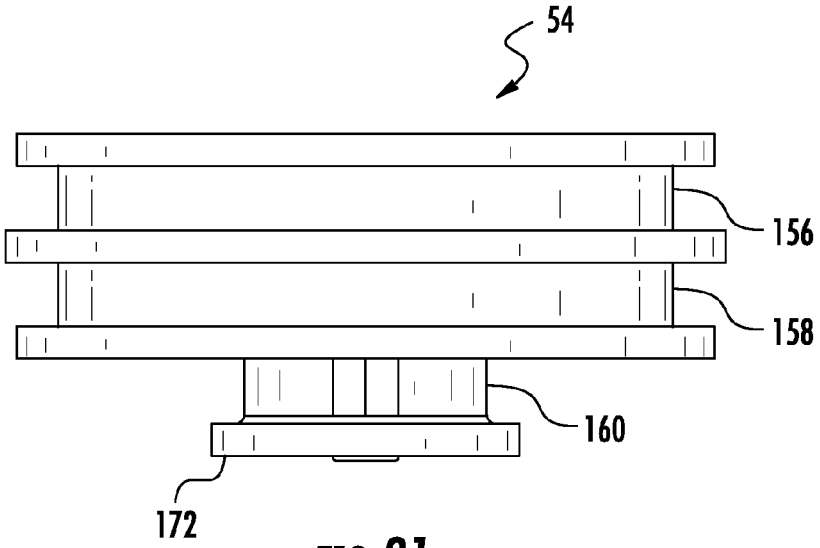
FIG. 31 is an end view of the tilt cord drum of FIG. 30.

The operating system also accommodates a tilt system for use with slatted blinds where the slats may be tilted for light control and privacy in addition to being raised and lowered. The tilt system may be omitted in window coverings such as cellular shades or Roman shades or the like where tilting of slats is not required. Referring to FIGS. 4, 30 and 31 the tilt system comprises a second shaft 52 on which at least one tilt drum 54 is provided. One tilt drum 54 is provided for each tilt cord 20 such that in a typical window covering two drums 54 are provided and in larger blinds three or more tilt drums 54 may be used. The tilt drum 54 comprises a first drum 156 for receiving a first vertical cord 28 of the tilt ladder 20, a second drum 158 for receiving a second vertical cord 30 of the tilt ladder 20 and a bearing surface 160 for supporting the tilt drum 54 for rotary motion. The tilt drum 54 also comprises a through hole receptacle 162 for receiving the shaft 52 such that the shaft 52 and tilt drum 54 rotate together. The tilt system also comprises a tilt assembly 50 that rotates the shaft 52. The tilt assembly 50 comprises an actuator such as a tilt wand or cord 25 that is manipulated to rotate the shaft 52. The tilt cord or wand 25 may be operatively coupled to the shaft 52 by a suitable transmission 164 such as a gear train. The shaft 52 is operatively coupled to the output of the transmission 164 and is inserted through the keyed receptacles 162 of the tilt drums 54. The bearing surfaces 160 of the tilt drums 54 may be supported on cradles 170 that are formed in the side plates of the lift spool systems 44 and motors 40 such that the tilt drums 54 may rotate on the cradles 170. The cradles 170 may be formed as recesses in the top edges of the side plates. The side plates may support the bearing surfaces 160 such that the side plates are trapped between the drums 156, 158 and the enlarged head 172. Other arrangements for rotatably supporting the tilt drums 54 and or shaft 52 may also be used. One vertical cord 28 of the tilt cord ladder is wound on one drum 156 in a first direction and the other vertical cord 30 of the tilt cord ladder is wound on the other drum 158 in a second direction such that as the drums 54 are rotated clockwise and counterclockwise the front and rear vertical cords are alternately raised and lowered to tilt the slats.

With any shade panel it is desirable to have the bottom edge of the panel and/or bottom rail level during use of the window covering. When the panel is in any raised position, the levelness of the bottom edge of the panel and/or bottom rail is directly related to the variation in lengths of the lift cords spanning the width of the window covering. Where one lift cord is shorter than the other lift cord, the bottom of the panel will angle upward toward the shorter lift cord. A system for equalizing the lengths of the lift cords to provide a level bottom rail is described with reference to FIGS. 32 through 37.

Figure 32:
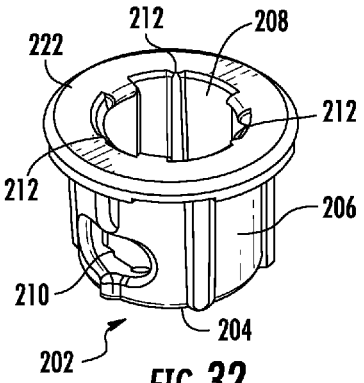
FIG. 32 is a perspective view of an embodiment of a component for a lift cord adjustment assembly usable in the operating system of the invention.
Figure 33:
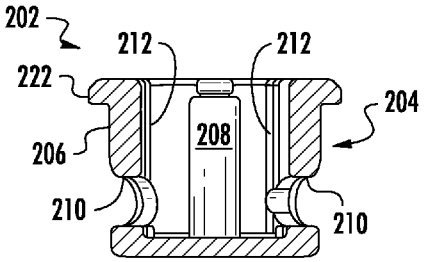
FIG. 33 is a section view of the component of FIG. 32.

An adjustment assembly 200 (FIG. 36) is mounted in the bottom rail 19 that engages a lift cord 21 to adjust the length of the lift cord to achieve a level bottom rail. Referring to FIGS. 32 and 33, the adjustment assembly 200 comprises a sleeve anchor 202 that fits into a hole or aperture formed in the bottom rail 19, typically on the underside of the rail. The sleeve anchor 202 comprises a cup shaped member 204 having a cylindrical side wall 206 that defines an interior space 208 that is dimensioned to receive a spool plug 216. The side wall 206 is formed with a pair of opposed apertures 210 that extend through the side wall. The interior surface of the side wall 206 is formed with a plurality of extending tabs or projections 212.

Figure 34:
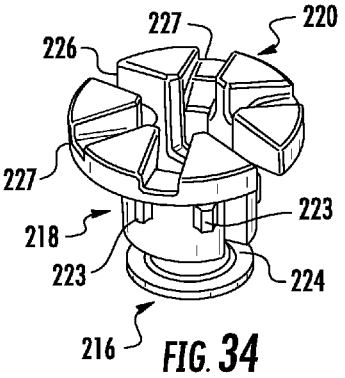
FIG. 34 is a perspective view of an embodiment of another component for the lift cord adjustment assembly usable in the operating system of the invention.
Figure 35:
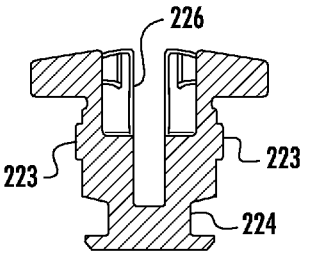
FIG. 35 is a section view of the component of FIG. 34.
Figure 36:
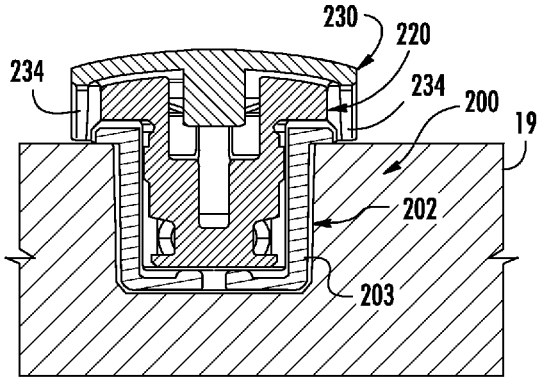
FIG. 36 is a section view of the lift cord adjustment assembly.

Referring to FIGS. 34 and 35, the spool plug 216 includes a stem 218 that extends into the sleeve anchor 202 and a head 220 that abuts the rim 222 of the sleeve anchor 202 when the plug 216 is fully inserted in the sleeve anchor 202. The plug 216 may rotate in the sleeve anchor 202 about its longitudinal axis. The stem 218 includes a plurality of outwardly projecting tabs or projections 223. The stem 218 also defines a drum 224 at the end remote from head 220. An axially extending slot 226 is formed in the head 220 and stem 218 that is transverse to the axis of rotation of the plug 216. A plurality of other slots 227 are formed in the head 220 that are angularly offset from slot 226 and that are transverse to the axis of rotation of the plug 216.

To use the adjustment assembly, a bore or hole 203 is formed on the bottom rail 19 that is dimensioned to receive the sleeve anchor 202. Typically, the sleeve anchor 202 is mounted on the bottom rail 19 so as to be vertically aligned with the lift spool assembly 44 and the lift cord 21. The portion of the lift cord 21 that passes below or through the bottom rail 19 (FIGS. 27B-27C) is inserted through the sleeve anchor 202 by threading the cord through the two apertures 210 during the initial installation of the lift cord. A short loop of cord is pulled through the sleeve anchor 203 and is inserted into and across the transverse slot 226 formed in the plug 216. The plug 216 is inserted into the sleeve anchor 202 such that the cord enters sleeve anchor 202 through one aperture 210, extends through the transverse groove 226 in the plug 216 and exits sleeve anchor 202 through the other aperture 210. The adjustment assembly 200 (without cap 230) is inserted into the bore formed in the bottom rail. The sleeve anchor may be held to the bottom rail by a snap fit, adhesive, fasteners or the like. This process is repeated for all of the lift cords 21.

The window covering is then supported from the head rail and the bottom rail 19 is checked for level. If it is not level, the longer lift cord (the lower end of the bottom rail) is adjusted. The length of the cord is adjusted by rotating the plug 216 in the sleeve anchor 202. As the plug 216 rotates, the cord 21 is wrapped around the plug 216 in drum 224 to shorten its effective length. The plugs 216 are rotated until the bottom rail is level. As the plug 216 is rotated projections 223 on the plug 216 ratchet over the projections 212 on the anchor sleeve 202 such that when the plug 216 is released the engaging projections hold the plug 216 in position relative to the anchor sleeve 202. Each "click" of the plug 216 over projections 212 may shorten or lengthen the lift cord a predetermined distance such as one-eighth of an inch such that if the user needs to shorten a lift cord a quarter of an inch the plug 216 is rotated two "clicks". The ratcheting movement may provide tactile and audible feedback to the user. Once the lift cords are properly adjusted, the bottom of the tilt cord (if a tilt cord is used such as in a slatted blind) is inserted into one of the slots 226 or 227 on the head 220 of the plug 216. A cap 230 is then inserted over and engages the head 220 of the plug 216 and the rim 222 of sleeve anchor 202. The cap 230 holds the tilt cord in place and fixes the position of the plug 216 relative to the sleeve anchor 202. The cap 230 is provided with cross-members 231 that engage slots 226 and 227 and tabs 232 that engage mating surfaces on the sleeve anchor 202 to connect these components together. The cap 230 is also provided with slots 234 for receiving the tilt cords.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. An operating system for a window covering comprising:

a spring motor;

a variable force brake including an outer race and a brake member, said brake member being operatively coupled to said outer race such that said brake member is configured to apply a braking force to said outer race;

a lift spool assembly operatively coupled to a panel for raising and lowering the panel between a raised position and a lowered position;

a shaft operatively coupled to each of said spring motor, said variable force brake, and said lift spool assembly and synchronizing said spring motor, said variable force brake, and said lift spool assembly; and a cam rotationally coupled to said shaft, said cam defining a cam surface and being configured to actuate a cam follower as said cam is rotated relative to said cam follower, said cam follower being operatively coupled to said brake member and being actuated by said cam in a direction non-parallel to a rotational axis of said cam;

wherein:

said outer race is selectively coupled for rotation with said shaft by a one-way clutch; and the braking force applied by said brake member to said outer race varies as a function of a position of the panel between the raised and lowered positions.

2. The operating system of claim 1, wherein:

said cam follower rides along said cam surface as said cam is rotated relative to said cam follower;

said cam follower being operatively coupled to said brake member to vary the braking force as the panel is moved between the raised and lowered positions.

3. The operating system of claim 1, wherein:

a magnitude of the braking force is varied over a force range as the panel is moved between the raised and lowered positions; and the force range is adjustable.

4. The operating system of claim 1, wherein:

said one-way clutch comprises a one-way needle bearing that receives said shaft; and said one-way needle bearing is mounted for rotation with the said outer race.

5. The operating system of claim 1, wherein said cam follower is operatively coupled to said brake member via an adjustment mechanism.

6. The operating system of claim 5, further comprising a spring compressed between said adjustment mechanism and said brake member;

wherein said adjustment mechanism is configured to be actuated to vary the compression of said spring between said adjustment mechanism and said brake member so as to adjust the braking force.

7. The operating system of claim 5, wherein:

said outer race has a generally cylindrical shape that defines a cylindrical brake surface; and said brake member comprises a band brake that is in contact with said cylindrical brake surface around at least a portion of an outer circumference of said outer race.

8. The operating system of claim 7, wherein:

said band brake has a first fixed end and a second movable end; and said adjustment mechanism is configured to move said second movable end relative to said first fixed end to adjust the braking force applied by said band brake to said outer race.

9. The operating system of claim 1, wherein:

said cam surface is shaped such that the cam follower is linearly actuated between a first position and a second position as said cam follower rides along said cam surface with rotation of said cam, and the braking force varies as said cam follower is linearly actuated between said first and second positions.

10. The operating system of claim 9, wherein a distance of said cam surface from a rotational axis of said cam varies across at least a portion of said cam surface to adjust a position of said cam follower between the first and second positions as said cam follower rides along said cam surface.

11. The operating system of claim 1, wherein:

the braking force is at a maximum braking force when the panel is at the raised position; and the braking force is at a minimum braking force when the panel is at the lowered position.

12. The operating system of claim 11, wherein the braking force is continuously varied as the panel moves along the range of motion between the raised and lowered positions.

13. An operating system for a window covering comprising:

a spring motor;

a variable force brake including an outer race, a brake member, and an adjustment mechanism, said brake member being configured to apply a braking force to said outer race, said adjustment mechanism being operatively coupled to said brake member to adjust the braking force applied to said outer race by said brake member;

a lever coupled to said adjustment mechanism;

a lift spool assembly operatively coupled to a panel for raising and lowering the panel between a raised position and a lowered position; and a shaft operatively coupled to each of said spring motor, said variable force brake, and said lift spool assembly;

wherein:

said lever is configured to pivot as the panel is being moved between the raised and lowered positions to actuate said adjustment mechanism such that the braking force applied by said brake member to said outer race varies as a function of a position of the panel between the raised and lowered positions.

14. The operating system of claim 13, wherein said outer race is selectively coupled for rotation with said shaft by a one-way clutch.

15. The operating system of claim 13, wherein:

said brake member comprises a band brake extending around at least a portion of an outer circumference of said outer race between a first end and a second end; and said second end of said band brake is configured to be moved relative to said first end of said band brake to adjust the braking force applied by said band brake to said outer race.

16. The operating system of claim 15, wherein a portion of said adjustment mechanism is configured to engage said second end of said band brake to allow said second end to be moved relative to said first end of said band brake.

17. The operating system of claim 16, wherein:

said portion of said adjustment mechanism corresponds to a spring compressed between said second end of said band brake and a separate portion of said adjustment mechanism; and a compressive force of said spring is varied to adjust the position of said second end relative to said first end of said band brake.

18. The operating system of claim 13, further comprising a cam rotationally coupled to said shaft, said cam being configured to actuate said lever as said shaft is being rotated.

19. The operating system of claim 18, wherein:

said cam is rotationally coupled to said shaft via a transmission;

said transmission including a gear train that limits rotation of said cam to less than 360 degrees as said shaft is being rotated more than 360 degrees to move the panel between the raised and lowered positions.

20. The operating system of claim 18, wherein:

said cam is operatively coupled to said lever via a cam follower; and said cam follower is configured to engage a cam surface of said cam as said cam is rotated with rotation of said shaft.

21. The operating system of claim 20, wherein:

said cam surface is shaped such that the cam follower is linearly actuated between a first position and a second position as said cam follower rides along said cam surface with rotation of said cam; and the braking force varies as said cam follower is linearly actuated between said first and second positions.

22. The operating system of claim 13, wherein:

the braking force is at a maximum braking force when the panel is at the raised position; and the braking force is at a minimum braking force when the panel is at the lowered position.

23. The operating system of claim 22, wherein the braking force is continuously varied as the panel moves along the range of motion between the raised and lowered positions.

24. An operating system for a window covering comprising:

a spring motor;

a variable force brake including an outer race and a brake member, said brake member being operatively coupled to said outer race such that said brake member is configured to apply a braking force to said outer race;

a lift spool assembly operatively coupled to a panel for raising and lowering the panel between a raised position and a lowered position;

a shaft operatively coupled to each of said spring motor, said variable force brake, and said lift spool assembly and synchronizing said spring motor, said variable force brake, and said lift spool assembly; and a cam rotationally coupled to said shaft, said cam defining a cam surface and being configured to actuate a cam follower as said cam is rotated relative to said cam follower, said cam follower being operatively coupled to said brake member via an adjustment mechanism;

wherein:

said outer race is selectively coupled for rotation with said shaft by a one-way clutch;

the braking force applied by said brake member to said outer race varies as a function of a position of the panel between the raised and lowered positions;

said outer race has a generally cylindrical shape that defines a cylindrical brake surface; and said brake member comprises a band brake that is in contact with said cylindrical brake surface around at least a portion of an outer circumference of said outer race.

25. The operating system of claim 24, wherein:

said band brake has a first fixed end and a second movable end; and said adjustment mechanism is configured to move said second movable end relative to said first fixed end to adjust the braking force applied by said band brake to said outer race.

* * * * *